US009528299B2

(12) United States Patent
Yoon et al.

(10) Patent No.: US 9,528,299 B2
(45) Date of Patent: Dec. 27, 2016

(54) DIGITAL ENTRANCE OPENING AND CLOSING DEVICE

(71) Applicants: Byungman Yoon, Gyeonggi-do (KR); Eunsook Lee, Gyeonggi-do (KR); Chaehi Yoon, Gyeonggi-do (KR); Chaeho Yoon, Gyeonggi-do (KR)

(72) Inventors: Byungman Yoon, Gyeonggi-do (KR); Eunsook Lee, Gyeonggi-do (KR); Chaehi Yoon, Gyeonggi-do (KR)

(73) Assignees: Byungman Yoon, Gyeonggi-Do (KR); Eunsook Lee, Gyeonggi-Do (KR); Chaehi Yoon, Gyeonggi-Do (KR); Chaeho Yoon, Gyeonggi-Do (KR)

( * ) Notice: Subject to any disclaimer, the term of this patent is extended or adjusted under 35 U.S.C. 154(b) by 260 days.

(21) Appl. No.: 14/498,890

(22) Filed: Sep. 26, 2014

(65) Prior Publication Data

US 2015/0128667 A1 May 14, 2015

Related U.S. Application Data

(63) Continuation-in-part of application No. PCT/KR2013/002835, filed on Apr. 5, 2013.

(30) Foreign Application Priority Data

Apr. 17, 2012 (KR) ..... 10-2012-0039747
Apr. 17, 2012 (KR) ..... 10-2012-0040019
May 21, 2012 (KR) ..... 10-2012-0053498

(51) Int. Cl.
*E05B 49/00* (2006.01)
*E05B 47/00* (2006.01)
(Continued)

(52) U.S. Cl.
CPC ..... *E05B 49/00* (2013.01); *E05B 9/02* (2013.01); *E05B 15/00* (2013.01); *E05B 47/00* (2013.01);
(Continued)

(58) Field of Classification Search
CPC .. E05B 47/00; E05B 47/0001; E05B 47/0046; E05B 47/02; E05B 47/026; E05B 47/06; E05B 2047/0014; E05B 2047/0018; E05B 2047/0048; E05B 2047/0072; E05B 2047/0084; E05B 49/00
See application file for complete search history.

(56) References Cited

FOREIGN PATENT DOCUMENTS

KR 20000074623 A 12/2000
KR 200330156 10/2003
(Continued)

*Primary Examiner* — Christopher Boswell
(74) *Attorney, Agent, or Firm* — Lucas & Mercanti, LLP

(57) ABSTRACT

Disclosed herein is a digital opening and closing device for an entrance. The device includes: a housing which includes an outer casing and an inner casing with a door interposed between the inner and outer casings; a password input unit which is provided on the outer casing; a door opening and closing unit which is installed in the housing and conducts the operation of opening or closing the door; a control unit which compares a password input to the password input unit with a preset reference password and controls the door opening and closing unit; an opening button which is provided on the inner casing and is used in automatically opening the door; a manual opening button which prevents the door from being automatically locked when the door is closed; and a power supply supplying drive power to the elements.

47 Claims, 35 Drawing Sheets

(51) Int. Cl.

| | |
|---|---|
| ***E05B 47/02*** | (2006.01) |
| ***E05B 9/02*** | (2006.01) |
| ***E05B 15/00*** | (2006.01) |
| ***E05B 47/06*** | (2006.01) |
| ***E05B 55/00*** | (2006.01) |
| ***G07C 9/00*** | (2006.01) |
| ***E05B 59/00*** | (2006.01) |
| ***E05B 63/20*** | (2006.01) |
| ***E05B 65/10*** | (2006.01) |
| ***E05C 1/14*** | (2006.01) |

(52) U.S. Cl.

CPC ..... *E05B 47/0001* (2013.01); *E05B 47/0012* (2013.01); *E05B 47/02* (2013.01); *E05B 47/026* (2013.01); *E05B 47/06* (2013.01); *E05B 55/00* (2013.01); *E05B 59/00* (2013.01); *E05B 63/20* (2013.01); *E05B 65/104* (2013.01); *E05C 1/14* (2013.01); *G07C 9/00142* (2013.01); *E05B 2047/0048* (2013.01); *E05B 2047/0056* (2013.01); *E05B 2047/0067* (2013.01); *E05B 2047/0068* (2013.01); *E05B 2047/0072* (2013.01); *E05B 2047/0086* (2013.01); *Y10T 70/625* (2015.04); *Y10T 70/7068* (2015.04); *Y10T 70/8946* (2015.04)

(56) References Cited

FOREIGN PATENT DOCUMENTS

| | | | |
|---|---|---|---|
| KR | 1020060079703 | | 7/2006 |
| KR | 20080093729 | A | 10/2008 |
| KR | 20080099572 | A | 11/2008 |
| KR | 100888514 | B1 | 3/2009 |
| KR | 2020090002488 | | 3/2009 |
| KR | 1020090054103 | | 5/2009 |

DIGITAL ENTRANCE OPENING AND CLOSING DEVICE

CROSS REFERENCE TO RELATED APPLICATIONS

This Application is a continuation-in-part of PCT/KR2013/002835 filed Apr. 5, 2013, which claimed the priority of KR Patent Application No. 10-2012-0039747 filed Apr. 17, 2012, KR Patent Application No. 10-2012-0040019 filed Apr. 17, 2012, KR Patent Application No. 10-2012-0053498 filed May 21, 2012, contents of each of which are incorporated herein by reference in their entirety.

BACKGROUND OF INVENTION

Field of Invention

The present invention relates, in general, to digital opening and closing devices for entrances and, more particularly, to a digital opening and closing device for an entrance which is configured such that a door can be opened in such a way that a handle of the door is pushed or pulled in a direction in which the door opens, and such that a user can sense that the is opening.

Prior Art Document

Korean Patent Unexamined Publication No.: 10-2010-0070191 (Publication date: Jun. 25, 2010)

Korean Patent Registration No. 10-1008980 (Publication date: Jan. 17, 2011)

Generally, digital door locks are high-tech locking devices which use passwords, semiconductor chips, smart cards, fingerprints, etc. in lieu of using conventional keys. All digital door locks operate in a way of using an electronic key, inputting a password, or reading a card or fingerprint, etc. and electronically lock or unlock a door in response to a corresponding signal.

In a conventional digital door lock, a mortise including a dead bolt and a latch bolt is installed in a door. Functioning to lock or unlock the door, the mortise is intimately connected both to an outer body of the door lock which is installed outdoors and to an inner body which is installed indoors.

However, when unlocking a conventional digital door lock, opening the door and going out through the door, a user has to conduct three successive operations of rotating a lever or pushing a button to unlock the dead bolt, rotating a door handle to unlock the latch bolt, and then pushing or pulling the door.

Particularly, successive operations of rotating the door handle with the hand in one direction and pushing or pulling the door may make it difficult for children, the elderly and disabled persons, etc. to pass through the door because they may not be able to easily rotate the door handle. Furthermore, if the user is using both hands to hold objects, he or she must put down at least one of the objects or have help from others to operate the door. Without help the user must pick up the object again after opening the door and then pass through the door.

Moreover, most conventional mortises are produced for right-handed people. Hence, left-handed people must accept inconvenience or purchase separate mortises suitable for them.

In addition, when many people gather in places such as public offices or venues, or in the case of an emergency, for example, a fire, a flood, etc., a user in confusion may not easily be able manipulate the door handle, and there is also the increased possibility of an accident because the operation of rotating the door handle makes opening the door slow.

SUMMARY OF INVENTION

Accordingly, the present invention has been made keeping in mind the above problems occurring in the prior art, and an object of the present invention is to provide a digital opening and closing device for an entrance which is operated in such a way that when pushing or pulling a handle of a door in a direction of opening of the door, a user can sense the opening of the door due both to a reduction in speed at which the door handle is pushed or pulled and to the rolling motion of a roller.

Another object of the present invention is to provide a digital opening and closing device for an entrance which is configured such that the door, when closed, is automatically locked.

A further object of the present invention is to provide a digital opening and closing device for an entrance which may be configured for doors used in crowded places such as public offices or venues, such that when the door is closed it is prevented from being automatically locked, thereby enabling people to rapidly pass through the door.

DETAILED DESCRIPTION OF INVENTION

In order to accomplish the above objects, in an aspect, the present invention provides a digital opening and closing device for an entrance, including: a housing comprising an outer casing installed on an outdoor surface of a door, and an inner casing coupled to the outer casing with the door interposed between the inner and outer casings; a password input unit provided on the outer casing of the housing, the password input unit being used in inputting a password; a door opening and closing unit installed in the housing, the door opening and closing unit conducting an operation of opening or closing the door in response to a control signal of a control unit; the control unit comparing a password input to the password input unit with a preset reference password and controlling the door opening and closing operation of the door opening and closing unit; an opening button provided on the inner casing of the housing, the opening button being connected to the control unit and used in automatically opening the door; a manual opening button applying a signal to the control unit to prevent the door from being automatically locked when the door is closed; and a power supply supplying drive power to the elements, wherein the door opening and closing unit is configured such that: a door is opened by an operation of pushing or pulling a door handle in a direction in which the door opens; when the door handle is pushed or pulled, opening of the door is sensed by a reduction in speed at which the door handle is pushed or pulled; and locking of the door can be selectively controlled in such a way that the door is automatically locked when the door is closed, or the door is prevented from being automatically locked when the door is closed.

The digital opening and closing device may include an identification unit provided in the outer casing of the housing, the identification unit functioning to identify a visitor. The control unit may compare information input to the identification unit with preset reference information and control the door opening and closing operation of the door opening and closing unit. The identification unit may include at least one of a door phone camera, a card reader, a fingerprint reader and an iris reader.

The door opening and closing unit may include: a body unit having, in a side surface thereof, a first opening in which a latch bolt is disposed, a second opening in which a dead bolt is disposed, and a third opening in which a sensing bolt is disposed; door handles respectively provided below the inner and outer casings of the housing, each of the door handles being configured to be pushed or pulled; a latch bolt moving unit configured such that when either of the door handles is pushed or pulled, the latch bolt is retracted into the door to allow the door to open, and when the door handle that has been pushed or pulled is released, the latch bolt is ejected outwards from the door to maintain the door in a closed state; an opening-and-closing sensing unit for sensing an operation of opening or closing the door and transmitting a sensing signal to the control unit; and a dead bolt moving unit controlling movement of the dead bolt in response to a control signal of the control unit and locking or unlocking the door.

Each of the door handles may include: a mounting bracket fixed to a corresponding one of the outer and inner casings of the housing, the mounting bracket having a receiving space in which a first end of a grip part is disposed so as to be movable forwards or backwards; and the grip part inserted at the first end thereof into the receiving space of the mounting bracket, the grip part being configured to be pushed or pulled.

The control unit, when receiving a door-close signal from the opening-and-closing sensing unit, may control operation of the dead bolt moving unit such that the door is locked.

The control unit, when receiving the signal of the manual opening button, may control operation of the dead bolt moving unit such that the door is prevented from being locked.

The digital opening and closing device may further include an opening and closing checking unit, having a sensor sensing conditions of movement of the dead bolt moving unit and transmitting a sensing signal to the control unit, the opening and closing checking unit being connected to a speaker so that whether the door is locked or not is output in a voice in response to the sensing signal of the sensor.

The latch bolt moving unit may include: a movable member coupled at opposite ends thereof to the respective door handles, the movable member being horizontally moved by pushing or pulling either of the door handles, with a lift guide block provided on a medial portion of an upper surface of the movable member, the lift guide block guiding upward movement of a roller; a rotating unit coupled at a medial portion thereof to a rotation shaft, the rotation shaft fixed in place and oriented in a direction parallel to the movable member, with the roller provided in a first end of the rotating unit, the roller making contact with the lift guide block, and with a locking stop provided on a second end of the rotating unit, wherein when the movable member is horizontally moved, the rotating unit is rotated around the rotation shaft; an actuating member locked at a first end thereof to the locking stop of the rotating unit and coupled at a second end thereof to the latch bolt disposed in the first opening of the body unit, the actuating member being moved to leftwards or rightwards depending on a direction of the rotation of the rotating unit; and a restoring spring wrapped around the rotation shaft of the rotating unit, the restoring spring fixed at a first end thereof to an inner surface of the body unit and fixed at a second end thereof to the second end of the rotating unit so that the rotating unit is returned to an original state thereof by the restoring spring.

The lift guide block may include an inclined surface having an upwardly curved shape so that the roller rolls on the inclined surface and moves upwards.

Furthermore, until the lift guide block of the movable member begins to push the roller, the door handles may be easily pushed or pulled, and when the lift guide block pushes the roller so that the roller rolls and moves upwards along the inclined surface of the lift guide block, a speed at which the door handles are pushed or pulled may be reduced.

The rotating unit may include: a pair of links spaced apart from each other by a predetermined distance, with a coupling hole formed in a medial portion of each of the links so that the links are coupled to the rotation shaft through the coupling holes; bent parts respectively provided on the first ends of the links and bent in a direction parallel to a direction in which the lift guide block moves, with the roller coupled to the bent parts by a hinge; and a connection part connecting the second ends of the links to each other, with the locking stop connected to the connection part, the locking stop being bent downwards.

The actuating member may have: a locking slot formed in a bottom surface of a first end of the actuating member so that the locking stop of the rotating unit is locked to the locking slot; and a guide slot formed in a side surface of the actuating member, with a stopper coupled to the guide slots, the stopper being used in limiting rotation of the locking stop.

The dead bolt moving unit may include: a motor configured to be operated in response to a signal of the control unit; an actuating shaft rotated leftwards or rightwards by the operation of the motor; a rotating lever coupled to the actuating shaft and disposed in the body unit, the rotating lever being rotated leftwards or rightwards by the rotation of the actuating shaft; and an opening and closing member coupled to the dead bolt disposed in the second opening of the body unit, the opening and closing member being moved leftwards or rightwards in conjunction with the rotation of the rotating lever.

The actuating shaft may have a rectangular cross-section, and the rotating lever may have in a central portion thereof a rectangular hole into which the actuating shaft is fitted so that when the actuating shaft rotates, the rotating lever is rotated along with the actuating shaft.

The opening and closing member may have: a guide slot in a central portion thereof, the guide slot extending a predetermined length in a longitudinal direction of the opening and closing member, with a support pin disposed in the guide slot, the support pin protruding from an inner surface of the body unit; a locking depression formed at a predetermined position in an upper edge of the opening and closing member so that the rotating lever is locked to the locking depression; and locking notches respectively formed in opposite side edges of the locking depression so that the rotating lever, when rotating, is locked to either of the locking notches and prevented from being removed from the locking depression. A tension spring may be wrapped around the support pin. The tension spring elastically supports the rotating lever.

The power supply may comprise an auxiliary power supply capable of supplying emergency power. The digital opening and closing device may further include a fire sensor connected to the control unit, the fire sensor sensing a temperature. The control unit may control the door opening and closing unit such that when the temperature sensed by the fire sensor exceeds a preset reference temperature, a locked state of the door opening and closing unit is released.

In another aspect, the present invention provides a digital opening and closing device for an entrance, including: a housing comprising an outer casing installed on an outdoor surface of a door, and an inner casing coupled to the outer casing with the door interposed between the inner and outer casings; a password input unit provided on the outer casing of the housing, the password input unit being used in inputting a password; a door opening and closing unit installed in the housing, the door opening and closing unit conducting an operation of opening or closing the door in response to a control signal of a control unit; the control unit comparing a password input to the password input unit with a preset reference password and controlling the door opening and closing operation of the door opening and closing unit; an opening button provided on the inner casing of the housing, the opening button being connected to the control unit and used in automatically opening the door; a manual opening button applying a signal to the control unit to prevent the door from being automatically locked when the door is closed; and a power supply supplying drive power to the elements, wherein the door opening and closing unit is configured such that: a door is opened by an operation of pushing or pulling a door handle in a direction in which the door opens; when the door handle is pushed or pulled, opening of the door is sensed by a reduction, due to rolling motion of a roller separately installed in the door opening and closing unit, in speed at which the door handle is pushed or pulled; and locking of the door can be selectively controlled in such a way that the door is automatically locked when the door is closed, or the door is prevented from being automatically locked when the door is closed.

The digital opening and closing device may include an identification unit provided in the outer casing of the housing, the identification unit identifying a visitor, wherein the control unit compares information input to the identification unit with preset reference information and controls the door opening and closing operation of the door opening and closing unit. The identification unit may include at least one of a door phone camera, a card reader, a fingerprint reader and an iris reader.

The door opening and closing unit may include: a body unit having, in a side surface thereof, a first opening in which a latch bolt is disposed, a second opening in which a dead bolt is disposed, and a third opening in which a sensing bolt is disposed; door handles respectively provided below the inner and outer casings of the housing, each of the door handles being configured to be pushed or pulled; a latch bolt moving unit configured such that when either of the door handles is pushed or pulled, the latch bolt is retracted into the door, and when the door handle that has been pushed or pulled is released, the latch bolt is ejected outwards from the door; an opening-and-closing sensing unit for sensing an operation of opening or closing the door and transmitting a sensing signal to the control unit; and a dead bolt moving unit controlling movement of the dead bolt in response to a control signal of the control unit and locking or unlocking the door.

Each of the door handles may include: a mounting bracket fixed to a corresponding one of the outer and inner casings of the housing, the mounting bracket having a receiving space in which a first end of a grip part is disposed so as to be movable forwards or backwards; and the grip part inserted at the first end thereof into the receiving space of the mounting bracket, the grip part being configured to be pushed or pulled. The control unit, when receiving a door-close signal from the opening-and-closing sensing unit, may control operation of the dead bolt moving unit such that the door is locked.

The control unit, when receiving the signal of the manual opening button, may control operation of the dead bolt moving unit such that the door is prevented from being locked.

The digital opening and closing device may include an opening and closing checking unit, having a sensor sensing conditions of movement of the dead bolt moving unit and transmitting a sensing signal to the control unit, the opening and closing checking unit being connected to a speaker so that whether the door is locked or not is output in a voice in response to the sensing signal of the sensor.

The latch bolt moving unit may include: a movable member coupled at opposite ends thereof to the respective door handles, the movable member being horizontally moved by pushing or pulling either of the door handles, with a guide block protruding from an upper surface of the movable member, the guide block having an inclined side surface; an actuating member having in a first end thereof the roller making contact with the inclined side surface of the guide block, the actuating member being coupled at a second end thereof to the latch bolt disposed in the first opening of the body unit, wherein when the movable member is moved, the actuating member is moved in a direction perpendicular to a direction of the movement of the movable member by the roller moving along the inclined side surface of the guide block; and a restoring spring installed between one surface of the body unit and the mounting bracket of the corresponding door handle, the restoring spring being configured to return the movable member to an original state thereof when no external force is applied to the latch bolt moving unit.

Guide slots may be respectively formed in opposite side surfaces of the actuating member. Protruding from the body unit, a protrusion pin may be disposed in each of the guide slots. An elastic spring may be installed between a pin for supporting the roller and the protrusion pin. The elastic spring may be configured to return the actuating member to an original position thereof.

Furthermore, until the guide block of the movable member begins to push the roller, the door handles may be easily pushed or pulled, and when the guide block pushes the roller so that the roller rolls and moves along the inclined side surface of the guide block, a speed at which the door handles are pushed or pulled may be reduced.

The dead bolt moving unit may include: a motor configured to be operated in response to a signal of the control unit; an actuating shaft rotated leftwards or rightwards by the operation of the motor; a rotating lever coupled to the actuating shaft and disposed in the body unit, the rotating lever being rotated leftwards or rightwards by the rotation of the actuating shaft; and an opening and closing member coupled to the dead bolt disposed in the second opening of the body unit, the opening and closing member being moved leftwards or rightwards in conjunction with the rotation of the rotating lever.

The actuating shaft may have a rectangular cross-section, and the rotating lever may have in a central portion thereof a rectangular hole into which the actuating shaft is fitted so that when the actuating shaft rotates, the rotating lever is rotated along with the actuating shaft.

The opening and closing member may have: a guide slot in a central portion thereof, the guide slot extending a predetermined length in a longitudinal direction of the opening and closing member, with a support pin disposed in the guide slot, the support pin protruding from an inner surface of the body unit; a locking depression formed at a predetermined position in an upper edge of the opening and closing member so that the rotating lever is locked to the locking depression; and locking notches respectively formed in opposite side edges of the locking depression so that the rotating lever, when rotating, is locked to either of the locking notches and prevented from being removed from the locking depression. In addition, a tension spring may be wrapped around the support pin. The tension spring elastically supports the rotating lever.

The power supply may include an auxiliary power supply capable of supplying emergency power.

The digital opening and closing device may further include a fire sensor connected to the control unit, the fire sensor sensing a temperature. The control unit may control the door opening and closing unit such that when the temperature sensed by the fire sensor exceeds a preset reference temperature, a locked state of the door opening and closing unit is released.

In a further aspect, the present invention provides a digital opening and closing device for an entrance, including: a housing comprising an outer casing installed on an outdoor surface of a door, and an inner casing coupled to the outer casing with the door interposed between the inner and outer casings; a password input unit provided on the outer casing of the housing, the password input unit being used in inputting a password; a door opening and closing unit installed in the housing, the door opening and closing unit conducting an operation of opening or closing the door in response to a control signal of a control unit; the control unit comparing a password input to the password input unit with a preset reference password and controlling the door opening and closing operation of the door opening and closing unit; an opening button provided on the inner casing of the housing, the opening button being connected to the control unit and used in automatically opening the door; a manual opening button applying a signal to the control unit to prevent the door from being automatically locked when the door is closed; and a power supply supplying drive power to the elements, wherein the door opening and closing unit is configured such that: a door is opened by an operation of pushing or pulling a door handle in a direction in which the door opens; when the door handle is pushed or pulled, opening of the door is sensed by a reduction, due to rolling motion of a roller separately installed in the door opening and closing unit, in speed at which the door handle is pushed or pulled; and locking of the door can be selectively controlled in such a way that the door is automatically locked when the door is closed, or the door is prevented from being automatically locked when the door is closed.

The digital opening and closing device may further include an identification unit provided in the outer casing of the housing. The identification unit identifies a visitor, wherein the control unit compares information input to the identification unit with preset reference information and controls the door opening and closing operation of the door opening and closing unit. The identification unit may include at least one of a door phone camera, a card reader, a fingerprint reader and an iris reader.

The door opening and closing unit may include: a body unit having, in a side surface thereof, a first opening in which a latch bolt is disposed, a second opening in which a dead bolt is disposed, and a third opening in which a sensing bolt is disposed; door handles respectively provided below the inner and outer casings of the housing, each of the door handles being configured to be pushed or pulled; a latch bolt moving unit configured such that when either of the door handles is pushed or pulled, the latch bolt is retracted into the door, and when the door handle that has been pushed or pulled is released, the latch bolt is ejected outwards from the door; an opening-and-closing sensing unit for sensing an operation of opening or closing the door and transmitting a sensing signal to the control unit; and a dead bolt moving unit controlling movement of the dead bolt in response to a control signal of the control unit and locking or unlocking the door.

Each of the door handles may include: a mounting bracket fixed to a corresponding one of the outer and inner casings of the housing, the mounting bracket having a receiving space in which a first end of a grip part is disposed so as to be movable forwards or backwards; and the grip part inserted at the first end thereof into the receiving space of the mounting bracket, the grip part being configured to be pushed or pulled.

The control unit, when receiving a door-close signal from the opening-and-closing sensing unit, may control operation of the dead bolt moving unit such that the door is locked.

The control unit, when receiving the signal of the manual opening button, may control operation of the dead bolt moving unit such that the door is prevented from being locked.

The digital opening and closing device may further include an opening and closing checking unit, having a sensor sensing conditions of movement of the dead bolt moving unit and transmitting a sensing signal to the control unit, the opening and closing checking unit being connected to a speaker so that whether the door is locked or not is output in a voice in response to the sensing signal of the sensor.

The latch bolt moving unit may include: a movable member passing through the body unit and coupled at opposite ends thereof to the respective door handles, the movable member being horizontally moved by pushing or pulling either of the door handles, with a lift guide block provided on a medial portion of an upper surface of the movable member, the lift guide block guiding upward movement of a roller; a rotating unit disposed across an upper surface of the movable member, the rotating unit being coupled at a first end thereof to a hinge shaft, with the roller provided in a lower surface of a medial portion of the rotating unit, the roller making contact with the lift guide block, the rotating unit including a bent part on a second thereof, wherein when the movable member is horizontally moved, the rotating unit is rotated around the hinge shaft by the roller moving upwards along the lift guide block; a latch bolt coupling unit locked at a first end thereof to the bent part of the rotating unit and coupled at a second end thereof to the latch bolt disposed in the first opening of the body unit, the latch bolt coupling unit being moved to leftwards or rightwards depending on a direction of the rotation of the rotating unit; and a restoring spring wrapped around the hinge shaft, the restoring spring fixed at a first end thereof to an inner surface of the body unit and fixed at a second end thereof to the rotating unit so that the rotating unit is returned to an original state thereof by the restoring spring.

The lift guide block may include an inclined surface having an upwardly curved shape so that the roller rolls on the inclined surface and moves upwards.

Furthermore, until the lift guide block of the movable member begins to push the roller, the door handles may be easily pushed or pulled, and when the lift guide block pushes the roller so that the roller rolls and moves upwards along the inclined surface of the lift guide block, a speed at which the door handles are pushed or pulled may be reduced.

The rotating unit may include: a pair of links having in a first end thereof a hinge coupling hole, with the bent part provided on a second end of the pair of links, the bent part being bent at a predetermined position to have a downward inclined surface extending from a first end of the bent part to the predetermined position and an upward inclined surface extending from the predetermined position to a second end of the bent part; the hinge shaft coupled to the hinge coupling hole of the pair of links spaced apart from each other by a predetermined distance; a connection part connecting medial portions of the pair of links to each other, with coupling surfaces bent downwards from respective opposite ends of the connection part; and the roller coupled to the coupling surfaces of the connection part by a hinge.

In addition, a roller pin may be provided on an outer surface of the first end of the latch bolt coupling unit and placed on the bent part of the pair of links of the rotating unit so as to be movable along the inclined surface of the bent part.

The dead bolt moving unit may include: a motor configured to be operated in response to a signal of the control unit; an actuating shaft rotated leftwards or rightwards by the operation of the motor; a rotating lever coupled to the actuating shaft and disposed in the body unit, the rotating lever being rotated leftwards or rightwards by the rotation of the actuating shaft; and an opening and closing member coupled to the dead bolt disposed in the second opening of the body unit, the opening and closing member being moved leftwards or rightwards in conjunction with the rotation of the rotating lever.

The actuating shaft may have a rectangular cross-section, and the rotating lever has in a central portion thereof a rectangular hole into which the actuating shaft is fitted so that when the actuating shaft rotates, the rotating lever is rotated along with the actuating shaft.

The opening and closing member may have: a guide slot in a central portion thereof, the guide slot extending a predetermined length in a longitudinal direction of the opening and closing member, with a support pin disposed in the guide slot, the support pin protruding from an inner surface of the body unit; a locking depression formed at a predetermined position in an upper edge of the opening and closing member so that the rotating lever is locked to the locking depression; and locking notches respectively formed in opposite side edges of the locking depression so that the rotating lever, when rotating, is locked to either of the locking notches and prevented from being removed from the locking depression. A tension spring may be wrapped around the support pin. The tension spring elastically supports the rotating lever.

The digital opening and closing device may include an auxiliary power supply provided in the power supply, the auxiliary power supply being capable of supplying emergency power.

The digital opening and closing device may further include a fire sensor connected to the control unit, the fire sensor sensing a temperature, wherein the control unit controls the door opening and closing unit such that when the temperature sensed by the fire sensor exceeds a preset reference temperature, a locked state of the door opening and closing unit is released.

In a digital opening and closing device for an entrance according to a first embodiment of the present invention, when pushing or pulling a door handle of a door in a direction of opening of the door, a user can easily sense that the door is opening while feeling both variation of the speed of the door handle when a roller begins to move upwards and the rolling motion of the roller. Furthermore, the operation of opening the door can be smoothly conducted. Therefore, the safety in opening or closing the door and convenience in use can be markedly enhanced.

In addition, the opening and closing device is operated in a pushing or pulling fashion rather than in a rotating fashion. Therefore, even children, the elderly and the disabled persons, or users who are using both hands to hold objects, can easily open the door. Thus, convenience in use and practicality can be improved. For crowded places such as public offices or venues, an accident can be prevented because it is easy to open the door. Particularly, in case of a fire, if a handle of the door is melted in the fire, it may be impossible to rotate the door handle. However, in this embodiment, because the opening and closing device can be easily operated in a pushing fashion, the risk of such an accident can be markedly reduced.

In a digital opening and closing device for an entrance according to a second or third embodiment of the present invention, the door is opened by pushing or pulling the door handle in the direction of opening of the door. Therefore, even children, the elderly and disabled persons, or users who are using both hands to hold objects, can easily open the door. Thus, convenience in use and practicality can be improved. For crowded places such as public offices or venues, an accident can be prevented because it is easy to open the door. Particularly, in case of a fire, if a handle of the door is melted in the fire, it may be impossible to rotate the door handle. However, in these embodiments, because the opening and closing device can be easily operated in a pushing fashion, the risk of such an accident can be markedly reduced.

Furthermore, when the door is closed, it can be automatically locked. Both security and safety can thus be enhanced.

Moreover, for doors used in crowded places such as public offices or venues, the opening and closing device is controlled such that when the door is closed, it is prevented from being automatically locked, thereby enabling people to rapidly pass through the door. Therefore, the applicability of the opening and closing device can be enhanced.

In the case of a fire, the door opening and closing unit is automatically unlocked so that people can rapidly evacuate and injuries can be prevented.

DESCRIPTION OF THE REFERENCE NUMERALS IN THE DRAWINGS

Figure 1:
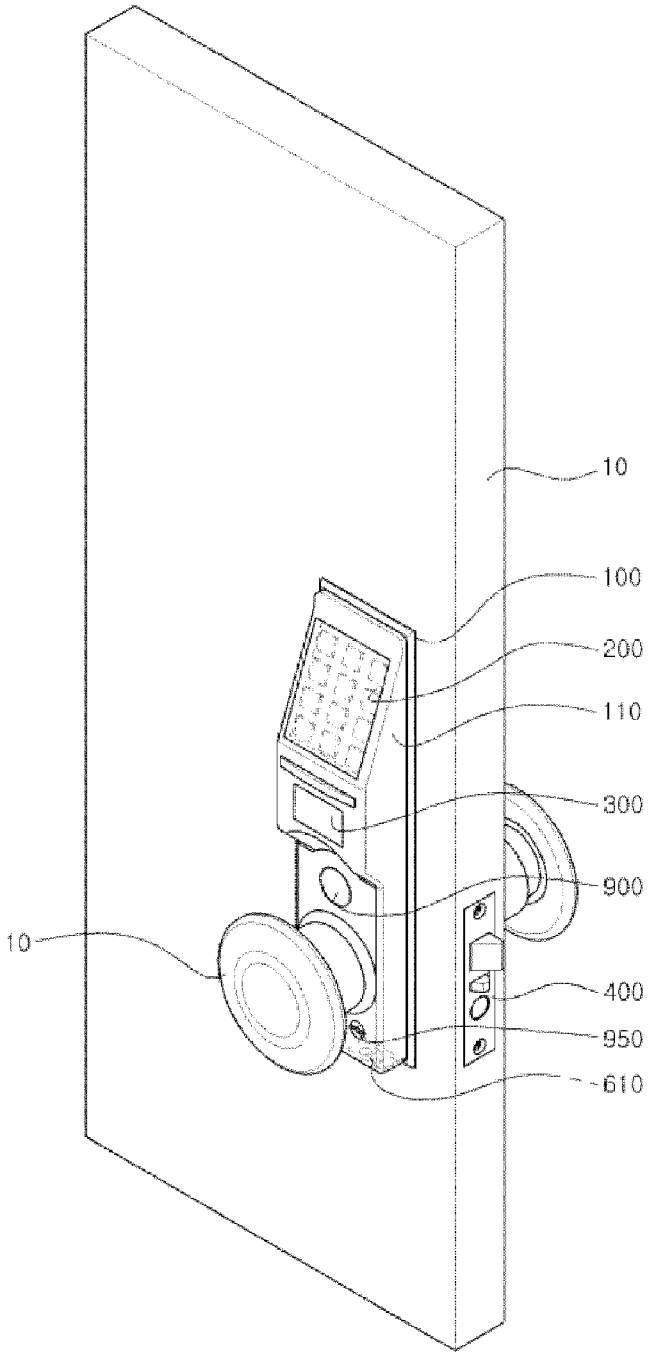
FIG. 1 is a perspective view illustrating an outdoor appearance of a digital opening and closing device for an entrance according to the present invention.

10: door 100: housing
110: outer casing 120: inner casing
200: password input unit 300: identification unit
400: door opening and closing unit 410: body unit
410*a*: main body 410*b*: cover
410*c*: fastener 411: movable-member passing hole
412: first opening 413: second opening
414: third opening 415: through hole
420: door handle 421: mounting bracket
422: receiving space 423: guide hole
424: hole 425: fixing protrusion
426: passing hole 427: grip part
428: insert hole 429: locking unit
430: latch bolt moving unit 440: movable member
441: lift guide block 442: inclined surface
443: stepped portion 450: rotating unit
451: rotation shaft 452: coupling hole
453: link 454: bent part
455: connection part 456: roller
457: locking stop 460: actuating member
461: locking slot 462: guide slot
463: stopper 464: protrusion
465: elastic spring 470: restoring spring
480: latch bolt 490: opening-and-closing sensing unit
491: sensing bolt 492: receiving space
493: spring 494: sensor
500: dead bolt moving unit 510: motor
520: actuating shaft 530: rotating lever
531: hole 532: protruding piece
533: guide slot 540: opening and closing member
541: locking depression 542: locking slot
543: guide slot 544: support pin
545: tension spring 550: sensor

560: dead bolt 570: opening and closing checking unit
600: power supply 610: auxiliary power supply
700: opening button 800: fire sensor
900: manual opening button 950: auxiliary-key insert hole
1000: control unit
10*a*: door 100*a*: housing
110*a*: outer casing 120*a*: inner casing
200*a*: password input unit 300*a*: identification unit
400*a*: door opening and closing unit 410*a*: body unit
410*d*: main body 410*e*: cover
410*f*: fastener 411*a*: movable-member passing hole
412*a*: first opening 413*a*: second opening
414*a*: third opening 415*a*: through hole
420*a*: door handle 421*a*: mounting bracket
422*a*: receiving space 423*a*: guide hole
424*a*: hole 425*a*: fixing protrusion
426*a*: passing hole 427*a*: grip part
428*a*: insert hole 429*a*: locking unit
430*a*: latch bolt moving unit 440*a*: movable member
450*a*: guide block 451*a*: inclined surface
460*a*: actuating member 461*a*: roller
462*a*: pin 463*a*: guide slot
464*a*: protrusion pin 465*a*: elastic spring
470*a*: restoring spring 480*a*: latch bolt
490*a*: opening-and-closing sensing unit 491*a*: sensing bolt
492*a*: receiving space 493*a*: spring
494*a*: sensor 500*a*: dead bolt moving unit
510*a*: motor 520*a*: actuating shaft
530*a*: rotating lever 531*a*: hole
532*a*: protruding piece 533*a*: guide slot
540*a*: opening and closing member 541*a*: locking depression
542*a*: locking slot 543*a*: guide slot
544*a*: support pin 545*a*: tension spring
550*a*: sensor 560*a*: dead bolt
570*a*: opening and closing checking unit
600*a*: power supply
610*a*: auxiliary power supply 700*a*: opening button
800*a*: fire sensor 900*a*: manual opening button
950*a*: auxiliary-key insert hole 1000*a*: control unit
10*b*: door 100*b*: housing
110*b*: outer casing 120*b*: inner casing
200*b*: password input unit 300*b*: identification unit
400*b*: door opening and closing unit 410*b*: body unit
410*g*: main body 410*h*: cover
410*i*: fastener 411*b*: movable-member passing hole
412*b*: first opening 413*b*: second opening
414*b*: third opening 415*b*: through hole
420*b*: door handle 421*b*: mounting bracket
422*b*: receiving space 423*b*: guide hole
424*b*: hole 425*b*: fixing protrusion
426*b*: passing hole 427*b*: grip part
428*b*: insert hole 429*b*: locking unit
430*b*: latch bolt moving unit 440*b*: movable member
441*b*: lift guide block 442*b*: inclined surface
450*b*: rotating unit 451*b*: hinge coupling hole
452*b*: bent part 453*b*: link
454*b*: hinge shaft 455*b*: coupling surface
456*b*: connection part 457*b*: roller
458*b*: removal prevention stop 460*b*: actuating member
461*b*: roller pin 470*b*: restoring spring
475*b*: elastic spring 480*b*: latch bolt
490*b*: opening-and-closing sensing unit 491*b*: sensing bolt
492*b*: receiving space 493*b*: spring
494*b*: sensor 500*b*: dead bolt moving unit
510*b*: motor 520*b*: actuating shaft
530*b*: rotating lever 531*b*: hole
532*b*: protruding piece 533*b*: guide slot
540*b*: opening and closing member 541*b*: locking depression
542*b*: locking slot 543*b*: guide slot
544*b*: support pin 545*b*: tension spring
550*b*: sensor 560*b*: dead bolt
570*b*: opening and closing checking unit
600*b*: power supply
610*b*: auxiliary power supply 700*b*: opening button
800*b*: fire sensor 900*b*: manual opening button
950*b*: auxiliary-key insert hole 1000*b*: control unit

EXAMPLES

The above and other objects, features and advantages of the present invention will be more clearly understood from the following detailed description taken in conjunction with the accompanying drawings. Hereinafter, an apparatus for opening and closing a front entrance according to the present invention will be described in detail with reference to the attached drawings. The same reference numerals are used throughout the different drawings to designate the same or similar components, unless specifically mentioned otherwise.

First Embodiment

Figure 2:
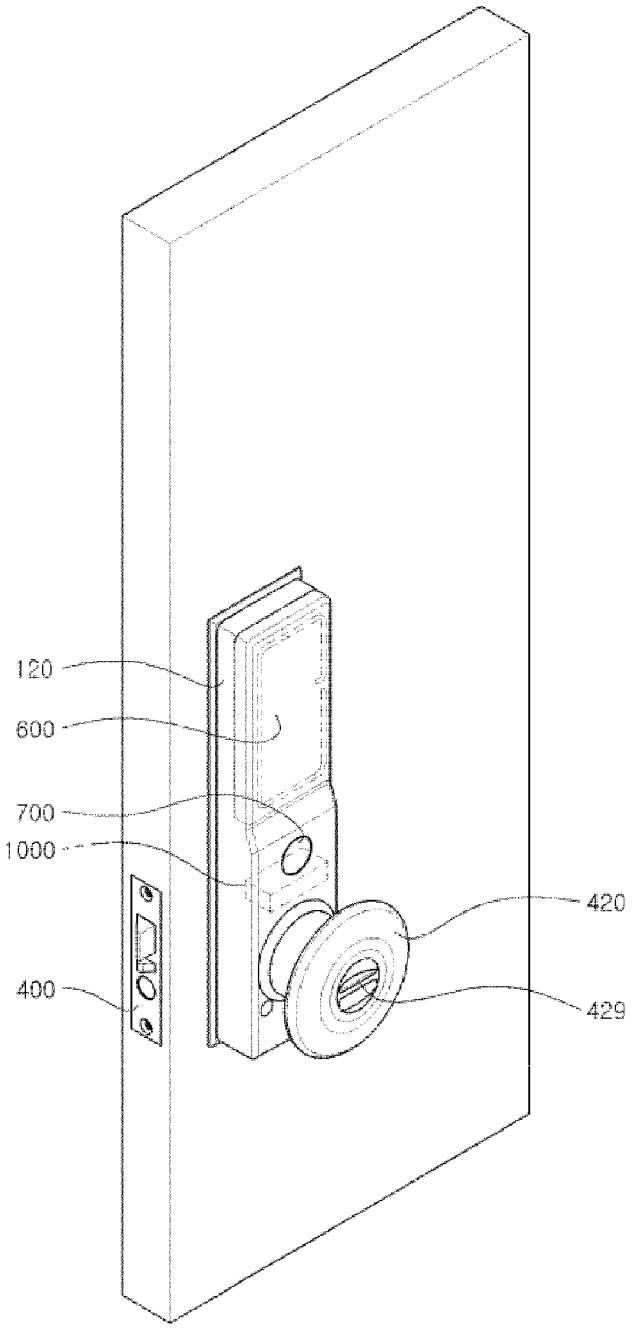
FIG. 2 is a perspective view illustrating an indoor appearance of the opening and closing device according to the present invention.
Figure 3:
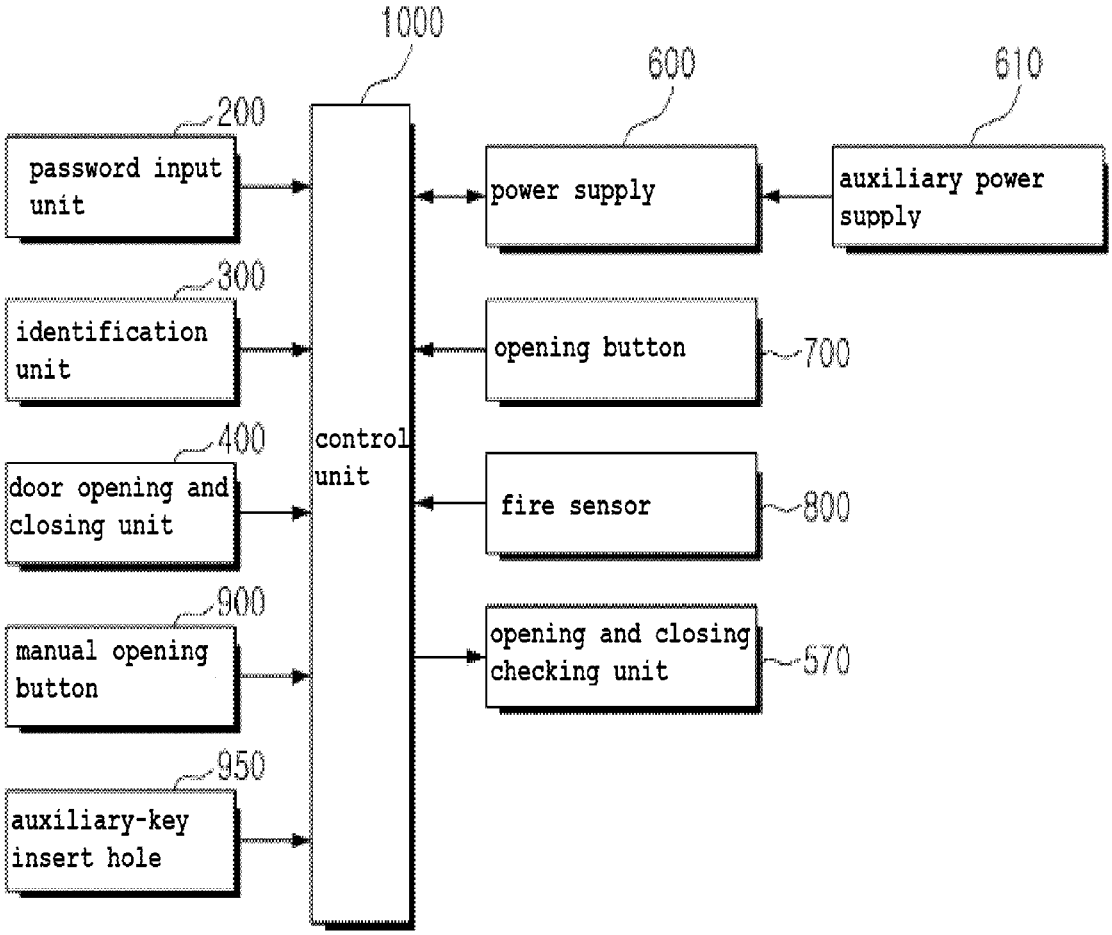
FIG. 3 is a block diagram showing the construction of the opening and closing device according to the present invention.

FIG. 1 is a perspective view illustrating an outdoor appearance of a digital opening and closing device for an entrance according to the present invention. FIG. 2 is a perspective view illustrating an indoor appearance of the opening and closing device according to the present invention. FIG. 3 is a block diagram showing the construction of the opening and closing device according to the present invention.

As shown in FIGS. 1 through 3, the opening and closing device according to the present invention includes a housing 100, a password input unit 200, an identification unit 300, a door opening and closing unit 400, a power supply 600, an opening button 700, a fire sensor 800, a manual opening button 900, an auxiliary-key insert hole 950 and a control unit 1000.

The housing 100 includes an outer casing 110 and an inner casing 120 which are respectively disposed at outdoor and indoor sides with a door 10 interposed therebetween and are coupled to each other.

The password input unit 200 is installed on a front surface of the outer casing 110 of the housing 100 and includes a keypad which has a combination of numeral buttons and special key buttons for use in inputting a password. The password input unit 200 may take the form of a touch panel. Furthermore, the password input unit 200 is connected to the control unit 1000 and transmits an input password to the control unit 1000.

The identification unit 300 includes an identification means for indentifying a visitor. The term "identification means" refers to a device, such as a door phone camera including a CMOS or CCD, a card reader which can recognize a card, a fingerprint reader, an iris reader, etc., which can identify the visitor. In addition, the identification means may include another kind of device which can identify the visitor using voice recognition or by other means. The identification unit 300 is connected to the control unit 1000 and transmits recognized information to the control unit 1000.

The door opening and closing unit 400 is installed within the door 10 between the outer casing 110 and the inner casing 120 of the housing. The door opening and closing unit 400 receives a control signal from the control unit 1000 and opens or closes the door 10. The construction and operation of the door opening and closing unit 400 will be explained in detail later herein.

The power supply 600, using AC power or a battery, supplies drive power to the elements of the opening and closing device. The power supply 600 further includes an auxiliary power supply 610 which has an emergency battery. In case of emergency, for example, when a blackout occurs or AC power is interrupted, or when the lifetime of the main battery has expired, the auxiliary power supply 610 including the emergency battery supplies emergency power to the opening and closing device. The battery is electrically connected to the housing. Therefore, when a large electrical shock is applied to the housing, the applied electricity is charges the battery, and the strength of shock applied to the housing can thus be reduced. In addition, the opening and closing device can be protected from being damaged by the electrical shock.

The opening button 700 is installed in the inner casing 120 of the housing and connected to the control unit 1000. When a user pushes the opening button 700 to exit via the door, an opening signal is applied to the control unit 1000.

The fire sensor 800 is installed in the inner casing 120 of the housing so as to sense the indoor temperature and connected to the control unit 1000. If the fire sensor 800 senses a temperature higher than a preset reference temperature, the fire sensor 800 transmits an abnormality signal to the control unit 1000.

The manual opening button 900 is installed in the outer casing of the housing and connected to the control unit 1000. For doors used in places such as public offices or venues which are crowded, the manual opening button 900 applies a signal to the control unit 1000 to prevent the door from being automatically locked when the door is closed.

The auxiliary-key insert hole 950 is formed in the outer casing 120 of the housing. An auxiliary key for use in unlocking the door is inserted into the auxiliary-key insert hole 950. When the auxiliary key is inserted into the auxiliary-key insert hole 950, a unlocking signal of the door opening and closing unit 400 is applied to the control unit 1000.

The control unit 1000 is electrically connected to the password input unit 200, the identification unit 300, the door opening and closing unit 400, the power supply 600, the opening button 700, the fire sensor 800, the manual opening button 900 and the auxiliary-key insert hole 950. The control unit 1000 functions to control the elements. Receiving a password input to the password input unit 200 or information input to the identification unit 300, the control unit 1000 compares it with preset reference password or information. If the input password or information matches the preset reference password or information, the control unit 1000 creates a control signal to unlock the door opening and closing unit 400. Furthermore, when receiving an abnormality signal from the fire sensor 800, the control unit 1000 creates a control signal to unlock the door opening and closing unit 400. When receiving an opening signal from the opening button 700, the control unit 1000 also creates a control signal to unlock the door opening and closing unit 400. If receiving a signal from the manual opening button 900, the control unit 1000 controls the locking operation of the door opening and closing unit 400 such that when the door is closed, an automatic locking operation of the door opening and closing unit 400 is not conducted. In addition, when the key is inserted into the auxiliary-key insert hole 950 and a key insert signal is applied, the control unit 1000 creates a control signal to unlock the door opening and closing unit 400.

Figure 4:
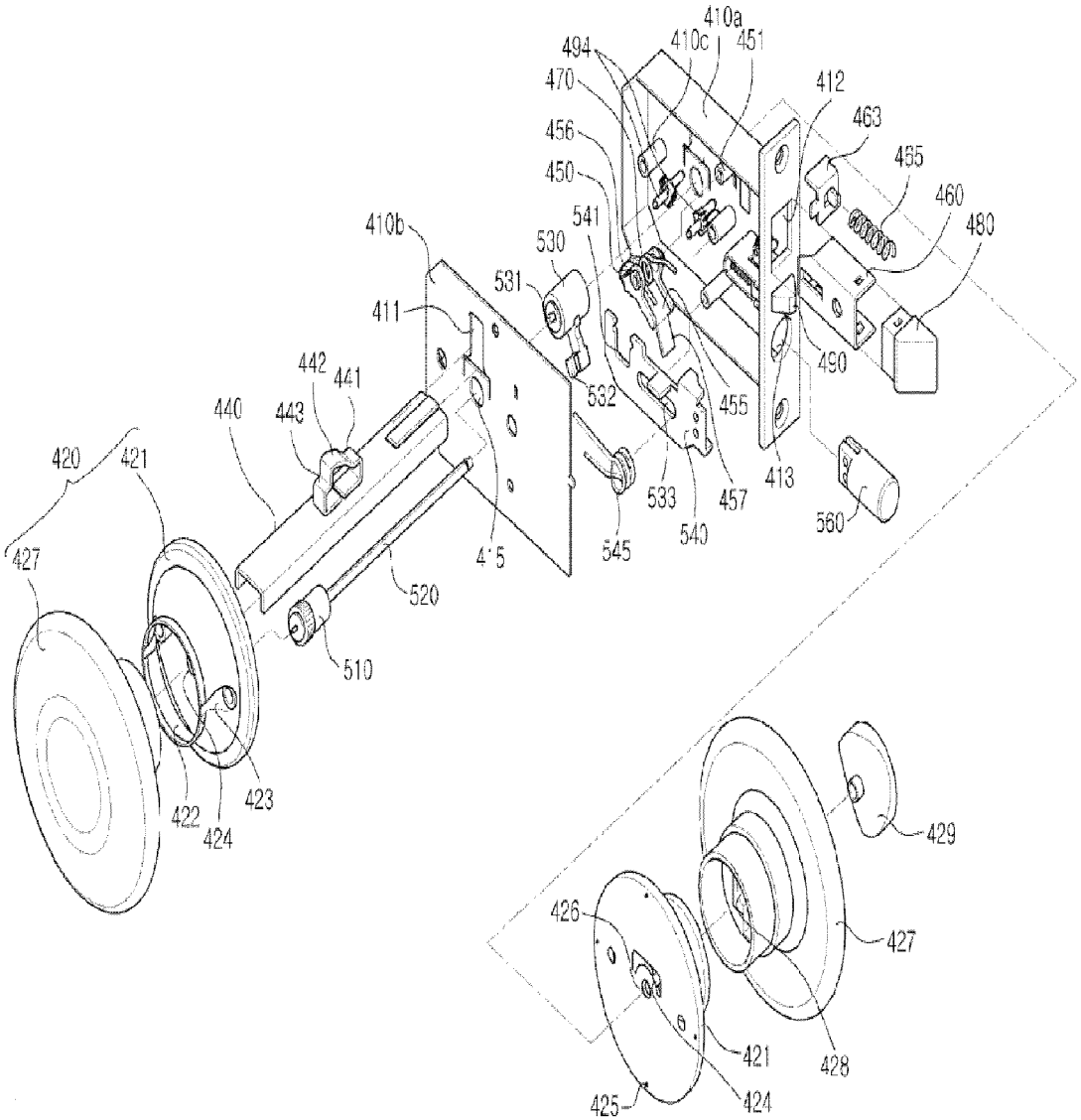
FIG. 4 is an exploded perspective view illustrating a door opening and closing unit of the opening and closing device according to the present invention.
Figure 5:
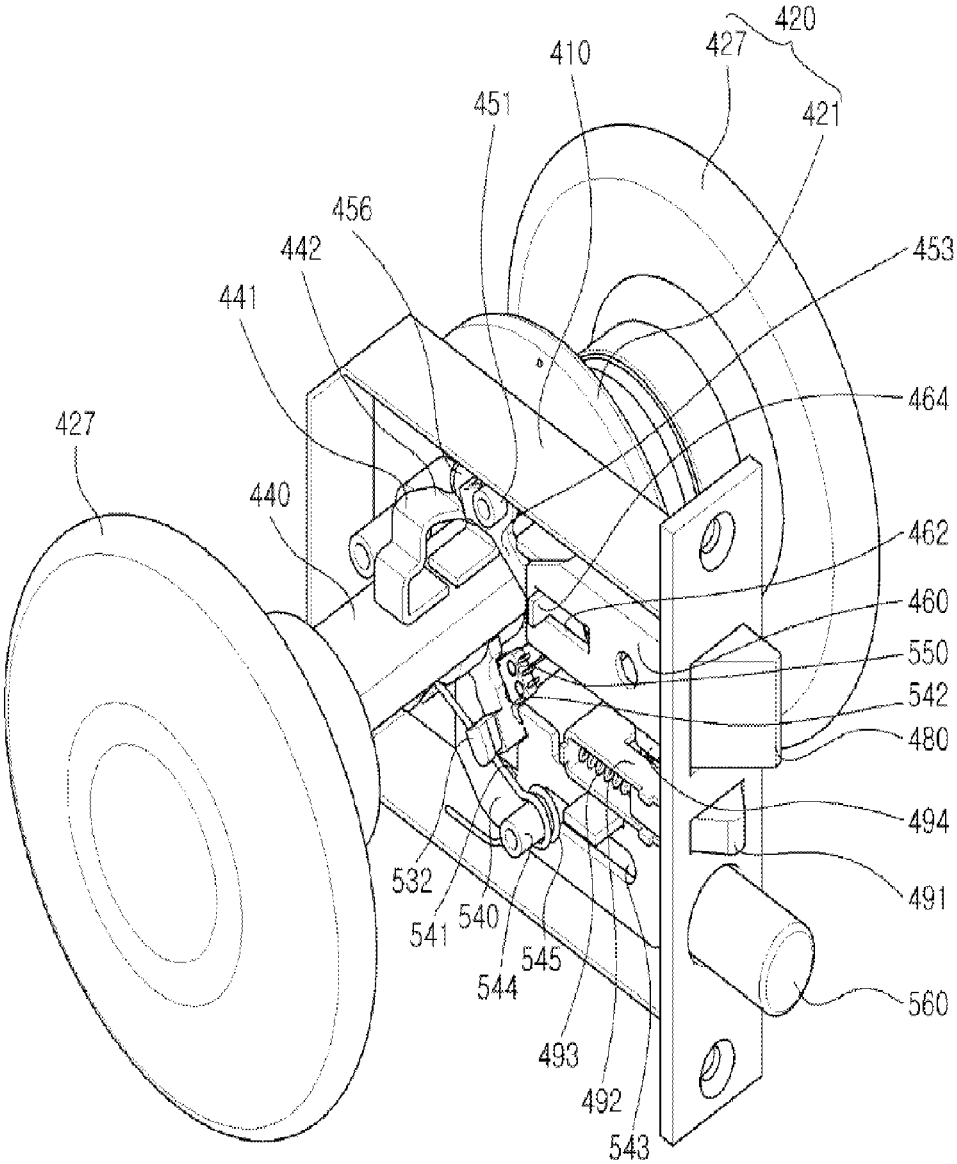
FIG. 5 is a perspective view showing the assembled door opening and closing unit of FIG. 4.
Figure 6:
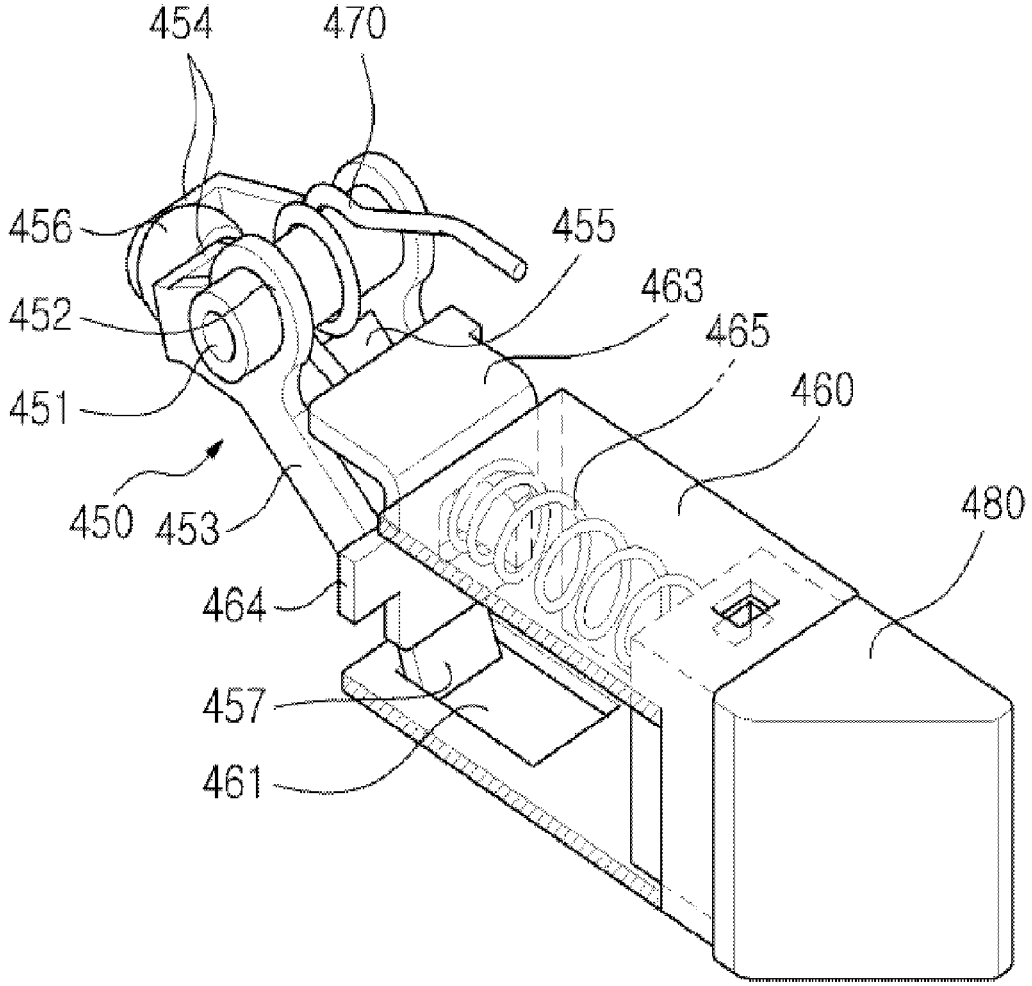
FIG. 6 is an enlarged view illustrating a rotating unit and an actuating member of the door opening and closing unit of FIG. 5.

FIG. 4 is an exploded perspective view illustrating the door opening and closing unit of the opening and closing device according to the present invention. FIG. 5 is a perspective view showing the assembled door opening and closing unit of FIG. 4. FIG. 6 is an enlarged view illustrating a rotating unit and an actuating member of the door opening and closing unit of FIG. 5.

As shown in FIGS. 4 through 6, the door opening and closing unit 400 includes a body unit 401, door handles 420, a latch bolt moving unit 430, an opening-and-closing sensing unit 490 and a dead bolt moving unit 500. The body unit 410 has, in a side surface thereof, a first opening 412 in which a latch bolt is retractably disposed, a second opening 413 in which a dead bolt is retractably disposed, and a third opening 414 in which a sensing bolt is disposed. The door handles 420 are respectively provided below the inner and outer casing 120 and 110 and configured so as to be pushed and pulled. The latch bolt moving unit 430 is coupled to the door handles 420 and configured such that when either door handle 420 is pushed or pulled, the latch bolt is retracted into the door 10 to allow the door 10 to open, and when the door handle 420 that has been pushed or pulled is released, the latch bolt is ejected from the door 10 to maintain the door 10 in a closed state. The opening-and-closing sensing unit 490 senses the operation of opening or closing the door 10 and transmits it to the control unit 1000. The dead bolt moving unit 500 locks or unlocks the door 10 depending on a control signal of the control unit 1000.

The body unit 410 includes a main body 410*a* which is open on a surface thereof and receives a rotating unit 150 and an actuating member 160 therein, and a cover 410*b* which covers the open surface of the main body 410*a*. The main body 410*a* and the cover 410*b* are coupled to each other by a plurality of fasteners 410*c*. The body unit 410 has a movable-member passing hole 411 which is formed in central portions of the cover 410*b* and the main body 410*a*. The main body 410*a* has, in a side surface thereof, the first opening 412 in which the latch bolt 480 is retractably disposed, the second opening 413 in which the dead bolt 560 is retractably disposed, and the third opening 414 which is formed between the first and second openings 412 and 413 and in which the sensing bolt is retractably disposed. The body unit 410 is installed in the door 10 in such a way that the first, second and third openings 412, 413 and 414 are exposed to the outside from the side surface of the door 10.

Each door handle 420 includes a mounting bracket 421 which are coupled to a corresponding one of the outer and inner casings 110 and 120, and a grip part 427 which is inserted into the mounting bracket 421 and configured to be pushed and pulled.

The mounting bracket 421 has a receiving space 422 in which a first end of the grip part 427 is disposed so as to be movable forwards or backwards. Guide holes 423 are formed in the mounting bracket 412 on opposite sides of the receiving space 422. Communicating with the receiving space 422, a hole 424 is formed in a central portion of a surface of the mounting bracket 421 that makes contact with the door 10. The hole 424 has the same shape as that of a movable member 431 so that the movable member 431 is inserted into the hole 424. A plurality of fixing protrusions 425, each of which has a pointed shape, are provided around the hole 424 on the mounting bracket 421 and pegged into the corresponding surface of the door 10. Pegged into the surface of the door 10 that makes contact with the mounting bracket 421, the fixing protrusions 425 function to fix the mounting bracket 421 in place.

A protrusion is provided on a central portion of a first surface of each grip part 427 and disposed in the receiving space 422 of the corresponding mounting bracket 421 so as to be movable forwards or backwards. An insert depression 428 having the same shape as that of the hole 424 of the mounting bracket 421 is formed in the grip part 427.

The latch bolt moving unit 430 includes the movable member 440, a rotating unit 450, an actuating member 460 and a restoring spring 470.

The movable member 440 has a reverse U-shaped cross-section. A lift guide block 441 is provided on a medial portion of the movable member 440 so that a roller 456 is moved upwards under guidance of the lift guide block 441. The lift guide block 441 has on a first end thereof an inclined surface 442 which is gently curved upwards from the first end to a medial portion of the lift guide block 441. A second end of the lift guide block 441 is bent to have a stepped portion 443. Opposite ends of the movable member 440 that is disposed in the movable-member passing hole 411 of the body unit are respectively fitted into the insert holes 428 of the grip parts of the door handles 420 through the holes 424 of the mounting brackets 421 of the door handles 420. The movable member 440 is moved by the operation of pushing or pulling the door handle 420.

The rotating unit 450 includes a pair of links 453 each of which has an L shape such that the principle of the lever can be used. A coupling hole 452 is formed in a bent portion of each L-shaped link 453, and a rotation shaft 451 is disposed in the coupling holes 452 of the links 453. The links 453 are rotatably provided on the rotating shaft 451 which is fixed in place in a longitudinal direction of the movable member 440. A bent part 454 is formed by bending the first end of the link 453 such that the bent part 454 is parallel to the direction in which the lift guide block 441 moves. Second ends of the links 453 are connected to each other by a connection part 455. The roller 456 is rotatably coupled to the bent parts 454 of the links 453. Bent downwards, a locking stop 457 is connected to the connection part 455 of the links 453.

The rotating unit 450 having the above-mentioned construction is disposed in the body unit 410 above the movable member 440 in such a way that the roller 456 makes contact with the inclined surface 442 of the lift guide block 441.

Therefore, when the movable member 440 horizontally moves in a predetermined direction, the roller 456 of the rotating unit 450 is moved upwards along the inclined surface of the lift guide block 441. Simultaneously, the locking stop 457 is moved downwards. That is, the rotating unit 450 rotates around the rotation shaft 451 because of the links 453 that use the principle of the lever.

The actuating member 460 has a hollow structure. A locking slot 461 is formed in the bottom surface of a first end of the actuating member 460. A guide slot 462 is formed in a sidewall of the actuating member 460. The locking stop 457 of the rotating unit is disposed in the locking slot 461 of the actuating member and locked to an end of the locking slot 461. Limiting the reverse rotation of the locking stop 457, a stopper 463 is provided on the actuating member 460 above the locking slot 461. The stopper 463 has a protrusion 464 which is fixed to the sidewall of the body unit 410 through the guide slot 462 of the actuating member. Thus, the stopper 463 functions not only to limit the reverse rotation of the locking stop 457, but also to guide the actuating member 460 such that the actuating member 460 can be reliably moved to the left or right. An elastic spring 465 is provided in the actuating member 460 between the stopper 463 and a portion of the actuating member 460. The elastic spring 465 elastically supports the actuating member 460 so that when no external force is applied to the actuating member 460, the actuating member 460 can return to its original position. A second end of the actuating member 460 is coupled to the latch bolt 480 which is disposed in the first opening 412 of the body unit 410.

When the rotating unit 450 is rotated, the actuating member 460 interlocked with the locking stop 457 is moved in a direction of the rotation of the rotating unit 450. That is, the actuating member 460 is moved in a direction perpendicular to the direction in which the movable member 440 moves. In addition, the latch bolt 480 coupled to the actuating member 460 is ejected outwards from the door 10 or retracted thereinto.

The restoring spring 470 is wrapped around the rotation shaft 451 of the rotating unit. A first end of the restoring spring 470 is fixed to the inner surface of the body unit 410, and a second end thereof is fixed to the links 453 at a position adjacent to the locking stop 457. Therefore, the restoring spring 470 is expanded by rotation of the links 453, and when the external force that has rotated the links 453 is removed, the restoring spring 470 returns to its original state so that the links 453 can be return to its pre-rotated state.

The opening-and-closing sensing unit 490 includes a sensing bolt 491 which is disposed in the third opening 414 of the body unit, a receiving space 492 which receives the sensing bolt 491, a spring 493 which is provided in the receiving space 492 and elastically supports the sensing bolt 491, and a sensor 494 which senses movement of the sensing bolt 491 and determines whether the door 10 is in the closed state or not.

In the opening-and-closing sensing unit 490, when the door 10 is closed, the sensing bolt 491 that has been ejected outwards from the door 10 is retracted into the door 10 by a side frame of an entrance. When the door 10 opens, the sensing bolt 491 is ejected outwards from the door 10. The sensor 494 senses ejection and retraction of the sensing bolt 491, determines whether the door 10 is in the closed state or not, and then transmits a sensing signal to the control unit 1000. When receiving a door-close signal from the opening-and-closing sensing unit 490, the control unit 1000 controls the operation of the dead bolt moving unit 500 to lock the door 10.

The dead bolt moving unit 500 includes a motor 510 which is operated in response to a signal of the control unit 1000; an actuating shaft 520 which is rotated to the left or right by the operation of the motor 510; a rotating lever 530 which is coupled to the actuating shaft 520, is disposed in the body unit 410, and is rotated to the left or right by the rotation of the actuating shaft 520; an opening and closing member 540 which is coupled to the dead bolt 560 disposed in the second opening 413 of the body unit and is moved to the left or right in conjunction with the rotation of the rotating lever 530; and a sensor 550 which senses the operation of the rotating lever 530 and thus determines whether the dead bolt 560 is in a closed state or an open state.

For this, a though hole 415, in which the actuating shaft 520 is disposed, is formed in the body unit 410. A passing hole 426, in which the actuating shaft 520 is disposed, is formed in a mounting bracket 421 of the door handle 420 that is installed on the inner casing 120 of the housing. A locking unit 429 is installed in the grip part 427 at a position corresponding to the passing hole 426 of the mounting bracket 421. A first end of the actuating shaft 520 is connected to the motor 510, and a second end of the actuating shaft 520 is connected to the locking unit 429 installed in a central portion of the door handle 420 that is disposed at an indoor side. The locking unit 429 that is installed in the door handle 420 disposed at the indoor side is used to manually unlock the door 10 in case of emergency.

The rotating lever 530 includes a cylindrical body which has in a central portion thereof a rectangular hole 531 into which the actuating shaft 520 is inserted, and a protruding piece 532 which protrudes outwards from an outer surface of the cylindrical body. A guide groove 533 is formed in an outer surface of the protruding piece 532. Because the actuating shaft 520 and the hole 531 of the rotating lever 530 are rectangular, the rotating lever 530 can be rotated along with the actuating shaft 520.

The opening and closing member 540 is disposed below the rotating lever 530. A locking depression 541 to which the protruding piece 532 of the rotating lever 530 is locked is formed at a predetermined position in an upper edge of the opening and closing member 540. Locking notches 542 are respectively formed in opposite side edges of the locking depression 541 so that, when rotated to the maximum, the protruding piece 532 is locked to the corresponding locking notch 542. Extending a predetermined length in the longitudinal direction of the opening and closing member 540, a guide slot 543 is formed in a central portion of the opening and closing member 540. Protruding from the inner surface of the body unit 410, a support pin 544 is disposed in the guide slot 543. A tension spring 545 which elastically supports the protruding piece 532 of the rotating lever 530 is wrapped around the support pin 544. Wrapped around the support pin 544, the tension spring 545 is fixed at a first end thereof to the bottom surface of the body unit 410 and fixed at a second end thereof to the sidewall of the body unit 410 via a lower surface of the guide groove 533 of the rotating lever 530. An end of the opening and closing member 540 is coupled to the dead bolt 560 disposed in the second opening 413.

The sensor 550 comprises two sensors which are respectively provided on opposite sides of the rotating lever 530. In detail, each sensor 550 is disposed at a position at which the protruding piece 532 of the rotating lever comes into contact with the sensor 550 when the protruding piece 532 is rotated to the maximum and locked to the corresponding locking notch 542 of the locking depression 541.

Hereinafter, the operation of the digital opening and closing device having the above-mentioned construction will be described in detail.

Figure 7:
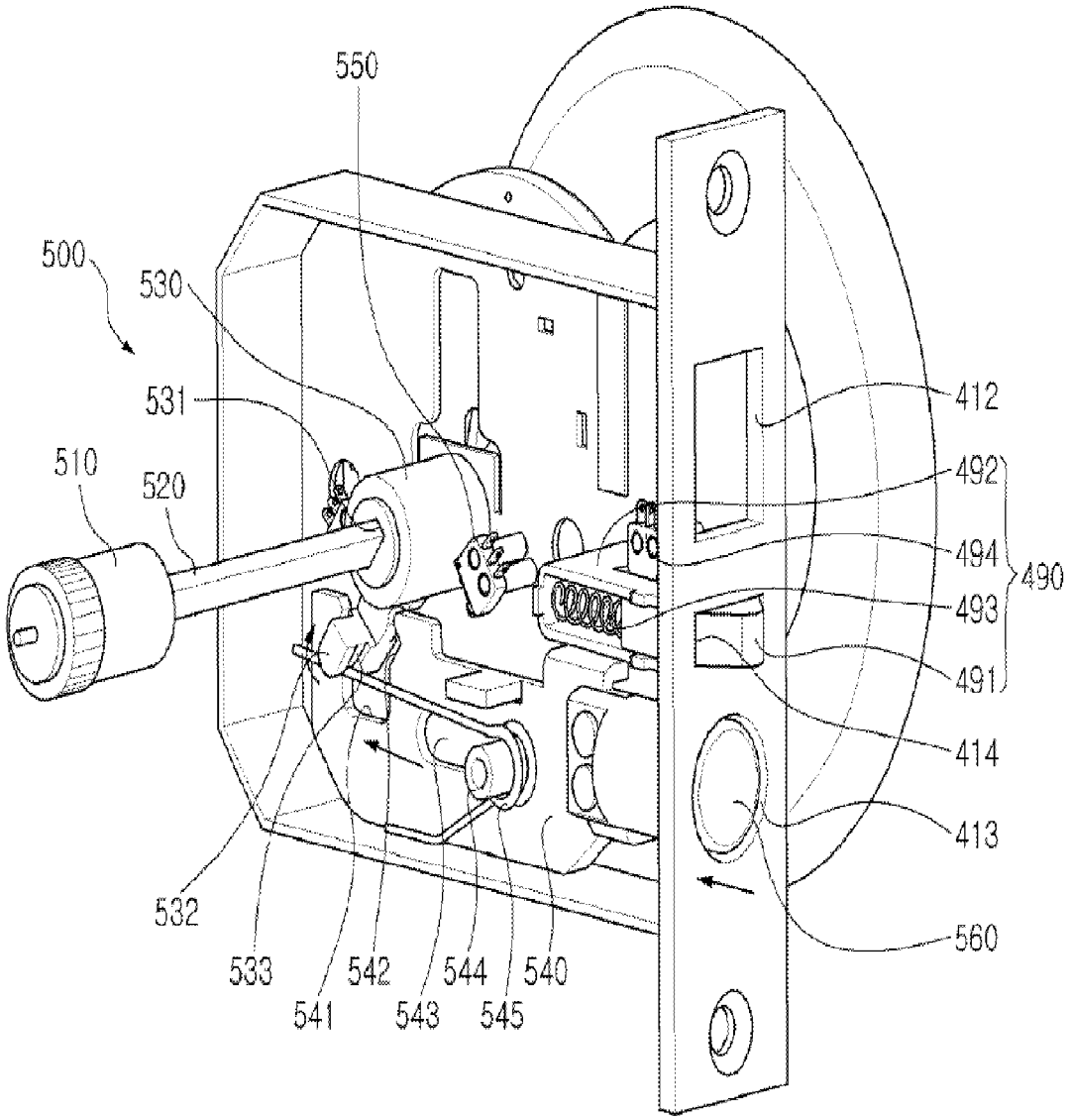
FIG. 7 is a view showing the operation of a dead bolt moving unit of the opening and closing device when a door opens according to the present invention.
Figure 8:
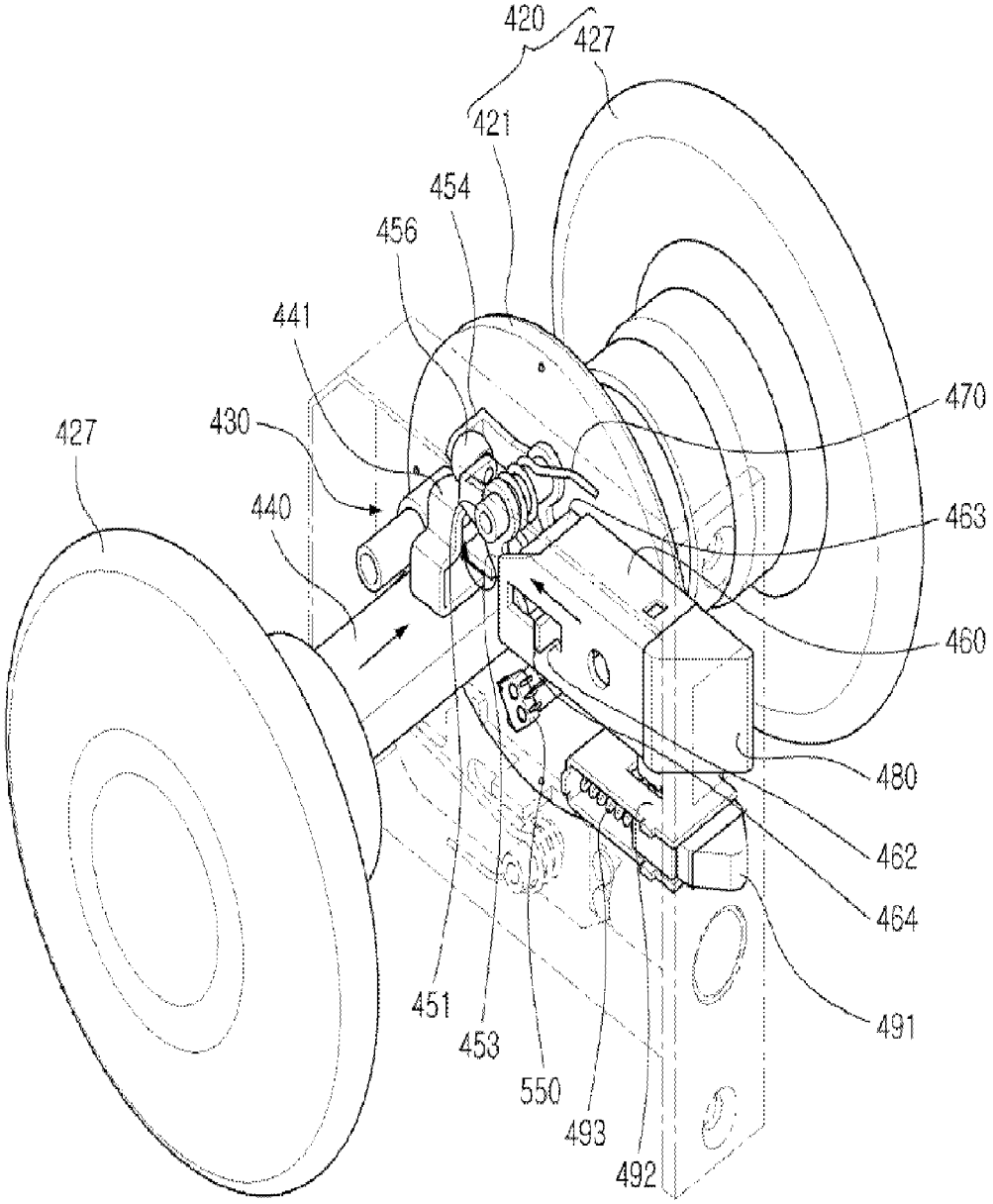
FIG. 8 is a view showing the operation of a latch bolt moving unit and an opening-and-closing sensing unit of the opening and closing device when the door opens according to the present invention.
Figure 9:
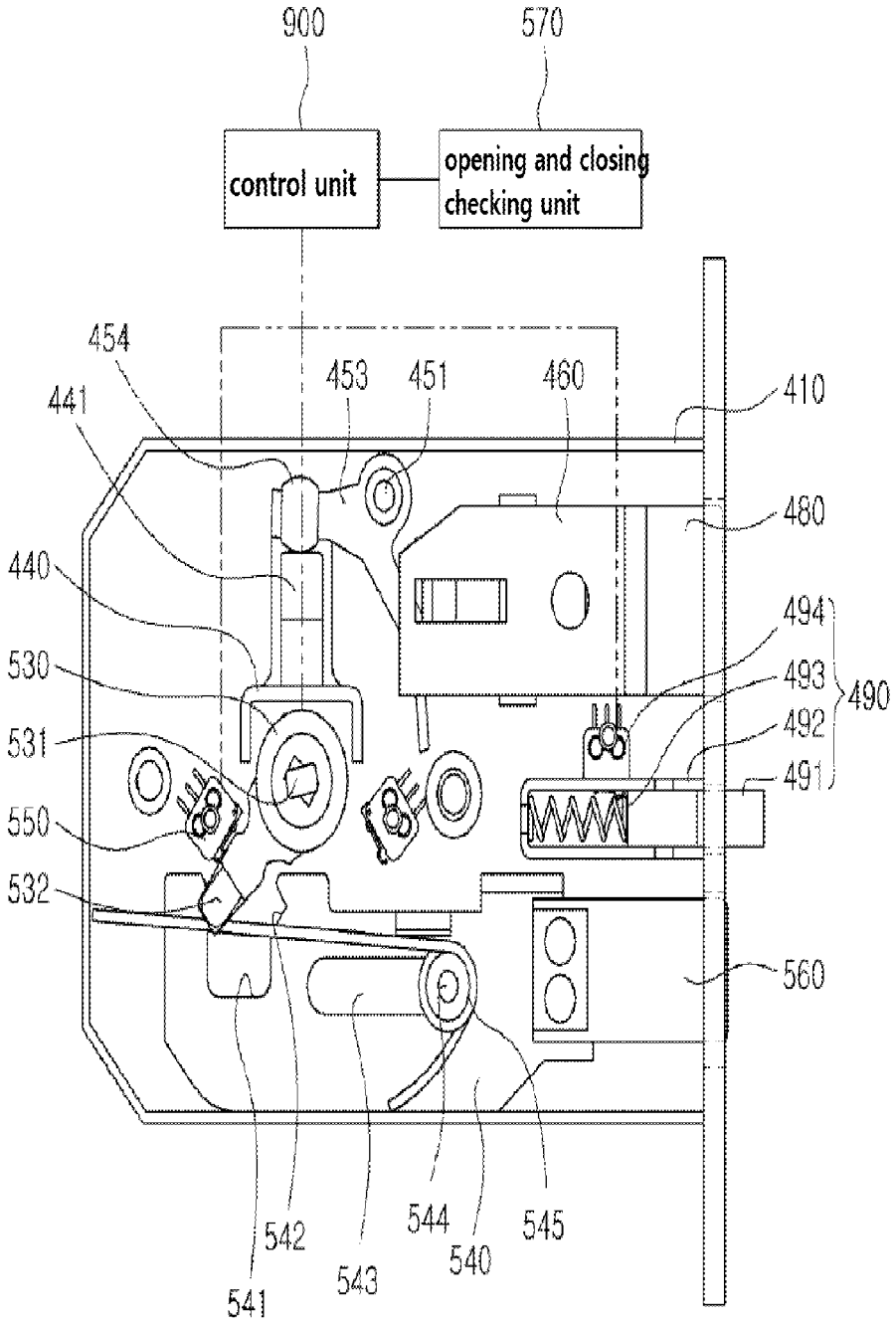
FIG. 9 is a front view of the door opening and closing unit of the opening and closing device to illustrate the opening-and-closing sensing unit and a sensor for sensing opening of the door according to the present invention.
Figure 10:
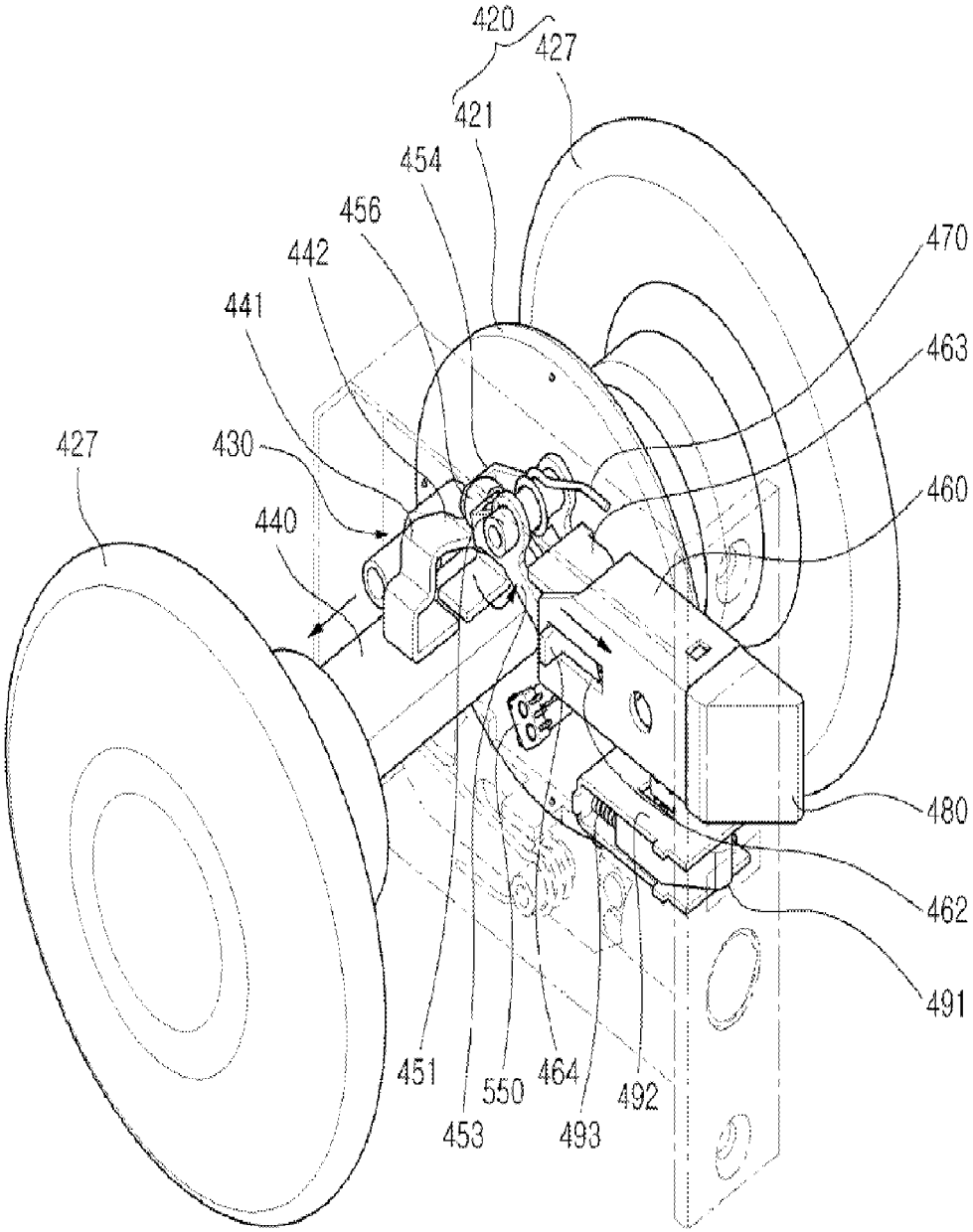
FIG. 10 is a view showing the operation of the latch bolt moving unit and the opening-and-closing sensing unit of the opening and closing device when the door is closed according to the present invention.
Figure 11:
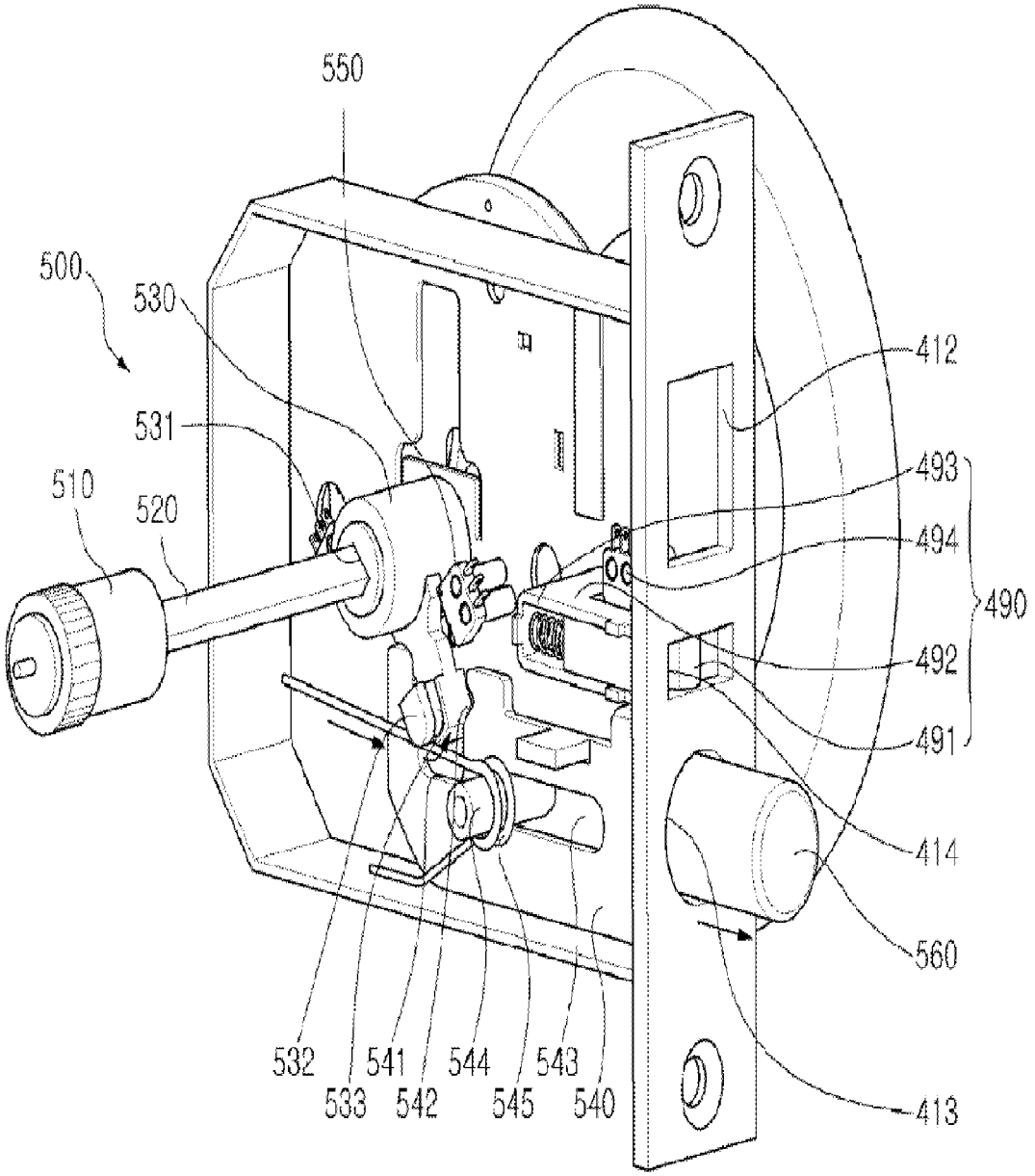
FIG. 11 is a view showing the operation of the dead bolt moving unit of the opening and closing device when the door is closed.
Figure 12:
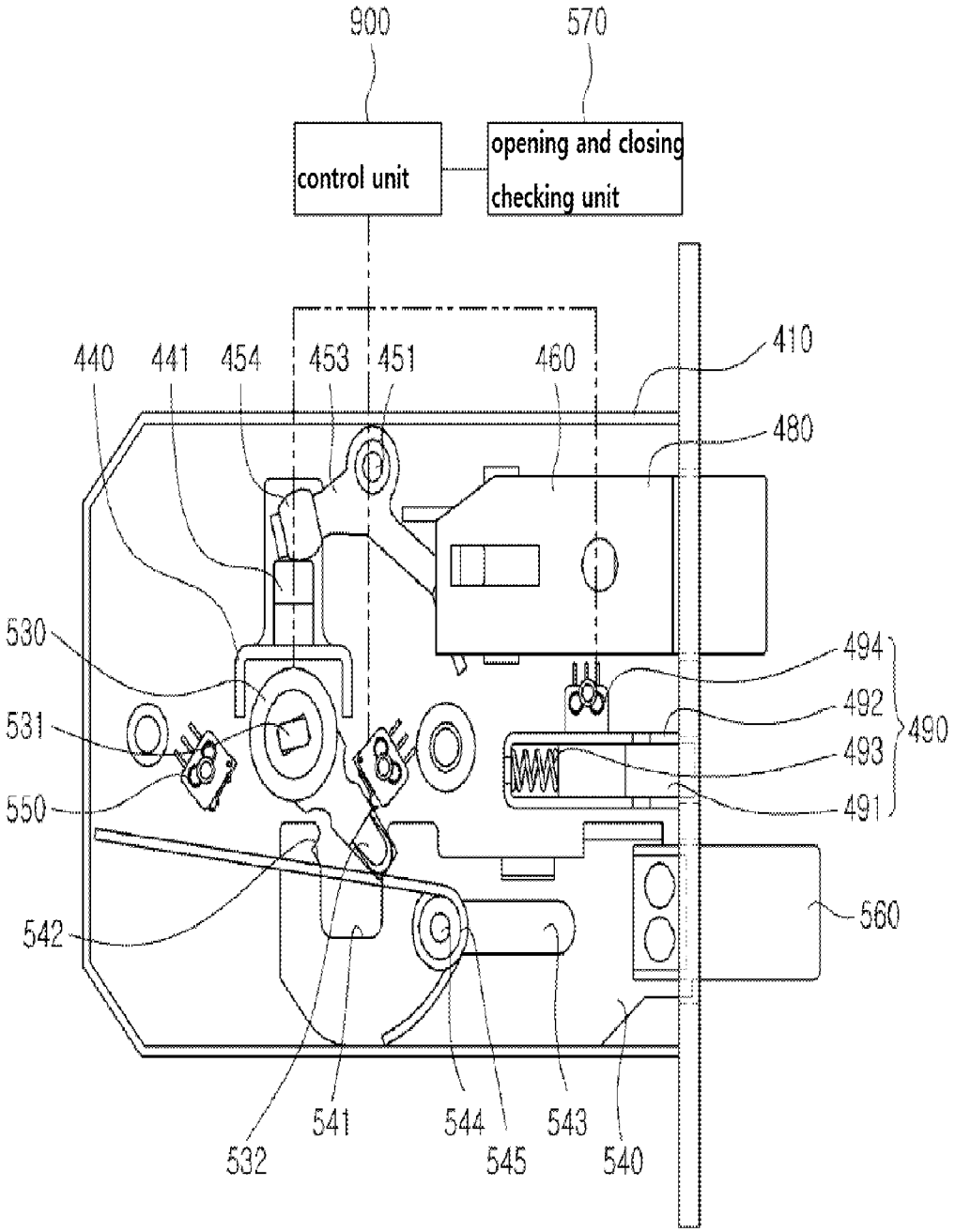
FIG. 12 is a front view of the door opening and closing unit of the opening and closing device to illustrate the opening-and-closing sensing unit and a sensor for sensing closing of the door according to the present invention.

FIG. 7 is a view showing the operation of the dead bolt moving unit of the opening and closing device when the door opens according to the present invention. FIG. 8 is a view showing the operation of the latch bolt moving unit and the opening-and-closing sensing unit of the opening and closing device when the door opens according to the present invention. FIG. 9 is a front view of the door opening and closing unit of the opening and closing device to illustrate the opening-and-closing sensing unit and the sensor for sensing opening of the door according to the present invention. FIG. 10 is a view showing the operation of the latch bolt moving unit and the opening-and-closing sensing unit of the opening and closing device when the door is closed according to the present invention. FIG. 11 is a view showing the operation of the dead bolt moving unit of the opening and closing device when the door is closed. FIG. 12 is a front view of the door opening and closing unit of the opening and closing device to illustrate the opening-and-closing sensing unit and the sensor for sensing closing of the door according to the present invention.

When a visitor inputs a password to the password input unit 200 or uses the identification unit 300, the password input to the password input unit 200 or the identification information input to the identification unit 300 is transmitted to the control unit 1000. The control unit 1000 compares the input password or identification information to the preset password or identification information and, when determining that they match each other, creates a control signal to open the door opening and closing unit 400. As shown in FIG. 7, the door opening and closing unit 400 that has received the control signal from the control unit 1000 drives the motor 510 of the dead bolt moving unit 500 and rotates the actuating shaft 520 connected to the motor 510 in one direction. Then, the rotating lever 530 is rotated in the same direction by the rotation of the actuating shaft 520. Simultaneously, the protruding piece 532, which is provided on the end of the rotating lever 530 and disposed in the locking depression 541 of the opening and closing member 540, is also rotated, thus moving the opening and closing member 540 in a direction corresponding to the direction of the rotation of the protruding piece 532. Here, because the support pin 544 fixed to the body unit 410 is disposed in the guide slot 543 of the opening and closing member 540, the opening and closing member 540 is linearly moved under the guidance of the support pin 544. When the protruding piece 532 that has rotated is locked to the locking notch 542 formed in the first side edge of the locking depression 541, the rotating lever 530 no longer rotates. Furthermore, in this state, the protruding piece 532 of the rotating lever 530 is supported by the elastic force of the tension spring 545. The rotating lever 530 is therefore prevented from being reversely rotated, unless external force is applied thereto. Consequently, the opening and closing member 540 that has been moved to open can be maintained in place. The dead bolt 560 coupled to the opening and closing member 540 is retracted into the second opening 413 by the movement of the opening and closing member 540, thus allowing opening of the door 10. Simultaneously, as shown in FIG. 9, the protruding piece 532 that is locked to the locking notch 542 formed in the first side edge of the locking depression 541 makes contact with the corresponding sensor 550. The sensor 550 senses that the protruding piece 532 has rotated to open the opening and closing member 540, determines that the dead bolt 560 has been retracted, and then transmits a door-open signal to the control unit 1000. Preferably, the control unit 1000 may output a voice, for example, "door unlocked", or an alarm, a warning sound, etc. using an opening and closing checking unit 570 connected to a speaker.

In this state, as shown in FIG. 8, when the user pushes or pulls, to open the door 10, the grip part 427 of the corresponding door handle 420 in the direction in which the door 10 opens, the movable member 440 is horizontally moved, and the lift guide block 441 provided on the upper surface of the movable member 440 is integrally moved along with the movable member 440. At this time, the lift guide block 441 pushes the roller 456 that makes contact with the inclined surface 442. Then, the roller 456 rotates on its own axis and rolls upwards along the inclined surface 442 of the lift guide block 441 from the bottom of the inclined surface 422 to the top thereof. As the roller 456 moves upwards, the locking stop 457 is moved by the rotation of the links 453 that use the principle of the lever. As moving downwards, the locking stop 457 is completely locked to the locking slot 461 of the actuating member 460 and rotated around the rotation shaft 451, thus moving the actuating member 460 in the direction corresponding to the direction in which the locking stop 457 rotates. Here, because the protrusion 464 of the stopper that is fixed to the body unit 410 through the guide slot 462 of the actuating member 460 guides the movement of the actuating member 460, the actuating member 460 can be reliably moved in the direction perpendicular to the direction in which the movable member 440 moves. The latch bolt 480 coupled to the actuating member 460 is retracted into the first opening 412 by the movement of the actuating member 460, and the door 10 thus opens. During the above process, the restoring spring 470 wrapped around the rotation shaft 451 is expanded by the rotation of the rotating unit 450, and the elastic spring 465 installed in the actuating member 460 is compressed.

As stated above, when the user pushes the grip part 427 of the door handle 420 in the direction in which the door 10 opens, the movable member 440 is pushed by the pushing force of the grip part 427. Here, until the lift guide block 441 of the movable member 440 begins to push the roller 456 upwards, the grip part 427 is easily pushed. While the lift guide block 441 pushes the roller 456 upwards and the roller 456 thus rolls upwards along the inclined surface of the lift guide block 441, the speed at which the grip part 427 is pushed and moved is reduced. Therefore, the user can feel in his or her hand a variation of the speed of the grip part 427, that is, a reduction in the speed at which the grip part 427 is pushed. Thus, the user can sense that the door 10 opens. In addition, by virtue of the rolling motion of the roller 456 that moves upwards along the inclined surface 442 of the lift guide block 441, the user not only may be able to sense that the door 10 is opening but the door 10 can also smoothly open.

As shown in FIG. 9, when the door 10 opens, the sensing bolt 491 of the opening-and-closing sensing unit 490 is ejected outwards from the door 10. The sensor 494 senses that the sensing bolt 491 has been ejected outwards and then transmits a door-open signal to the control unit 1000.

Meanwhile, as shown in FIG. 10, when the door handle 420 that has been pushed or pulled is released in the open state of the door 10, in other words, when the external force that has been applied to the grip part 427 is removed, the restoring spring 470 that has expanded returns to its original state, thus returning the links 453 of the rotating unit 450 to the pre-rotated state. As the links 453 return to their original state, the locking stop 457 is moved upwards whereby the actuating member 460 that has been pulled by the locking stop 457 is released therefrom. The actuating member 460 released from the locking stop 457 is returned to its original position by the restoring force of the elastic spring 465. Thereby, the latch bolt 480 that has been retracted into the first opening 412 is ejected outwards from the first opening 412 by the movement of the actuating member 460 so that the door 10 enters the closed state.

As shown in FIG. 12, when the door 10 enters the closed state, the sensing bolt 491 that has been ejected is retracted into the door 10 by the side frame of the entrance. The sensor 494 senses that the sensing bolt 491 has been retracted and thus transmits a door-close signal to the control unit 1000. When receiving the door-close signal from the opening-and-closing sensing unit 490, the control unit 1000 controls the operation of the dead bolt moving unit 500 to lock the door.

As shown in FIG. 11, when receiving a signal from the control unit 1000, the dead bolt moving unit 500 operates the motor 510 in a reverse direction so that the actuating shaft 520 connected to the motor 510 is reversely rotated. Then, the rotating lever 530 is also reversely rotated by the reverse rotation of the actuating shaft 520. Provided on the end of the rotating lever 530, the protruding piece 532 that is in the locking depression 541 of the opening and closing member 540 reversely rotates and thus moves the opening and closing member 540 in a direction corresponding to the direction in which the protruding piece 532 rotates. During the above process, because the support pin 544 fixed to the body unit 410 is disposed in the guide slot 543 of the opening and closing member 540, the opening and closing member 540 can also linearly move under the guidance of the support pin 544. When the protruding piece 532 that has reversely rotated is locked to the locking notch 542 formed in the second side edge of the locking depression 541, the protruding piece 532 no longer rotates. Furthermore, because the protruding piece 532 of the rotating lever 530 moves the opening and closing member 540 while overcoming the elastic force of the tension spring 545 that elastically supports the protruding piece 532, the rotation of the rotating lever 530 and the movement of the opening and closing member 540 can be reliably and smoothly embodied. The dead bolt 560 coupled to the opening and closing member 540 is ejected outwards from the second opening 413 by the movement of the opening and closing member 540 and inserted into a locking recess (not shown) formed in the side frame of the entrance, thus locking the door 10. Simultaneously, as shown in FIG. 12, the protruding piece 532 that is locked to the locking notch 542 formed in the second side edge of the locking depression 541 makes contact with the corresponding sensor 550. The sensor 550 senses that the protruding piece 532 has reversely rotated to close the opening and closing member 540, determines that the dead bolt 560 has been ejected, and then transmits a door-lock signal to the control unit 1000. Preferably, the control unit 1000 may output a voice, for example, "door locked", or an alarm, warning sound, etc. using the opening and closing checking unit 570 connected to the speaker.

Meanwhile, when receiving a manual opening signal from the manual opening button 900, the control unit 1000 controls the operation of the dead bolt moving unit 500 such that even when the control unit 1000 receives a door-close signal from the opening-and-closing sensing unit 490, the door is not locked. The reason for this is to control the door such that the door is not automatically locked, given the fact that if the door, for example, installed places such as public offices or venues which are crowded, is automatically locked when closed, people cannot rapidly pass through the door.

When the user pushes the opening button 700 provided in the inner casing 120 to open the door 10 and go outside, the control unit 1000 receives a signal from the opening button and releases the locked state of the bolt moving unit 500 in the operating manner illustrated in FIG. 7. Subsequently, when the user pushes the door handle 420, the door 10 opens in the operating manner illustrated in FIG. 8.

As described above, in a digital opening and closing device for an entrance according to the present invention, when pushing or pulling a door handle of a door after unlocking the door, a user can easily sense that the door opens while feeling both variation of the speed of the door handle when a roller begins to move upwards and the rolling motion of the roller. Furthermore, the operation of opening the door can be smoothly conducted. The safety in opening or closing the door and convenience in use can be markedly enhanced.

In addition, the opening and closing device is operated in a pushing or pulling fashion rather than in a rotating fashion. Therefore, even children, the elderly and disabled persons or a user who uses both hands to hold objects can easily open the door. Thus, convenience in use and practicality can be improved. For places such as public offices or venues which are crowded, an accident can be prevented because it is easy to open the door. Particularly, in case of fire, if a handle of the door melts in a fire, it may be impossible to rotate the door handle. However, in the present invention, because the opening and closing device can be easily operated in a pushing fashion, the risk of an accident can be markedly reduced.

Furthermore, when the door is closed, it can be automatically locked. Both security and safety can thus be enhanced.

Moreover, in case of fire, a door opening and closing unit is automatically unlocked so that people can rapidly evacuate and an accident can be prevented.

Second Embodiment

Figure 13:
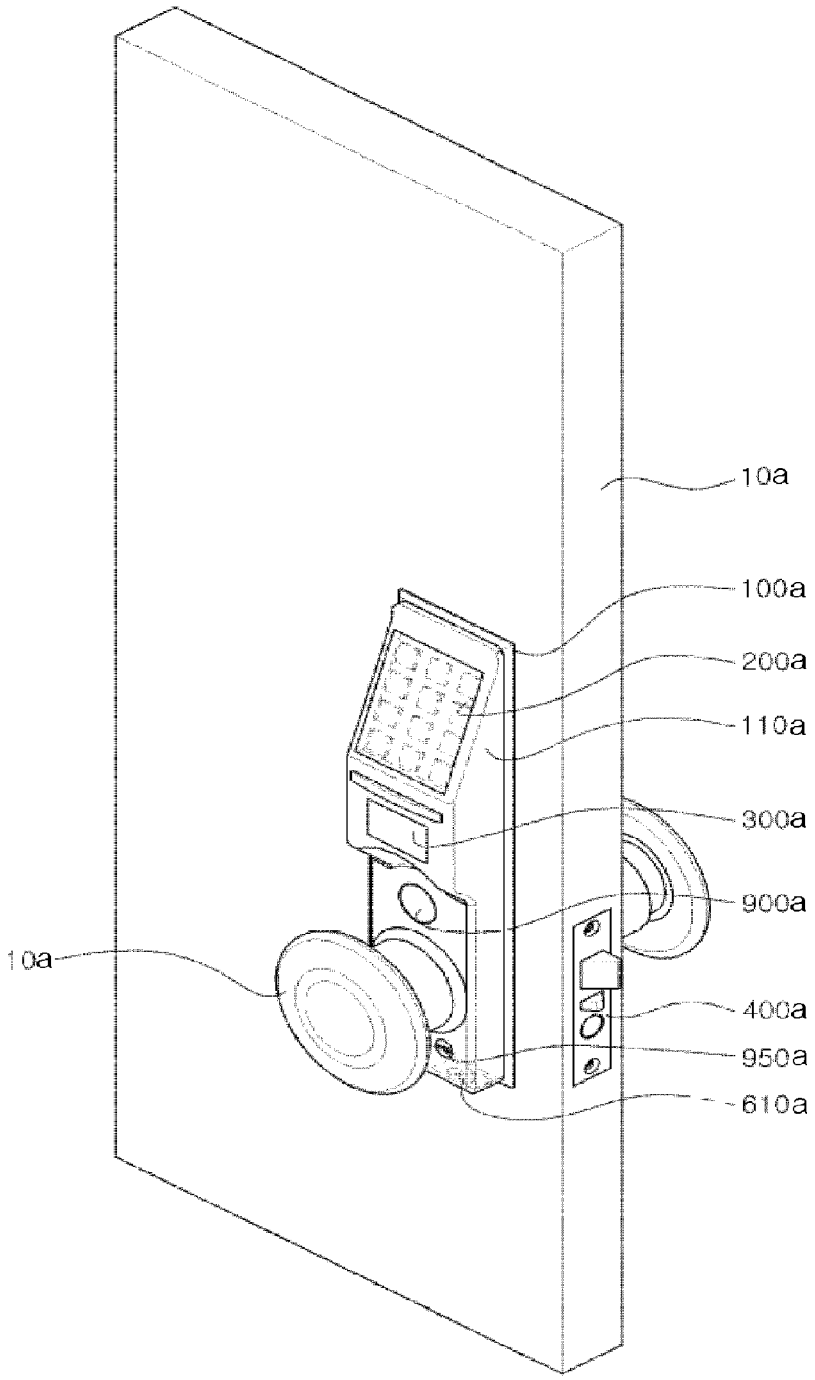
FIG. 13 is a perspective view illustrating an outdoor appearance of a digital opening and closing device for an entrance according to the present invention.
Figure 14:
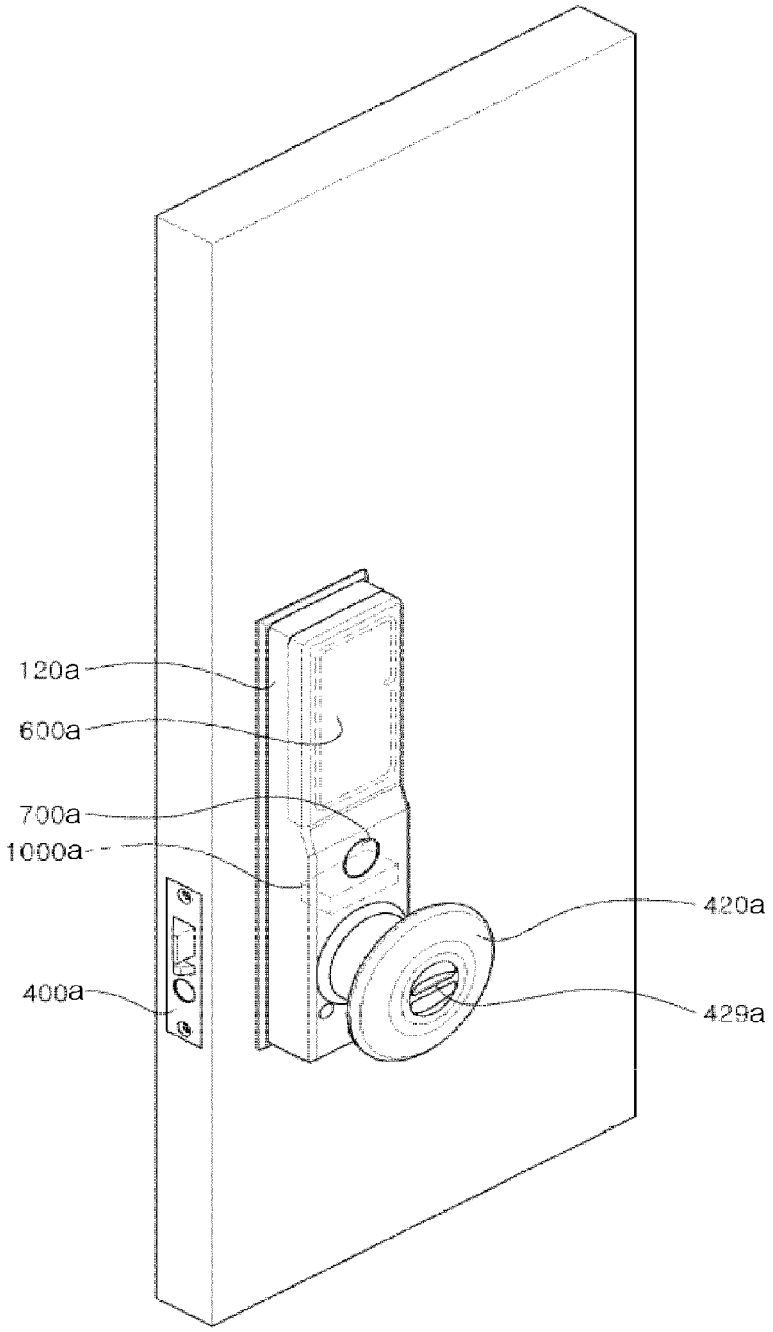
FIG. 14 is a perspective view illustrating an indoor appearance of the opening and closing device according to the present invention.
Figure 15:
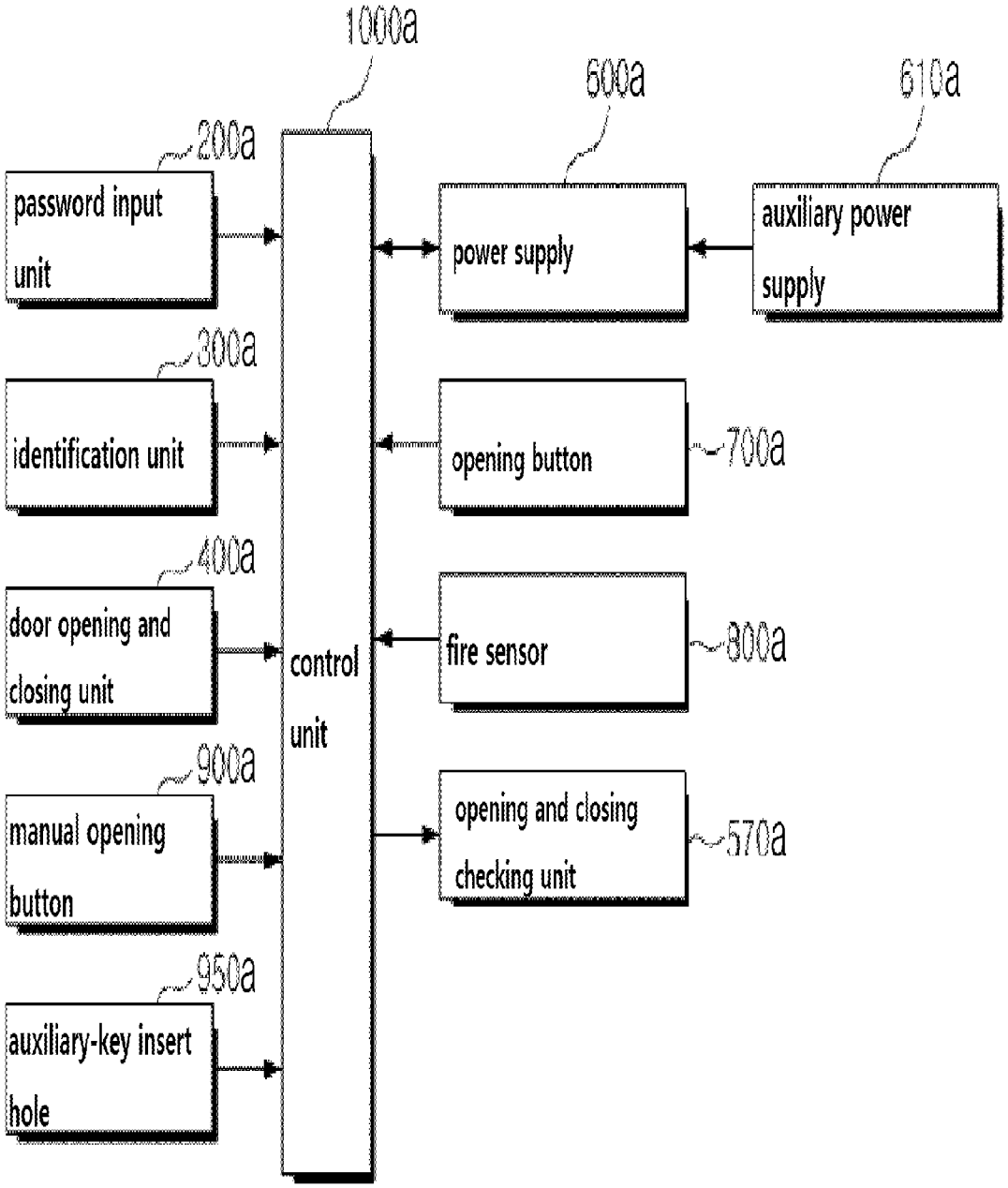
FIG. 15 is a block diagram showing the construction of the opening and closing device according to the present invention.

FIG. 13 is a perspective view illustrating an outdoor appearance of a digital opening and closing device for an entrance according to the present invention. FIG. 14 is a perspective view illustrating an indoor appearance of the opening and closing device according to the present invention. FIG. 15 is a block diagram showing the construction of the opening and closing device according to the present invention.

As shown in FIGS. 13 through 15, the opening and closing device according to the present invention includes a housing 100*a*, a password input unit 200*a*, an identification unit 300*a*, a door opening and closing unit 400*a*, a power supply 600*a*, an opening button 700*a*, a fire sensor 800*a*, a manual opening button 900*a*, an auxiliary-key insert hole 950*a* and a control unit 1000*a*.

The housing 100*a* includes an outer casing 110*a* and an inner casing 120*a* which are respectively disposed at outdoor and indoor sides with a door 10*a* interposed therebetween and are coupled to each other.

The password input unit 200*a* is installed on a front surface of the outer casing 110*a* of the housing 100*a* and includes a keypad which has a combination of numeral buttons and special key buttons for use in inputting a password. The password input unit 200*a* may take the form of a touch panel. Furthermore, the password input unit 200*a* is connected to the control unit 1000*a* and transmits an input password to the control unit 1000*a*.

The identification unit 300*a* includes an identification means for indentifying a visitor. The term "identification means" refers to a device, such as a door phone camera including a CMOS or CCD, a card reader which can recognize a card, a fingerprint reader, an iris reader, etc., which can identify the visitor. In addition, the identification means may include another kind of device which can identify the visitor using voice recognition or by other means. The identification unit 300*a* is connected to the control unit 1000*a* and transmits recognized information to the control unit 1000*a*.

The door opening and closing unit 400*a* is installed within the door 10*a* between the outer casing 110*a* and the inner casing 120*a* of the housing. The door opening and closing unit 400*a* receives a control signal from the control unit 1000*a* and opens or closes the door 10*a*. The construction and operation of the door opening and closing unit 400*a* will be explained in detail later herein.

The power supply 600*a*, using AC power or a battery, supplies drive power to the elements of the opening and closing device. The power supply 600*a* further includes an auxiliary power supply 610*a* which has an emergency battery. In case of emergency, for example, when a blackout occurs or AC power is interrupted, or when the lifetime of the main battery has expired, the auxiliary power supply 610*a* including the emergency battery supplies emergency power to the opening and closing device. The battery is electrically connected to the housing 100*a*. Therefore, when a large electrical shock is applied to the housing 100*a*, the applied electricity is charges the battery, and the strength of shock applied to the housing 100*a* can thus be reduced. In addition, the opening and closing device can be protected from being damaged by the electrical shock.

The opening button 700*a* is installed in the inner casing 120*a* of the housing and connected to the control unit 1000*a*. When a user pushes the opening button 700*a* to exit via the door, an opening signal is applied to the control unit 1000*a*.

The fire sensor 800*a* is installed in the inner casing 120*a* of the housing so as to sense the indoor temperature and connected to the control unit 1000*a*. If the fire sensor 800*a* senses a temperature higher than a preset reference temperature, the fire sensor 800*a* transmits an abnormality signal to the control unit 1000*a*.

The manual opening button 900*a* is installed in the outer casing of the housing and connected to the control unit 1000*a*. For doors used in places such as public offices or venues which are crowded, the manual opening button 900*a* applies a signal to the control unit 1000*a* to prevent the door from being automatically locked when the door is closed.

The auxiliary-key insert hole 950*a* is formed in the outer casing 120*a* of the housing. An auxiliary key for use in unlocking the door is inserted into the auxiliary-key insert hole 950*a*. When the auxiliary key is inserted into the auxiliary-key insert hole 950*a*, a unlocking signal of the door opening and closing unit 400*a* is applied to the control unit 1000*a*.

The control unit 1000*a* is electrically connected to the password input unit 200*a*, the identification unit 300*a*, the door opening and closing unit 400*a*, the power supply 600*a*, the opening button 700*a*, the fire sensor 800*a*, the manual opening button 900*a* and the auxiliary-key insert hole 950*a*. The control unit 1000*a* functions to control the elements. Receiving a password input to the password input unit 200*a* or information input to the identification unit 300*a*, the control unit 1000*a* compares it with preset reference password or information. If the input password or information matches the preset reference password or information, the control unit 1000*a* creates a control signal to unlock the door opening and closing unit 400*a*. Furthermore, when receiving an abnormality signal from the fire sensor 800*a*, the control unit 1000*a* creates a control signal to unlock the door opening and closing unit 400*a*. When receiving an opening signal from the opening button 700*a*, the control unit 1000*a* also creates a control signal to unlock the door opening and closing unit 400*a*. If receiving a signal from the manual opening button 900*a*, the control unit 1000*a* controls the locking operation of the door opening and closing unit 400*a* such that when the door is closed, an automatic locking operation of the door opening and closing unit 400*a* is not conducted. In addition, when the key is inserted into the auxiliary-key insert hole 950*a* and a key insert signal is applied, the control unit 1000*a* creates a control signal to unlock the door opening and closing unit 400*a*.

Figure 16:
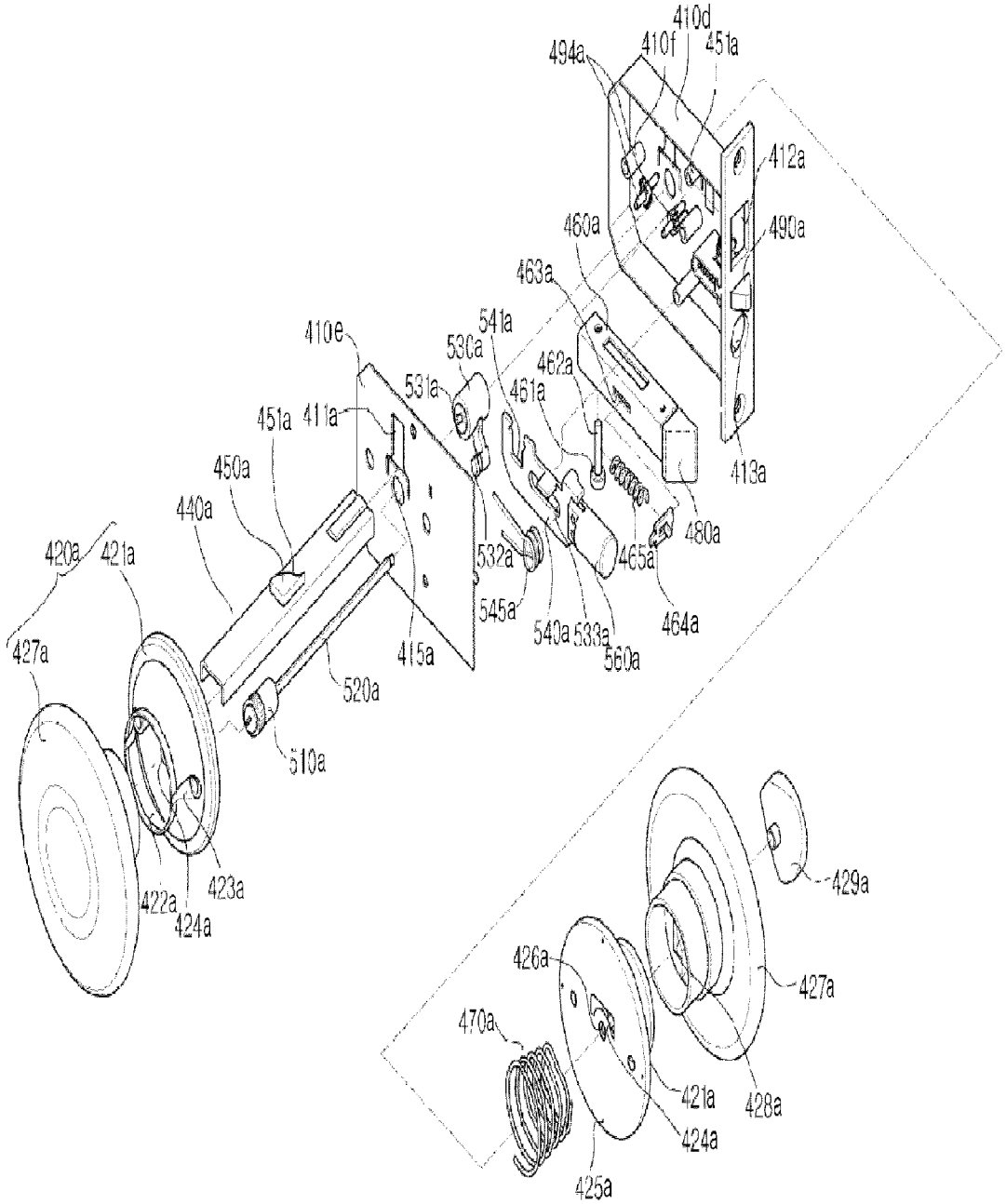
FIG. 16 is an exploded perspective view illustrating a door opening and closing unit of the opening and closing device according to the present invention.
Figure 17:
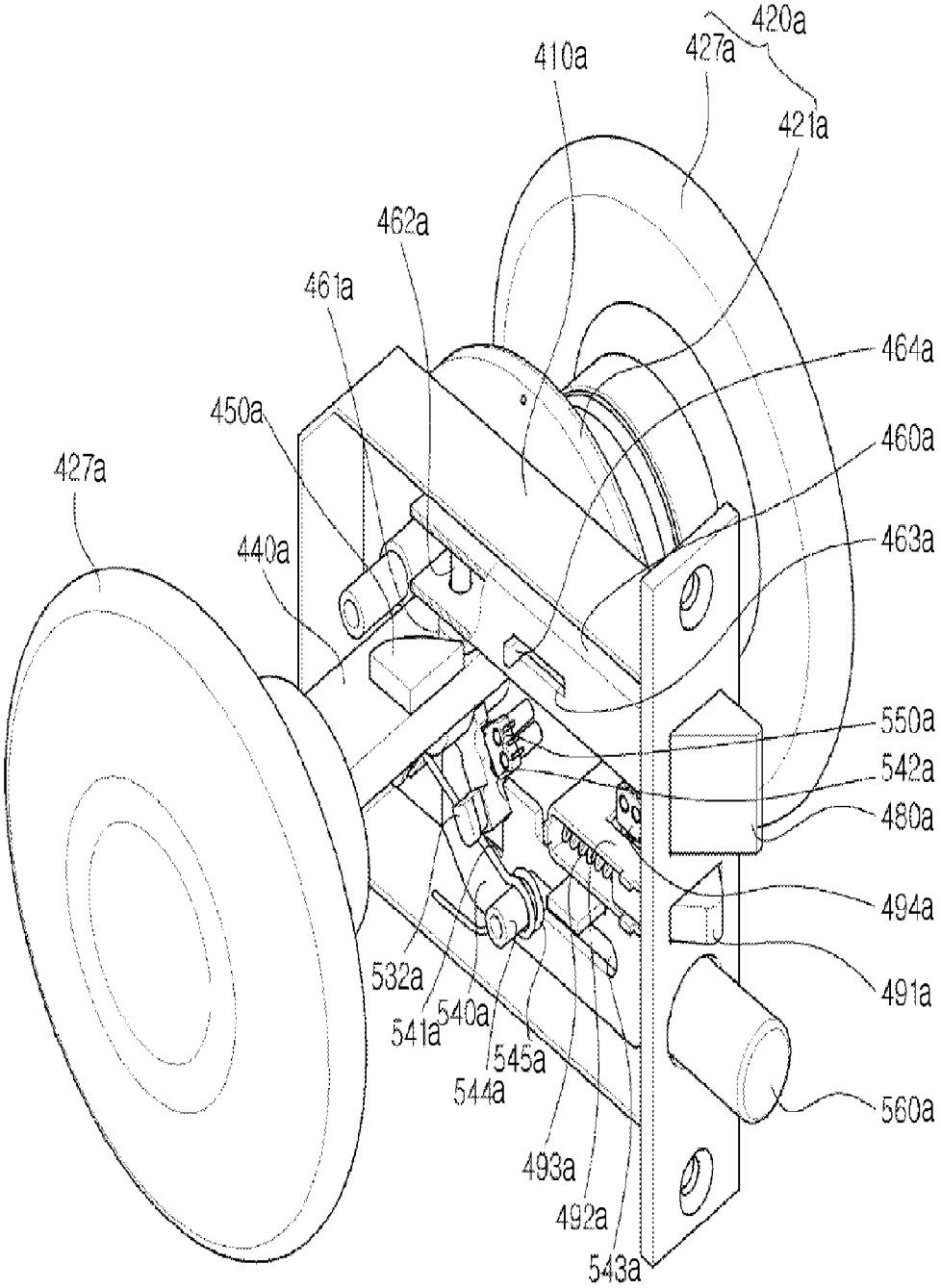
FIG. 17 is a perspective view showing the assembled door opening and closing unit of FIG. 16.

FIG. 16 is an exploded perspective view illustrating the door opening and closing unit of the opening and closing device according to the present invention. FIG. 17 is a perspective view showing the assembled door opening and closing unit of FIG. 16.

As shown in FIGS. 16 through 17, the door opening and closing unit 400*a* includes a body unit 401*a*, door handles

420*a*, a latch bolt moving unit 430*a*, an opening-and-closing sensing unit 490*a* and a dead bolt moving unit 500*a*. The body unit 410*a* has, in a side surface thereof, a first opening 412*a* in which a latch bolt is retractably disposed, a second opening 413*a* in which a dead bolt is retractably disposed, and a third opening 414*a* in which a sensing bolt is disposed. The door handles 420*a* are respectively provided below the inner and outer casing 120*a* and 110*a* and configured so as to be pushed and pulled. The latch bolt moving unit 430*a* is coupled to the door handles 420*a* and configured such that when either door handle 420*a* is pushed or pulled, the latch bolt is retracted into the door 10*a* to allow the door 10*a* to open, and when the door handle 420*a* that has been pushed or pulled is released, the latch bolt is ejected from the door 10*a* to maintain the door 10*a* in a closed state. The opening-and-closing sensing unit 490*a* senses the operation of opening or closing the door 10*a* and transmits it to the control unit 1000*a*. The dead bolt moving unit 500*a* locks or unlocks the door 10*a* depending on a control signal of the control unit 1000.

The body unit 410*a* includes a main body 410*d* which is open on a surface thereof and receives a rotating unit 150*a* and an actuating member 160*a* therein, and a cover 410*e* which covers the open surface of the main body 410*d*. The main body 410*d* and the cover 410*e* are coupled to each other by a plurality of fasteners 410*f*. The body unit 410*d* has a movable-member passing hole 411*a* which is formed in central portions of the cover 410*e* and the main body 410*d*. The main body 410*d* has, in a side surface thereof, the first opening 412*a* in which the latch bolt 480*a* is retractably disposed, the second opening 413*a* in which the dead bolt 560*a* is retractably disposed, and the third opening 414*a* which is formed between the first and second openings 412*a* and 413*a* and in which the sensing bolt is retractably disposed. The body unit 410*a* is installed in the door 10*a* in such a way that the first, second and third openings 412*a*, 413*a* and 414*a* are exposed to the outside from the side surface of the door 10*a*.

Each door handle 420*a* includes a mounting bracket 421*a* which are coupled to a corresponding one of the outer and inner casings 110*a* and 120*a*, and a grip part 427*a* which is inserted into the mounting bracket 421*a* and configured to be pushed and pulled.

The mounting bracket 421*a* has a receiving space 422*a* in which a first end of the grip part 427*a* is disposed so as to be movable forwards or backwards. Guide holes 423*a* are formed in the mounting bracket 412*a* on opposite sides of the receiving space 422*a*. Communicating with the receiving space 422*a*, a hole 424*a* is formed in a central portion of a surface of the mounting bracket 421*a* that makes contact with the door 10*a*. The hole 424*a* has the same shape as that of a movable member 431*a* so that the movable member 431*a* is inserted into the hole 424*a*. A plurality of fixing protrusions 425*a*, each of which has a pointed shape, are provided around the hole 424*a* on the mounting bracket 421*a* and pegged into the corresponding surface of the door 10*a*. Pegged into the surface of the door 10*a* that makes contact with the mounting bracket 421*a*, the fixing protrusions 425*a* function to fix the mounting bracket 421*a* in place.

A protrusion is provided on a central portion of a first surface of each grip part 427*a* and disposed in the receiving space 422*a* of the corresponding mounting bracket 421*a* so as to be movable forwards or backwards. An insert depression 428*a* having the same shape as that of the hole 424*a* of the mounting bracket 421*a* is formed in the grip part 427*a*.

The latch bolt moving unit 430*a* includes the movable member 440*a*, a guide block 450*a*, an actuating member 460*a* and a restoring spring 470*a*.

The movable member 440*a* has a reverse U-shaped cross-section. Opposite ends of the movable member 440*a* that is disposed in the movable-member passing hole 411*a* of the body unit are respectively fitted into the insert holes 428*a* of the grip parts of the door handles 420*a* through the holes 424*a* of the mounting brackets 421*a* of the door handles 420*a*. The movable member 440*a* is moved by the operation of pushing or pulling the door handle 420*a*.

The guide block 450*a* protrudes from a medial portion of an upper surface of the movable member 440*a*. A side surface of the guide block 450*a* has an inclined surface 451*a* which is gently curved to guide movement of a roller 461*a* which will be explained later herein.

The actuating member 460*a* has a hollow structure. The roller 461*a* which makes contact with the inclined surface 451*a* of the guide block 450*a* is provided in a first end of the actuating member 460*a*. Disposed in the first opening 412*a* of the body unit 410*a*, the latch bolt 480*a* is coupled to a second end of the actuating member 460*a*. In detail, the roller 461*a* is coupled to the first end of the actuating member 460*a* by a pin 462*a* such that the roller 461*a* can roll along the inclined surface 451*a* of the guide block 450*a*. A guide slot 463*a* is formed in a medial portion of the actuating member 460*a*. Protruding from the body unit, a protrusion pin 464*a* is disposed in the guide slot 463*a*. Thereby, the actuating member 460*a* can be smoothly and reliably moved under guidance of the protrusion pin 464*a* disposed in the guide slot 463*a*. An elastic spring 465*a* is provided between the protrusion pin 464*a* and the pin 462*a* for use in installation of the roller 461*a*. The elastic spring 465*a* functions to return the actuating member 460*a* to its original position when no external force is applied to the actuating member 460*a*. When the movable member 440*a* horizontally moves, because of the roller 461*a* that moves along the inclined surface 451*a* of the guide block 450*a*, the actuating member 460*a* moves in a direction perpendicular to the direction in which the movable member 440*a* moves. Consequently, the latch bolt 480*a* coupled to the actuating member 460*a* is ejected outwards from the door 10 or retracted thereinto.

The restoring spring 470*a* is installed between one surface of the body unit 410*a* and the mounting bracket 421*a* of the corresponding door handle. When external force is applied to the grip part 427*a* of either of the door handles and thus the movable member 440*a* is moved, the restoring spring 470*a* is compressed, and when the external force is removed, the restoring spring 470*a* is restored to its original state, thereby returning the movable member 440*a* to its original position.

The opening-and-closing sensing unit 490*a* is provided between the latch bolt moving unit and the dead bolt moving unit. The opening-and-closing sensing unit 490*a* includes a sensing bolt 491*a* which is disposed in the third opening 414*a* of the body unit, a receiving space 492*a* which receives the sensing bolt 491*a*, a spring 493*a* which is provided in the receiving space 492*a* and elastically supports the sensing bolt 491*a*, and a sensor 494*a* which senses movement of the sensing bolt 491*a* and determines whether the door 10*a* is in the closed state or not.

In the opening-and-closing sensing unit 490*a*, when the door 10*a* is closed, the sensing bolt 491*a* that has been ejected outwards from the door 10*a* is retracted into the door 10*a* by a side frame of an entrance. When the door 10*a* opens, the sensing bolt 491*a* is ejected outwards from the door 10*a*. The sensor 494*a* senses ejection and retraction of the sensing bolt 491*a*, determines whether the door 10*a* is in the closed state or not, and then transmits a sensing signal to the control unit 1000*a*. When receiving a door-close signal from the opening-and-closing sensing unit 490*a*, the control unit 1000*a* controls the operation of the dead bolt moving unit 500*a* to lock the door 10*a*.

The dead bolt moving unit 500*a* includes a motor 510*a* which is operated in response to a signal of the control unit 1000*a*; an actuating shaft 520*a* which is rotated to the left or right by the operation of the motor 510*a*; a rotating lever 530*a* which is coupled to the actuating shaft 520*a*, is disposed in the body unit 410*a*, and is rotated to the left or right by the rotation of the actuating shaft 520*a*; an opening and closing member 540*a* which is coupled to the dead bolt 560*a* disposed in the second opening 413*a* of the body unit and is moved to the left or right in conjunction with the rotation of the rotating lever 530*a*; and a sensor 550*a* which senses the operation of the rotating lever 530*a* and thus determines whether the dead bolt 560*a* is in a closed state or an open state.

For this, a though hole 415*a*, in which the actuating shaft 520*a* is disposed, is formed in the body unit 410*a*. A passing hole 426*a*, in which the actuating shaft 520*a* is disposed, is formed in a mounting bracket 421*a* of the door handle 420*a* that is installed on the inner casing 120*a* of the housing. A locking unit 429*a* is installed in the grip part 427*a* at a position corresponding to the passing hole 426*a* of the mounting bracket 421*a*. A first end of the actuating shaft 520*a* is connected to the motor 510*a*, and a second end of the actuating shaft 520*a* is connected to the locking unit 429*a* installed in a central portion of the door handle 420*a* that is disposed at an indoor side. The locking unit 429*a* that is installed in the door handle 420*a* disposed at the indoor side is used to manually unlock the door 10*a* in case of emergency.

The rotating lever 530*a* includes a cylindrical body which has in a central portion thereof a rectangular hole 531*a* into which the actuating shaft 520*a* is inserted, and a protruding piece 532*a* which protrudes outwards from an outer surface of the cylindrical body. A guide groove 533*a* is formed in an outer surface of the protruding piece 532*a*. Because the actuating shaft 520*a* and the hole 531*a* of the rotating lever 530*a* are rectangular, the rotating lever 530*a* can be rotated along with the actuating shaft 520*a*.

The opening and closing member 540*a* is disposed below the rotating lever 530*a*. A locking depression 541*a* to which the protruding piece 532*a* of the rotating lever 530*a* is locked is formed at a predetermined position in an upper edge of the opening and closing member 540*a*. Locking notches 542*a* are respectively formed in opposite side edges of the locking depression 541*a* so that, when rotated to the maximum, the protruding piece 532*a* is locked to the corresponding locking notch 542*a*. Extending a predetermined length in the longitudinal direction of the opening and closing member 540*a*, a guide slot 543 is formed in a central portion of the opening and closing member 540*a*. Protruding from the inner surface of the body unit 410*a*, a support pin 544*a* is disposed in the guide slot 543*a*. A tension spring 545*a* which elastically supports the protruding piece 532*a* of the rotating lever 530*a* is wrapped around the support pin 544*a*. Wrapped around the support pin 544*a*, the tension spring 545*a* is fixed at a first end thereof to the bottom surface of the body unit 410*a* and fixed at a second end thereof to the sidewall of the body unit 410*a* via a lower surface of the guide groove 533*a* of the rotating lever 530*a*. An end of the opening and closing member 540*a* is coupled to the dead bolt 560*a* disposed in the second opening 413*a*.

The sensor 550*a* comprises two sensors which are respectively provided on opposite sides of the rotating lever 530*a*. In detail, each sensor 550*a* is disposed at a position at which the protruding piece 532*a* of the rotating lever comes into contact with the sensor 550*a* when the protruding piece 532*a* is rotated to the maximum and locked to the corresponding locking notch 542*a* of the locking depression 541*a*.

Hereinafter, the operation of the digital opening and closing device having the above-mentioned construction will be described in detail.

Figure 18:
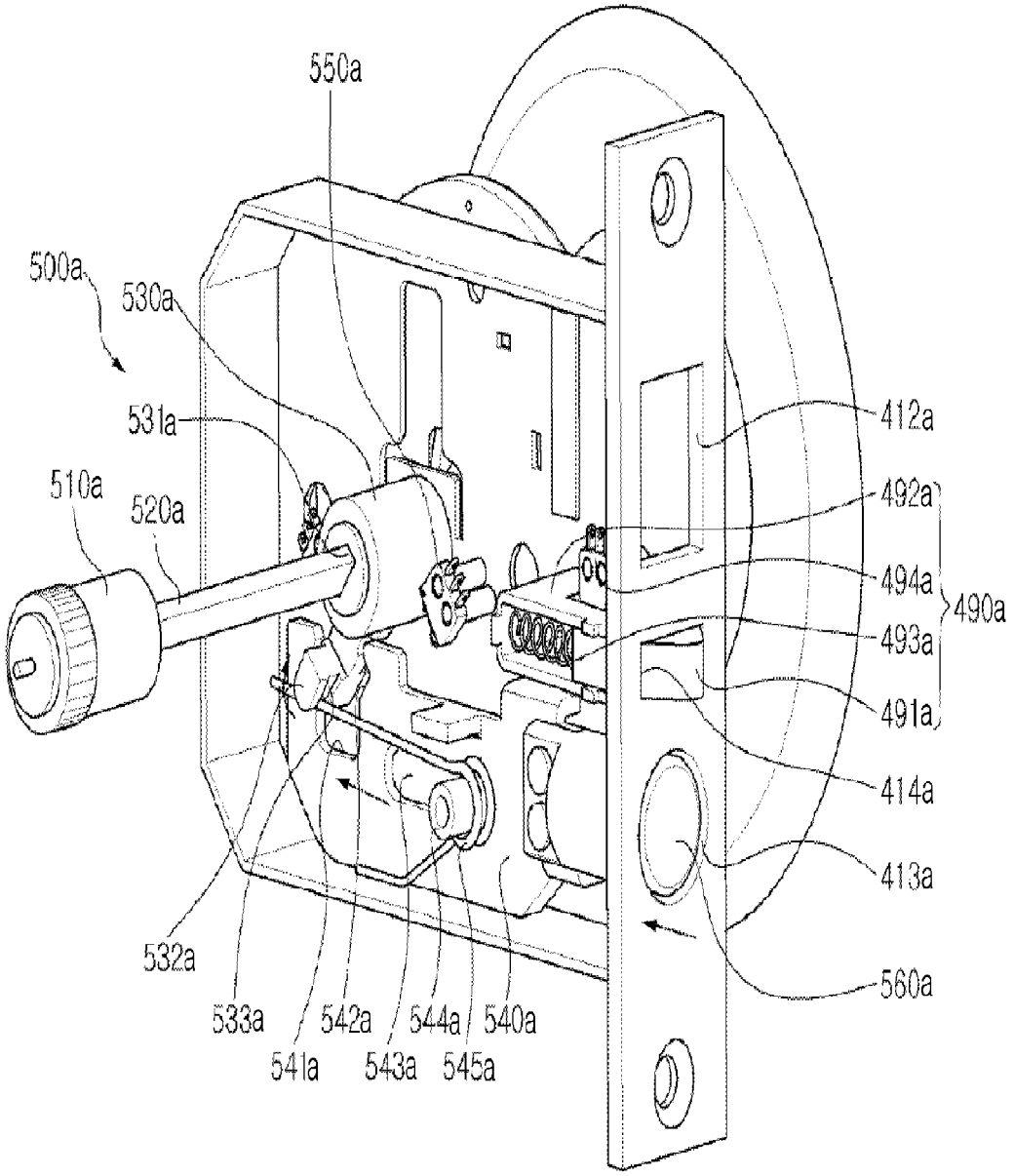
FIG. 18 is a view showing the operation of a dead bolt moving unit of the opening and closing device when a door opens according to the present invention.
Figure 19:
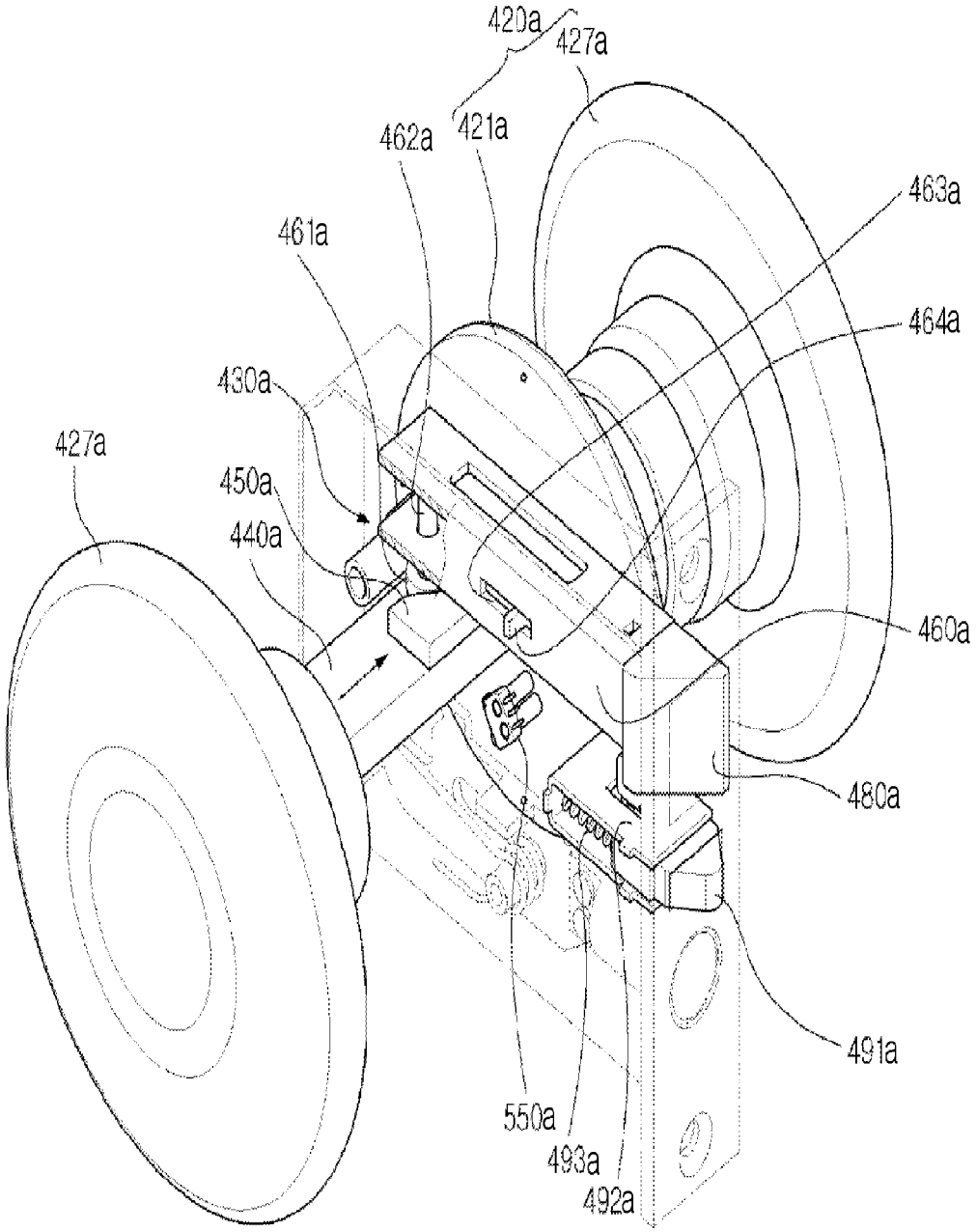
FIG. 19 is a view showing the operation of a latch bolt moving unit and an opening-and-closing sensing unit of the opening and closing device when the door opens according to the present invention.
Figure 20:
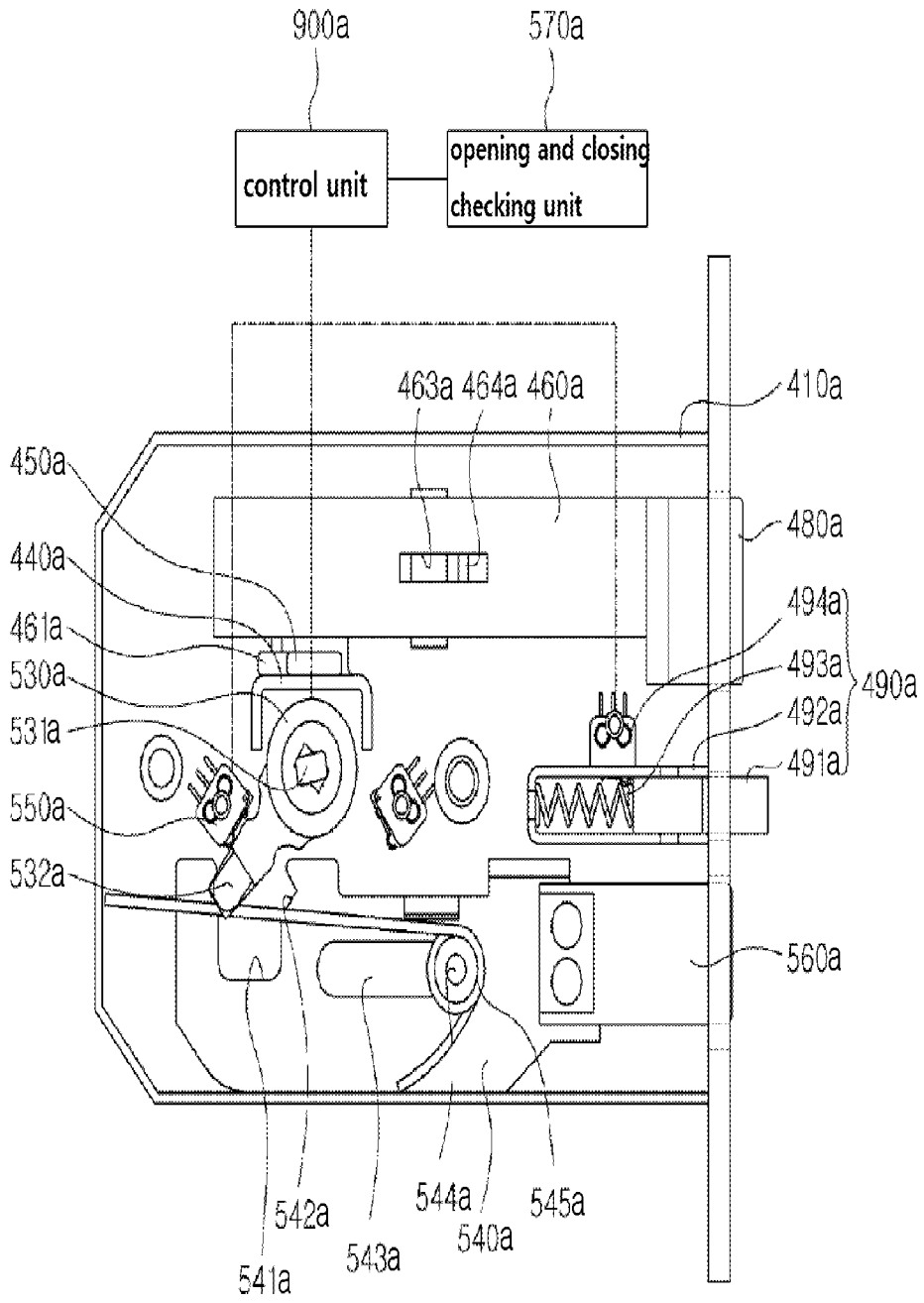
FIG. 20 is a front view of the door opening and closing unit of the opening and closing device to illustrate the opening-and-closing sensing unit and a sensor for sensing opening of the door according to the present invention.
Figure 21:
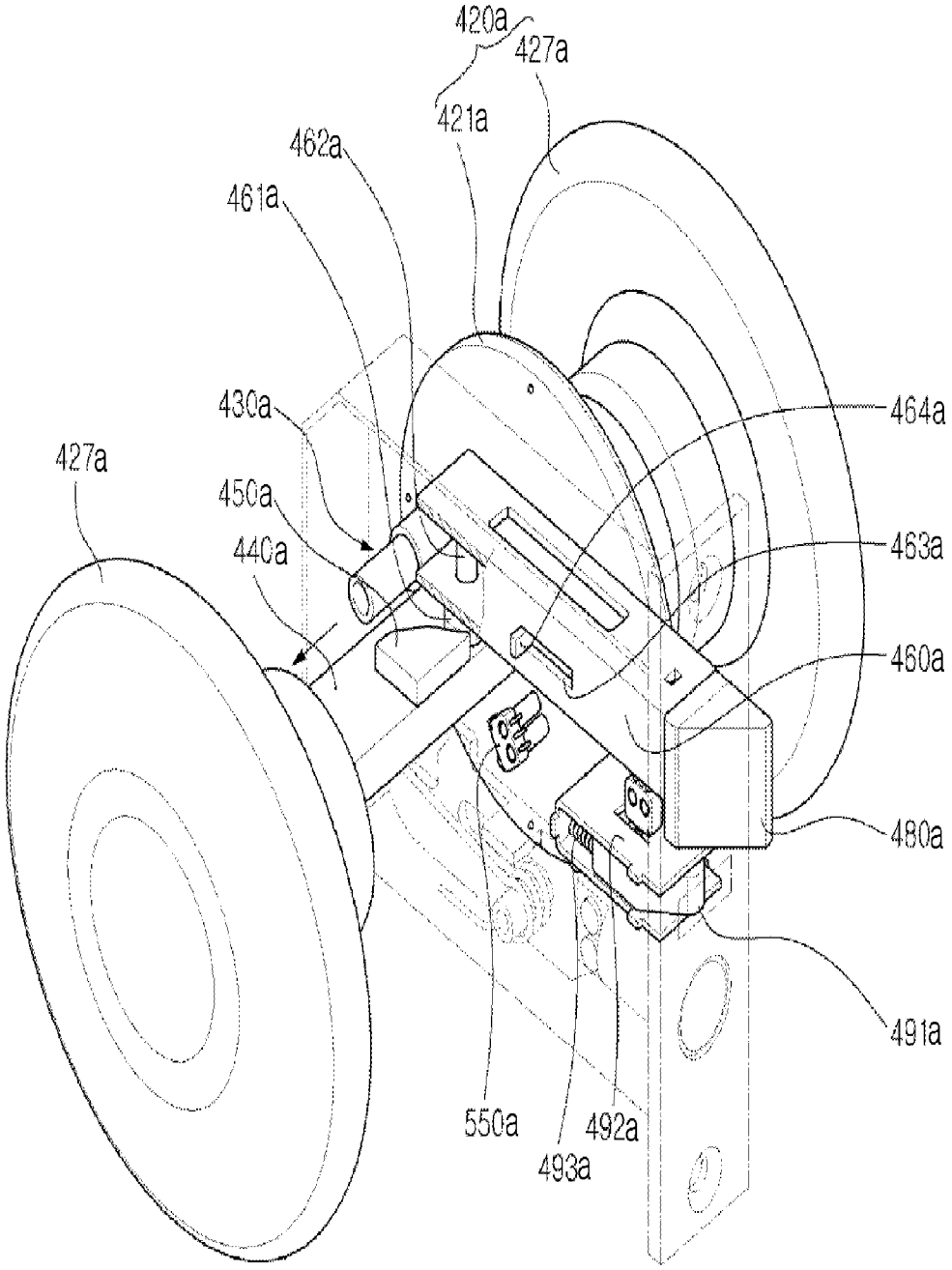
FIG. 21 is a view showing the operation of the latch bolt moving unit and the opening-and-closing sensing unit of the opening and closing device when the door is closed according to the present invention.
Figure 22:
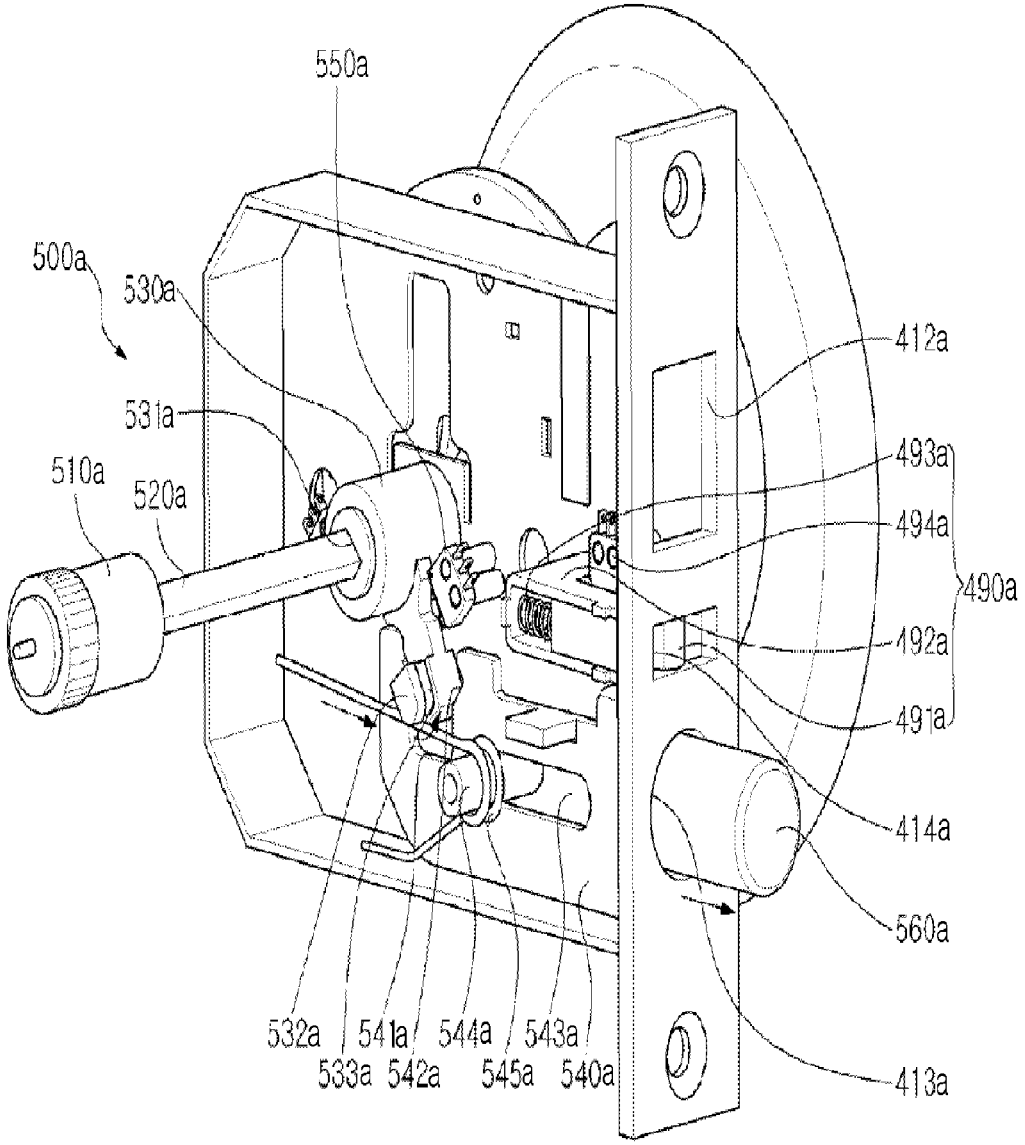
FIG. 22 is a view showing the operation of the dead bolt moving unit of the opening and closing device when the door is closed.
Figure 23:
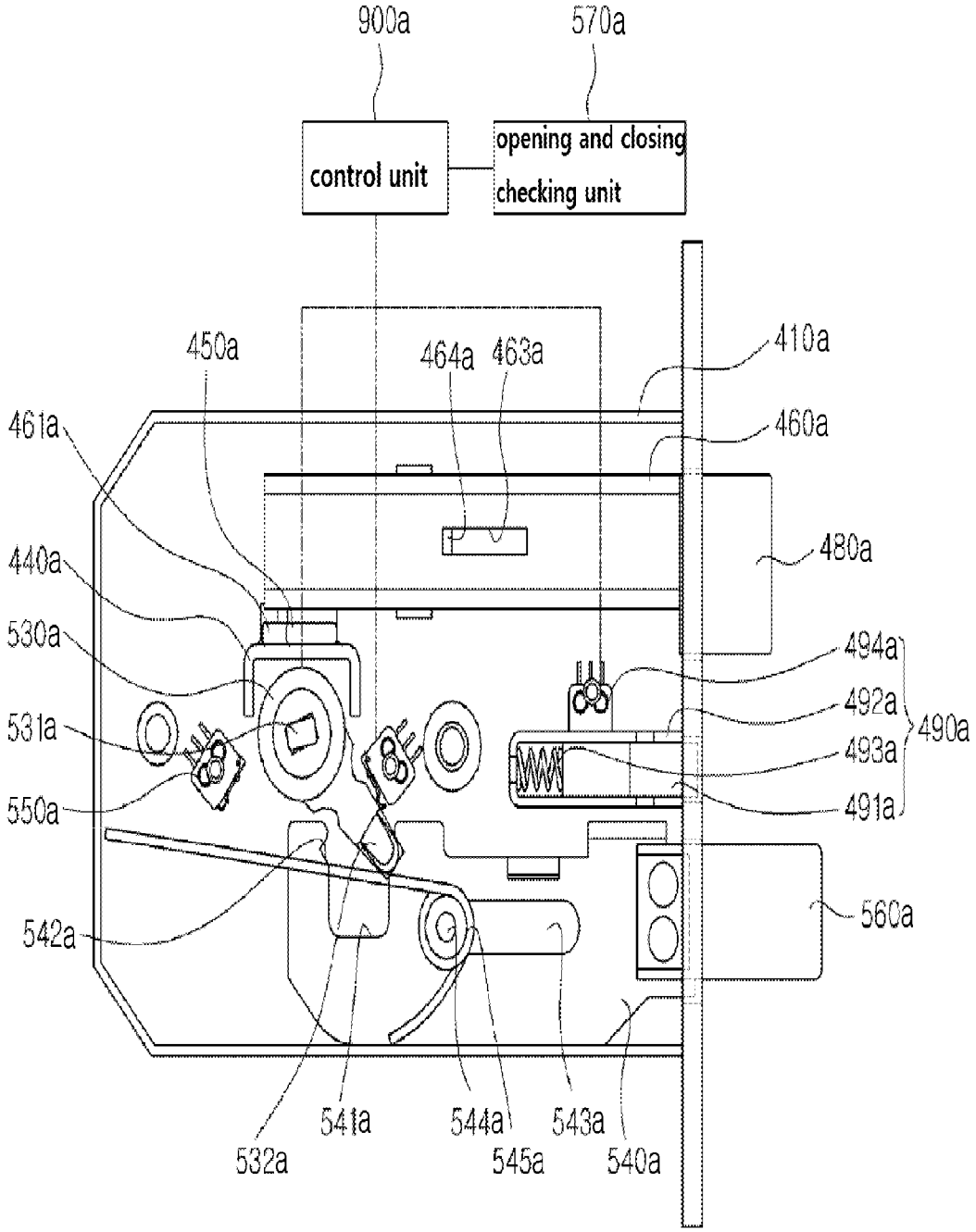
FIG. 23 is a front view of the door opening and closing unit of the opening and closing device to illustrate the opening-and-closing sensing unit and a sensor for sensing closing of the door according to the present invention.

FIG. 18 is a view showing the operation of the dead bolt moving unit of the opening and closing device when the door opens according to the present invention. FIG. 19 is a view showing the operation of the latch bolt moving unit and the opening-and-closing sensing unit of the opening and closing device when the door opens according to the present invention. FIG. 20 is a front view of the door opening and closing unit of the opening and closing device to illustrate the opening-and-closing sensing unit and the sensor for sensing opening of the door according to the present invention. FIG. 21 is a view showing the operation of the latch bolt moving unit and the opening-and-closing sensing unit of the opening and closing device when the door is closed according to the present invention. FIG. 22 is a view showing the operation of the dead bolt moving unit of the opening and closing device when the door is closed. FIG. 23 is a front view of the door opening and closing unit of the opening and closing device to illustrate the opening-and-closing sensing unit and the sensor for sensing closing of the door according to the present invention.

When a visitor inputs a password to the password input unit 200*a* or uses the identification unit 300*a*, the password input to the password input unit 200*a* or the identification information input to the identification unit 300*a* is transmitted to the control unit 1000*a*. The control unit 1000*a* compares the input password or identification information to the preset password or identification information and, when determining that they match each other, creates a control signal to open the door opening and closing unit 400*a*. As shown in FIG. 18, the door opening and closing unit 400*a* that has received the control signal from the control unit 1000*a* drives the motor 510*a* of the dead bolt moving unit 500*a* and rotates the actuating shaft 520*a* connected to the motor 510*a* in one direction. Then, the rotating lever 530*a* is rotated in the same direction by the rotation of the actuating shaft 520*a*. Simultaneously, the protruding piece 532*a*, which is provided on the end of the rotating lever 530*a* and disposed in the locking depression 541*a* of the opening and closing member 540*a*, is also rotated, thus moving the opening and closing member 540*a* in a direction corresponding to the direction of the rotation of the protruding piece 532*a*. Here, because the support pin 544*a* fixed to the body unit 410*a* is disposed in the guide slot 543*a* of the opening and closing member 540*a*, the opening and closing member 540*a* is linearly moved under the guidance of the support pin 544*a*. When the protruding piece 532*a* that has rotated is locked to the locking notch 542*a* formed in the first side edge of the locking depression 541*a*, the rotating lever 530*a* no longer rotates. Furthermore, in this state, the protruding piece 532*a* of the rotating lever 530*a* is supported by the elastic force of the tension spring 545*a*. The rotating lever 530*a* is therefore prevented from being reversely rotated, unless external force is applied thereto. Consequently, the opening and closing member 540*a* that has been moved to a door openable state can be maintained in place. The dead bolt 560*a* coupled to the opening and closing member 540*a* is retracted into the second opening 413*a* by the movement of the opening and closing member 540*a*, thus allowing opening of the door 10*a*. Simultaneously, as shown in FIG. 20, the protruding piece 532*a* that is locked to the locking notch 542*a* formed in the first side edge of the locking depression 541*a* makes contact with the corresponding sensor 550*a*. The sensor 550*a* senses that the protruding piece 532*a* has rotated to open the opening and closing member 540*a*, determines that the dead bolt 560*a* has been retracted, and then transmits a door-open signal to the control unit 1000*a*. Preferably, the control unit 1000*a* may output a voice, for example, "door unlocked", or an alarm, a warning sound, etc. using an opening and closing checking unit 570*a* connected to a speaker.

In this state, as shown in FIG. 19, when the user pushes or pulls, to open the door 10*a*, the grip part 427*a* of the corresponding door handle 420*a* in the direction in which the door 10*a* opens, the movable member 440*a* is horizontally moved, and the guide block 540*a* provided on the upper surface of the movable member 440*a* integrally moves along with the movable member 440*a* while pushing the roller 461*a* which makes contact with the inclined surface 451*a*. The roller 461*a* rotates around the pin 462*a* and moves along the inclined surface 451*a* of the guide block 450*a* in a direction inclined to the direction in which the movable member 440*a* moves. As the roller 461*a* moves, the actuating member 460*a* coupled to the roller 461*a* by the pin 462*a* is moved in a direction perpendicular to the direction in which the movable member 440*a* moves. During this process, the actuating member 460*a* can smoothly and reliably move because the protrusion pin 464*a* disposed in the guide slot 463*a* of the actuating member 460*a* guides the actuating member 460*a*. The latch bolt 480*a* coupled to the actuating member 460*a* is retracted into the door 10*a*. Furthermore, the restoring spring 470*a* provided between the body unit 410*a* and the mounting bracket 421*a* of the door handle is compressed by the movement of the movable member 440*a* that is caused by pulling or pushing the grip part 427*a*.

As stated above, when the user pushes the grip part 427*a* of the door handle in the direction in which the door 10*a* opens, the movable member 440*a* is pushed by the pushing force of the grip part 427*a*. Here, until the guide block 450*a* of the movable member 440*a* begins to push the roller 456*a*, the grip part 427*a* is easily pushed. While the guide block 450*a* pushes the roller 456*a* and the roller 456 thus rolls along the inclined surface of the guide block 450*a*, the speed at which the grip part 427*a* is pushed and moved is reduced. Therefore, the user can feel in his or her hand a variation of the speed of movement of the grip part 427*a*, that is, a reduction, due to the rolling motion of the roller, of the speed at which the grip part 427*a* is pushed. Thus, the user can sense that the door 10*a* is opening. In addition, by virtue of the rolling motion of the roller 456 that moves along the inclined surface 451*a* of the guide block 450*a* in the direction inclined to the direction in which the movable member 440*a* moves, the user may not only be able to sense that the door 10*a* is opening but also the door opening movement is smooth.

As shown in FIG. 20, when the door 10*a* opens, the sensing bolt 491*a* of the opening-and-closing sensing unit 490*a* is ejected outwards from the door 10*a*. The sensor 494*a* senses that the sensing bolt 491*a* has been ejected outwards and then transmits a door-open signal to the control unit 1000*a*.

Meanwhile, as shown in FIG. 21, when the door handle 420*a* that has been pushed or pulled is released in the open state of the door 10*a*, in other words, when the external force that has been applied to the grip part 427*a* is removed, the restoring spring 470*a* that has compressed returns to its original state, thus returning the movable member 440*a* to its pre-rotated state. For the returning of the movable member 440*a*, as the roller 461*a* that has moved along the inclined surface 451*a* of the guide block 450*a* is returned to its original position, the actuating member 460*a* is moved in a direction perpendicular to the direction of the movement of the movable member 440*a* and returned to its original position. Then, the latch bolt 480*a* that has been retracted into the first opening 412*a* is ejected outwards from the first opening 412*a* by the movement of the actuating member 460*a* so that the door 10*a* enters the closed state.

As shown in FIG. 23, when the door 10*a* enters the closed state, the sensing bolt 491*a* that is in an ejected state is pushed into the door 10*a* by the side frame of the entrance. The sensor 494*a* senses that the sensing bolt 491*a* has been pushed in and thus transmits a door-close signal to the control unit 1000*a*. When receiving the door-close signal from the opening-and-closing sensing unit 490*a*, the control unit 1000*a* controls the operation of the dead bolt moving unit 500*a* to lock the door.

As shown in FIG. 22, when receiving a signal from the control unit 1000*a*, the dead bolt moving unit 500*a* operates the motor 510*a* in a reverse direction so that the actuating shaft 520*a* connected to the motor 510*a* is reversely rotated. Then, the rotating lever 530*a* is also reversely rotated by the reverse rotation of the actuating shaft 520*a*. Provided on the end of the rotating lever 530*a*, the protruding piece 532*a* that is in the locking depression 541*a* of the opening and closing member 540*a* reversely rotates and thus moves the opening and closing member 540*a* in a direction corresponding to the direction in which the protruding piece 532*a* rotates. During the above process, because the support pin 544*a* fixed to the body unit 410*a* is disposed in the guide slot 543*a* of the opening and closing member 540*a*, the opening and closing member 540*a* can also linearly move under the guidance of the support pin 544*a*. When the protruding piece 532*a* that has reversely rotated is locked to the locking notch 542*a* formed in the second side edge of the locking depression 541*a*, the protruding piece 532*a* no longer rotates. Furthermore, because the protruding piece 532*a* of the rotating lever 530*a* moves the opening and closing member 540*a* while overcoming the elastic force of the tension spring 545*a* that elastically supports the protruding piece 532*a*, the rotation of the rotating lever 530*a* and the movement of the opening and closing member 540*a* can be reliably and smoothly embodied. The dead bolt 560*a* coupled to the opening and closing member 540*a* is ejected outwards from the second opening 413*a* by the movement of the opening and closing member 540*a* and inserted into a locking recess (not shown) formed in the side frame of the entrance, thus locking the door 10*a*. Simultaneously, as shown in FIG. 23, the protruding piece 532*a* that is locked to the locking notch 542*a* formed in the second side edge of the locking depression 541*a* makes contact with the corresponding sensor 550*a*. The sensor 550*a* senses that the protruding piece 532*a* has reversely rotated to close the opening and closing member 540*a*, determines that the dead bolt 560*a* has been ejected, and then transmits a door-lock signal to the control unit 1000*a*. Preferably, the control unit 1000*a* may output a voice, for example, "door locked", or an alarm, warning sound, etc. using the opening and closing checking unit 570*a* connected to the speaker.

Meanwhile, when receiving a manual opening signal from the manual opening button 900*a*, the control unit 1000*a* controls the operation of the dead bolt moving unit 500*a* such that even when the control unit 1000*a* receives a door-close signal from the opening-and-closing sensing unit 490*a*, the door is not locked. The reason for this is to control the door such that the door is not automatically locked, given the fact that if the door, for example, installed places such as public offices or venues which are crowded, is automatically locked when closed, people cannot rapidly pass through the door.

When the user pushes the opening button 700*a* provided in the inner casing 120*a* to open the door 10*a* and go outside, the control unit 1000*a* receives a signal from the opening button and releases the locked state of the bolt moving unit 500*a* in the operating manner illustrated in FIG. 18. Subsequently, when the user pushes the door handle 420*a*, the door 10*a* opens in the operating manner illustrated in FIG. 19.

As described above, in a digital opening and closing device for an entrance according to the present invention, when pushing or pulling a door handle of a door after unlocking the door, a user can easily sense that the door is opening while feeling both a reduction in speed of movement of the pushed or pulled door handle when a roller begins to move along an inclined surface of a guide block and the rolling motion of the roller. Furthermore, the operation of opening the door can be smoothly conducted. The safety in opening or closing the door and convenience in use can be markedly enhanced.

In addition, the opening and closing device is operated in a pushing or pulling fashion rather than in a rotating fashion. Therefore, even children, the elderly and disabled persons or a user who uses both hands to hold objects can easily open the door. Thus, convenience in use and practicality can be improved. For places such as public offices or venues which are crowded, an accident can be prevented because it is easy to open the door. Particularly, in case of fire, if a handle of the door melts in a fire, it may be impossible to rotate the door handle. However, in the present invention, because the opening and closing device can be easily operated in a pushing fashion, the risk of an accident can be markedly reduced.

Furthermore, when the door is closed, it can be automatically locked, enhancing both security and safety.

Moreover, for doors used in crowded places such as public offices or venues, the opening and closing device is controlled such that when the door is closed, it is prevented from being automatically locked, thereby enabling people to rapidly pass through the door. Therefore, the applicability of the opening and closing device can be enhanced.

In case of fire, a door opening and closing unit is automatically unlocked so that people can rapidly evacuate and an accident can be prevented.

Third Embodiment

Figure 24:
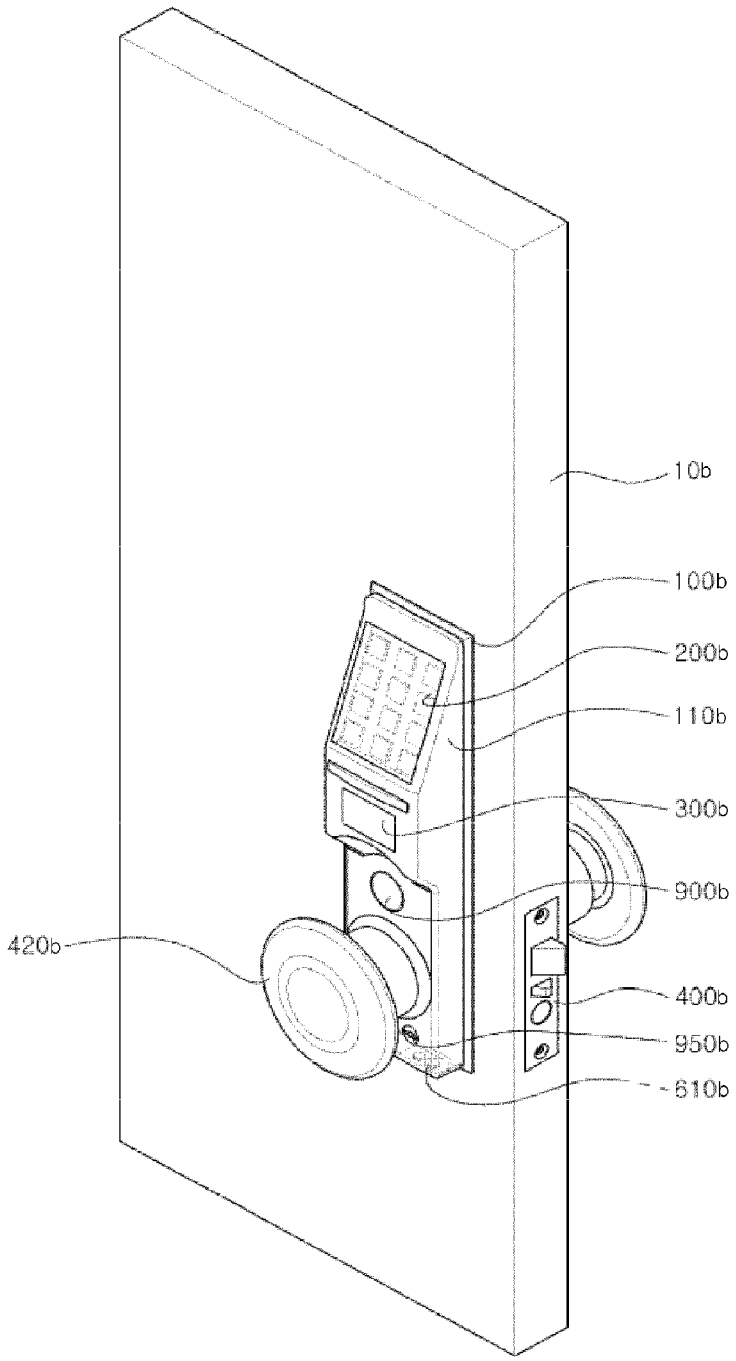
FIG. 24 is a perspective view illustrating an outdoor appearance of a digital opening and closing device for an entrance according to the present invention.
Figure 25:
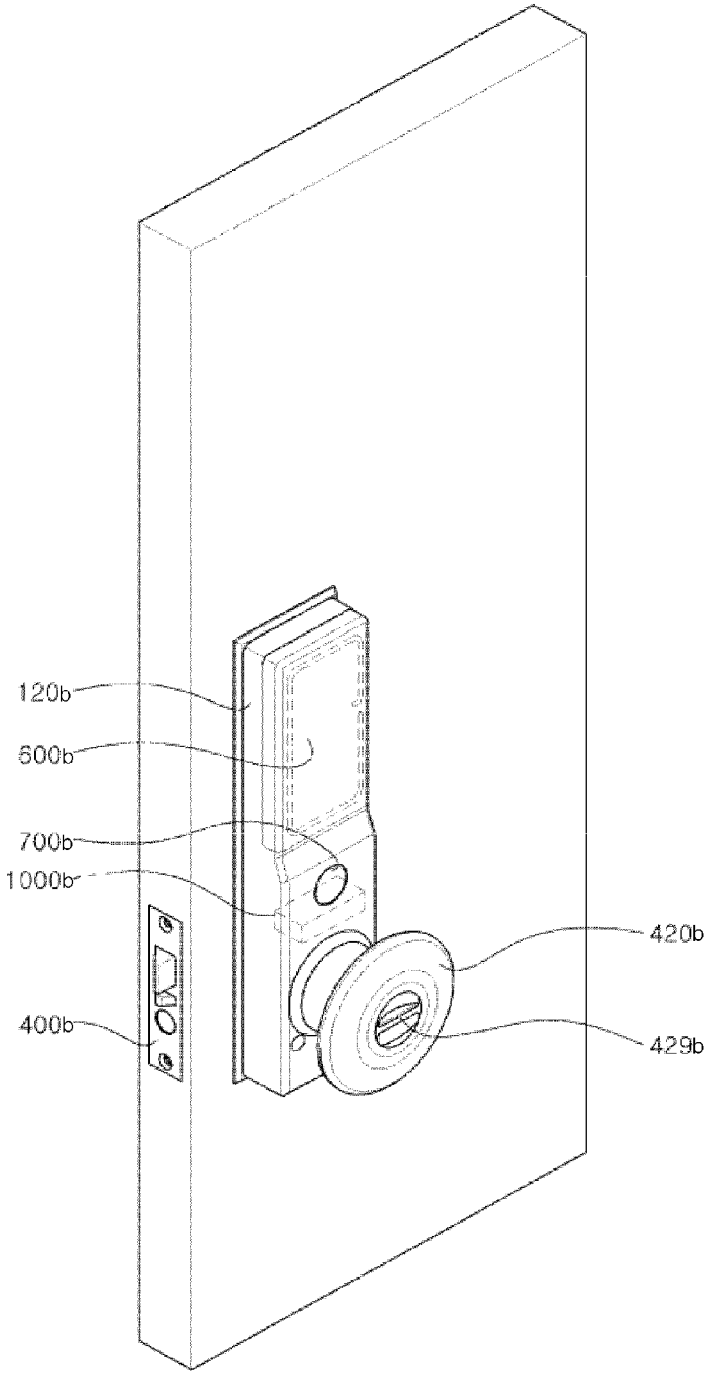
FIG. 25 is a perspective view illustrating an indoor appearance of the opening and closing device according to the present invention.
Figure 26:
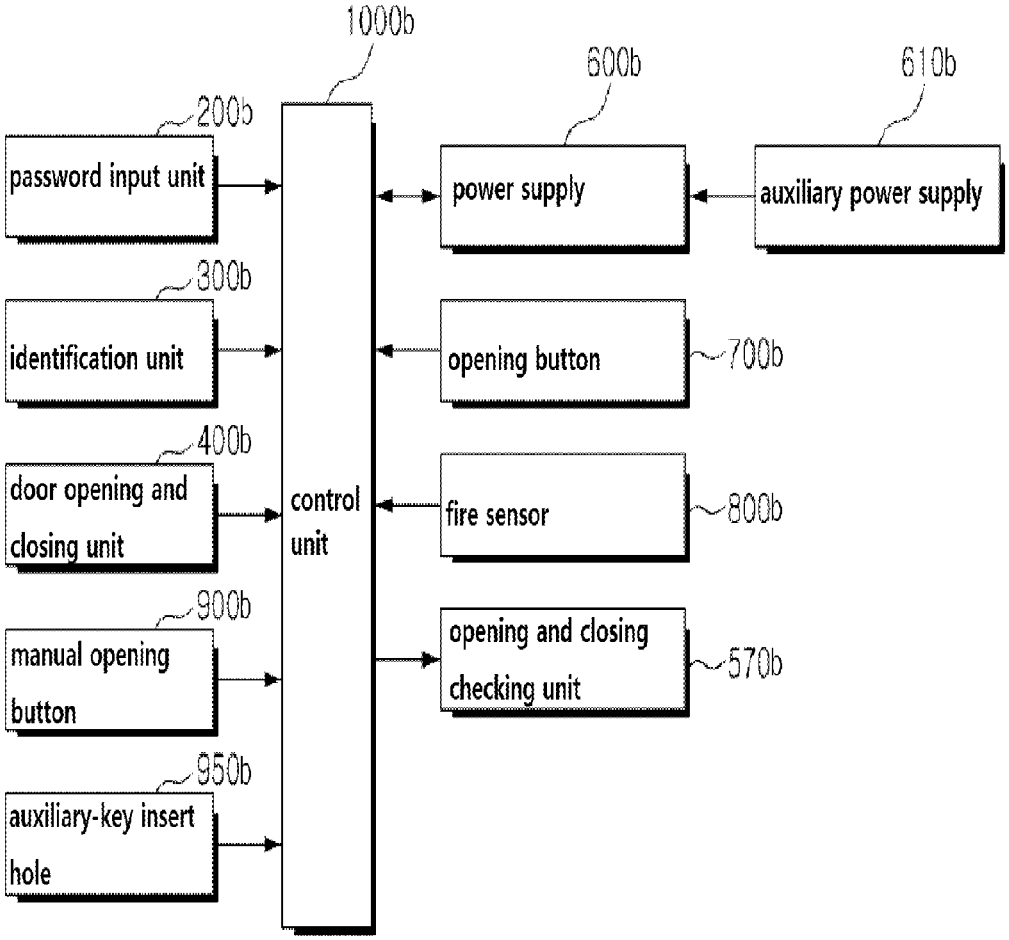
FIG. 26 is a block diagram showing the construction of the opening and closing device according to the present invention.

FIG. 24 is a perspective view illustrating an outdoor appearance of a digital opening and closing device for an entrance according to the present invention. FIG. 25 is a perspective view illustrating an indoor appearance of the opening and closing device according to the present invention. FIG. 26 is a block diagram showing the construction of the opening and closing device according to the present invention.

As shown in FIGS. 24 through 26, the digital entrance opening and closing device according to the present invention includes a housing 100*b*, a password input unit 200*b*, an identification unit 300*b*, a door opening and closing unit 400*b*, a power supply 600*b*, an opening button 700*b*, a fire sensor 800*b*, a manual opening button 900*b*, an auxiliary-key insert hole 950*b* and a control unit 1000*b*.

The housing 100*b* includes an outer casing 110*b* and an inner casing 120*b* which are respectively disposed at outdoor and indoor sides with a door 10*b* interposed therebetween and are coupled to each other.

The password input unit 200*b* is installed on a front surface of the outer casing 110*b* of the housing 100*b* and includes a keypad which has a combination of numeral buttons and special key buttons for use in inputting a password. The password input unit 200*b* may take the form of a touch panel. Furthermore, the password input unit 200*b* is connected to the control unit 1000*b* and transmits an input password to the control unit 1000*b*.

The identification unit 300*b* includes an identification means for indentifying a visitor. The term "identification means" refers to a device, such as a door phone camera including a CMOS or CCD, a card reader which can recognize a card, a fingerprint reader, an iris reader, etc., which can identify the visitor. In addition, the identification means may include another kind of device which can identify the visitor using voice recognition or by other means. The identification unit 300*b* is connected to the control unit 1000*b* and transmits recognized information to the control unit 1000*b*.

The door opening and closing unit 400*b* is installed within the door 10*b* between the outer casing 110*b* and the inner casing 120*b* of the housing. The door opening and closing unit 400*b* receives a control signal from the control unit 1000*b* and opens or closes the door 10*b*. The construction and operation of the door opening and closing unit 400*b* will be explained in detail later herein.

The power supply 600*b*, using AC power or a battery, supplies drive power to the elements of the opening and closing device. The power supply 600*b* further includes an auxiliary power supply 610*b* which has an emergency battery. In case of emergency, for example, when a blackout occurs or AC power is interrupted, or when the lifetime of the main battery has expired, the auxiliary power supply 610*b* including the emergency battery supplies emergency power to the opening and closing device. The battery is electrically connected to the housing 100*b*. Therefore, when a large electrical shock is applied to the housing 100*b*, the applied electricity is charges the battery, and the strength of shock applied to the housing 100*b* can thus be reduced. In addition, the opening and closing device can be protected from being damaged by the electrical shock.

The opening button 700*b* is installed in the inner casing 120*b* of the housing and connected to the control unit 1000*b*. When a user pushes the opening button 700*b* to exit via the door, an opening signal is applied to the control unit 1000*b*.

The fire sensor 800*b* is installed in the inner casing 120*b* of the housing so as to sense the indoor temperature and connected to the control unit 1000*b*. If the fire sensor 800*b* senses a temperature higher than a preset reference temperature, the fire sensor 800*b* transmits an abnormality signal to the control unit 1000*b*.

The manual opening button 900*b* is installed in the outer casing of the housing and connected to the control unit 1000*b*. For doors used in places such as public offices or venues which are crowded, the manual opening button 900*b* applies a signal to the control unit 1000*b* to prevent the door from being automatically locked when the door is closed.

The auxiliary-key insert hole 950*b* is formed in the outer casing 120*b* of the housing. An auxiliary key for use in unlocking the door is inserted into the auxiliary-key insert hole 950*b*. When the auxiliary key is inserted into the auxiliary-key insert hole 950*b*, a unlocking signal of the door opening and closing unit 400*b* is applied to the control unit 1000*b*.

The control unit 1000*b* is electrically connected to the password input unit 200*b*, the identification unit 300*b*, the door opening and closing unit 400*b*, the power supply 600*b*, the opening button 700*b*, the fire sensor 800*b*, the manual opening button 900*b* and the auxiliary-key insert hole 950*b*. The control unit 1000*b* functions to control the elements. Receiving a password input to the password input unit 200*b* or information input to the identification unit 300*b*, the control unit 1000*b* compares it with preset reference password or information. If the input password or information matches the preset reference password or information, the control unit 1000*b* creates a control signal to unlock the door opening and closing unit 400*b*. Furthermore, when receiving an abnormality signal from the fire sensor 800*b*, the control unit 1000*b* creates a control signal to unlock the door opening and closing unit 400*b*. When receiving an opening signal from the opening button 700*b*, the control unit 1000*b* also creates a control signal to unlock the door opening and closing unit 400*b*. If receiving a signal from the manual opening button 900*b*, the control unit 1000*b* controls the locking operation of the door opening and closing unit 400*b* such that when the door is closed, an automatic locking operation of the door opening and closing unit 400*b* is not conducted. In addition, when the key is inserted into the auxiliary-key insert hole 950*b* and a key insert signal is applied, the control unit 1000*b* creates a control signal to unlock the door opening and closing unit 400*b*.

Figure 27:
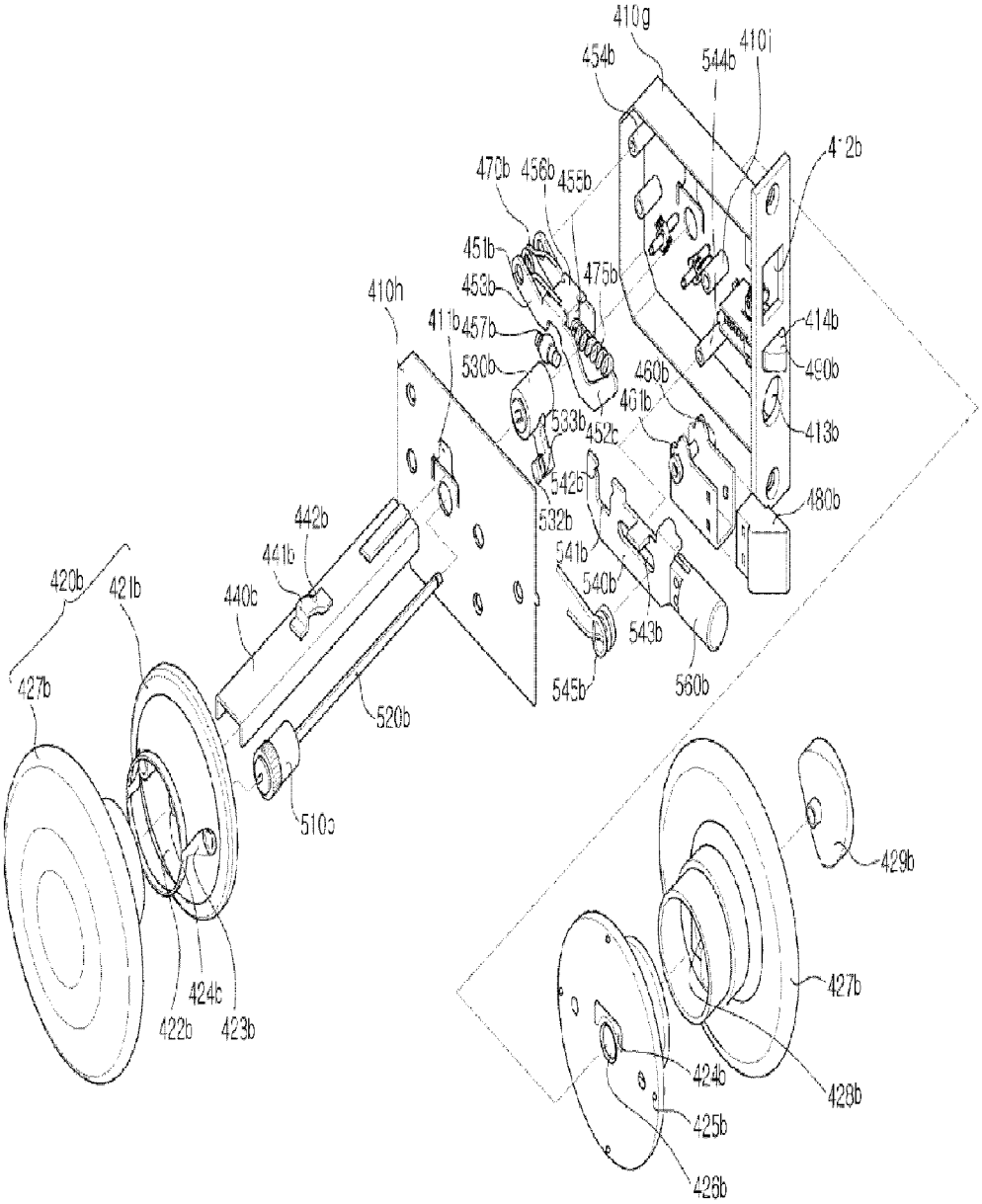
FIG. 27 is an exploded perspective view illustrating the door opening and closing unit of the opening and closing device according to the present invention.
Figure 28:
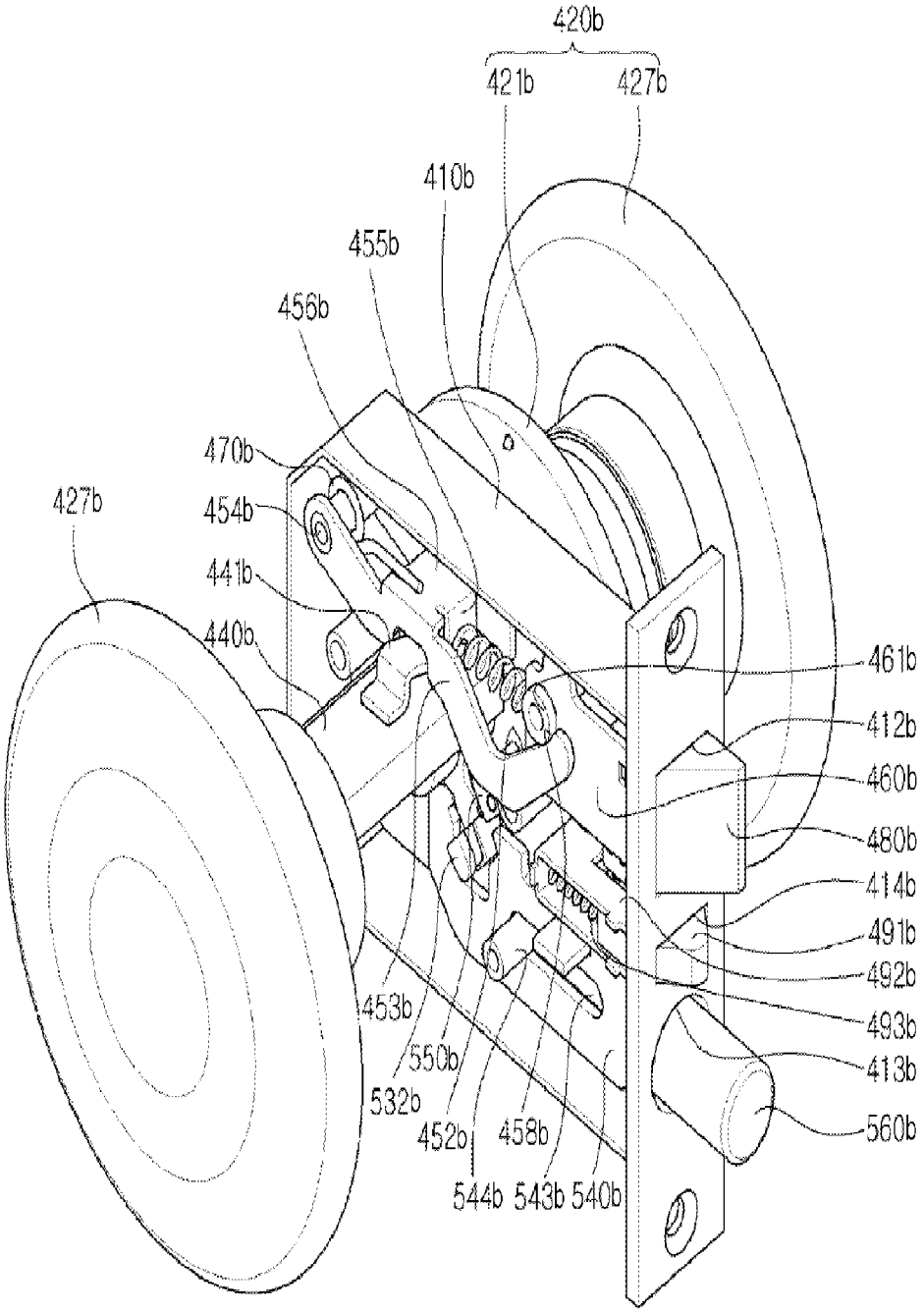
FIG. 28 is a perspective view showing the assembled door opening and closing unit of FIG. 27.
Figure 29:
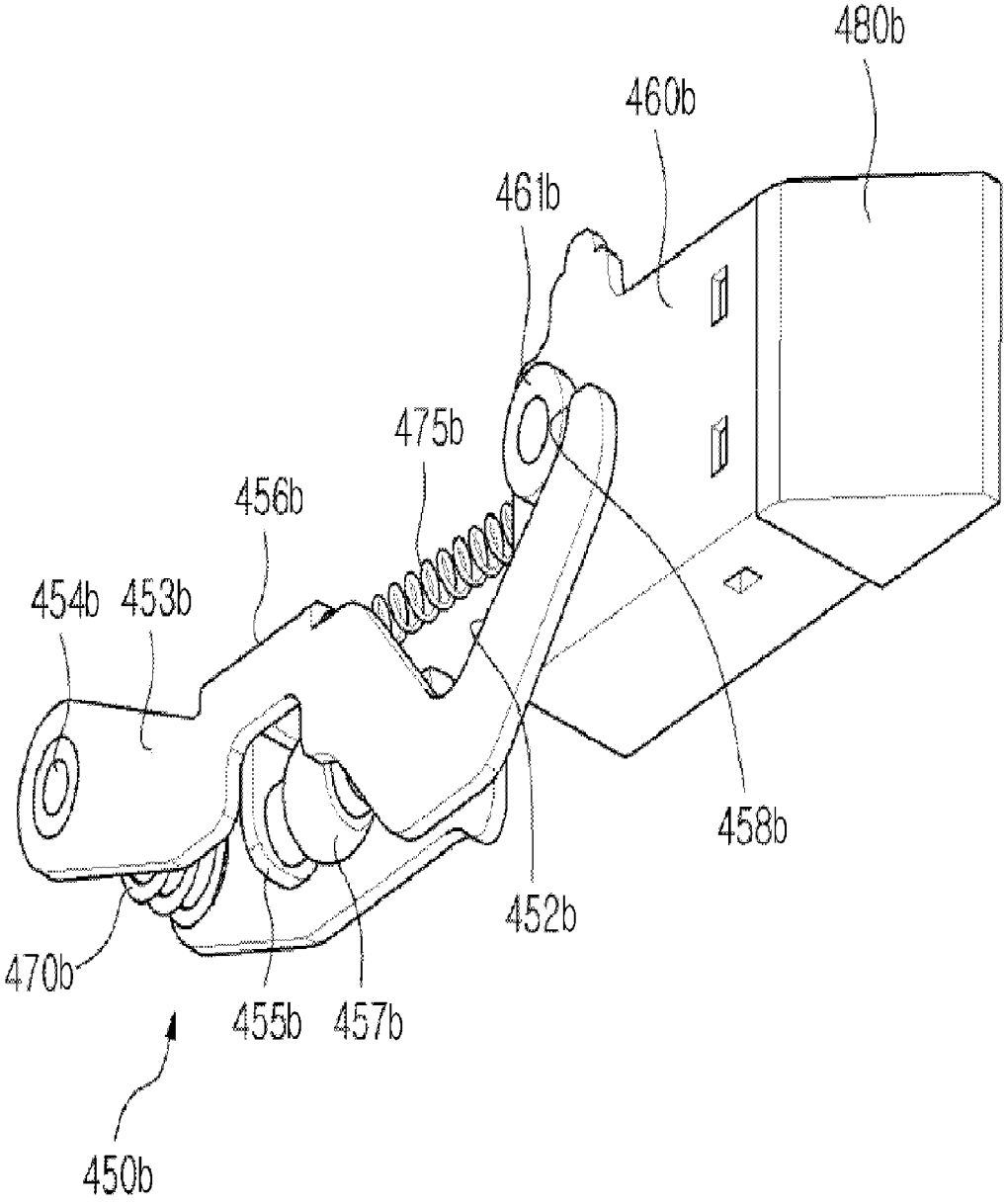
FIG. 29 is an enlarged view illustrating a rotating unit and a latch bolt coupling unit of the door opening and closing unit of FIG. 28.

FIG. 27 is an exploded perspective view illustrating the door opening and closing unit of the opening and closing device according to the present invention. FIG. 28 is a perspective view showing the assembled door opening and closing unit of FIG. 27. FIG. 29 is an enlarged view illustrating a rotating unit and a latch bolt coupling unit of the door opening and closing unit of FIG. 28.

As shown in FIGS. 27 through 29, the door opening and closing unit 400*b* includes a body unit 401*b*, door handles 420*b*, a latch bolt moving unit 430*b*, an opening-and-closing sensing unit 490*b* and a dead bolt moving unit 500*b*. The body unit 410*b* has, in a side surface thereof, a first opening 412*b* in which a latch bolt is retractably disposed, a second opening 413*b* in which a dead bolt is retractably disposed, and a third opening 414*b* in which a sensing bolt is disposed. The door handles 420*b* are respectively provided below the inner and outer casing 120*b* and 110*b* and configured so as to be pushed and pulled. The latch bolt moving unit 430*b* is coupled to the door handles 420*b* and configured such that when either door handle 420*b* is pushed or pulled, the latch bolt is retracted into the door 10*b* to allow the door 10*b* to open, and when the door handle 420*b* that has been pushed or pulled is released, the latch bolt is ejected from the door 10*b* to maintain the door 10*b* in a closed state. The opening-and-closing sensing unit 490*b* senses the operation of opening or closing the door 10*b* and transmits it to the control unit 1000*b*. The dead bolt moving unit 500*b* locks or unlocks the door 10*b* depending on a control signal of the control unit 1000*b*.

The body unit 410*b* includes a main body 410*g* which is open on a surface thereof and receives a rotating unit 450*b* and a latch bolt coupling unit 460*b* therein, and a cover 410*h* which covers the open surface of the main body 410*g*. The main body 410*g* and the cover 410*h* are coupled to each other by a plurality of fasteners 410*i*. The body unit 410*b* has a movable-member passing hole 411*b* which is formed in central portions of the cover 410*h* and the main body 410*g*. The main body 410*g* has, in a side surface thereof, the first opening 412*b* in which the latch bolt 480*b* is retractably disposed, the second opening 413*b* in which the dead bolt 560*b* is retractably disposed, and the third opening 414*b* which is formed between the first and second openings 412*b* and 413*b* and in which the sensing bolt is retractably disposed. The body unit 410*b* is installed in the door 10*b* in such a way that the first, second and third openings 412*b*, 413*b* and 414*b* are exposed to the outside from the side surface of the door 10*b*.

Each door handle 420*b* includes a mounting bracket 421*b* which are coupled to a corresponding one of the outer and inner casings 110*b* and 120*b*, and a grip part 427*b* which is inserted into the mounting bracket 421*b* and configured to be pushed and pulled.

The mounting bracket 421*b* has a receiving space 422*b* in which a first end of the grip part 427*b* is disposed so as to be movable forwards or backwards. Guide holes 423*b* bare formed in the mounting bracket 412*b* on opposite sides of the receiving space 422*b*. Communicating with the receiving space 422*b*, a hole 424*b* is formed in a central portion of a surface of the mounting bracket 421*b* that makes contact with the door 10*b*. The hole 424*b* has the same shape as that of a movable member 431*b* so that the movable member 431*b* is inserted into the hole 424*b*. A plurality of fixing protrusions 425*b*, each of which has a pointed shape, are provided around the hole 424*b* on the mounting bracket 421*b* and pegged into the corresponding surface of the door 10*b*. Pegged into the surface of the door 10*b* that makes contact with the mounting bracket 421*b*, the fixing protrusions 425*b* function to fix the mounting bracket 421*b* in place.

A protrusion is provided on a central portion of a first surface of each grip part 427*b* and disposed in the receiving space 422*b* of the corresponding mounting bracket 421*b* so as to be movable forwards or backwards. An insert depression 428*b* having the same shape as that of the hole 424*b* of the mounting bracket 421*b* is formed in the grip part 427*b*.

The latch bolt moving unit 430*b* includes the movable member 440*b*, a rotating unit 450*b*, the latch bolt coupling unit 460*b* and a restoring spring 470*b*.

The movable member 440*b* has a reverse U-shaped cross-section. A lift guide block 441*b* is provided on a medial portion of the movable member 440*b* so that a roller 456*b* is moved upwards under guidance of the lift guide block 441*b*. The lift guide block 441*b* has on a first end thereof an inclined surface 442*b* which is gently curved upwards from the first end to a second of the lift guide block 441*b* so that the roller 456*b* can smoothly roll and move upwards along the inclined surface 442*b*. Opposite ends of the movable member 440*b* that is disposed in the movable-member passing hole 411*b* of the body unit are respectively fitted into the insert holes 428*b* of the grip parts of the door handles 420*b* through the holes 424*b* of the mounting brackets 421*b* of the door handles 420*b*. The movable member 440*b* is moved by the operation of pushing or pulling the door handle 420*b*.

The rotating unit 450*b* includes a pair of links 453*b*, a hinge shaft 454*b*, a connection part 456*b* and a roller 457*b*. At least one of the links 453*b* has a hinge coupling hole 451*b* in a first end thereof and includes in a second end thereof a bent part 452*b* which is bent at a predetermined position to have a downward inclined surface extending from a first end of the bent part 452*b* to the predetermined position and an upward inclined surface extending from the predetermined position to a second end of the bent part 452*b*. The hinge shaft 454*b* is coupled to the hinge coupling hole 451*b* with the links 453*b* spaced apart from each other by a predetermined distance. The connection part 456*b* connects medial portions of the spaced links 453*b* to each other and has on opposite ends thereof coupling surfaces 455*b* which are bent downwards. The roller 457*b* is coupled to the coupling surfaces 455*b* of the connection part 456*b* by a hinge.

The rotating unit 450*b* having the above-mentioned construction is disposed in the body unit 410*b* across the upper surface of the movable member 440*b* in such a way that the roller 456*b* can make contact with the inclined surface 442*b* of the lift guide block 441*b*.

Therefore, when the movable member 440*b* horizontally moves in a predetermined direction, the lift guide block 441*b* pushes the roller 457*b* upwards. While pushed by the lift guide block 441*b*, the roller 457*b* rolls around the hinge and moves upwards along the inclined surface 442*b* of the lift guide block 441*b*. The links 453*b* are rotated around the hinge shaft 454*b* by the upward movement of the roller 457*b*.

The latch bolt coupling unit 460*b* is disposed in the body unit 410*b* between the rotating unit 450*b* and the first opening 412*b* of the body unit. A first end of the latch bolt coupling unit 460*b* is connected to the rotating unit 450*b*, and a second end thereof is coupled to the latch bolt 480*b* disposed in the first opening 412*b*.

A roller pin 461*b* is coupled to an outer surface of the first end of the latch bolt coupling unit 460*b* and disposed on the bent part 452*b* of the corresponding link 453*b*. Furthermore, the roller pin 461*b* is configured such that it can move along the inclined surface of the bent part 452*b*. A removal prevention stop 458*b* is formed on the end of the bent part 452*b* so as to prevent the roller pin 461*b* from being removed from the bent part 452*b*.

When the roller 457*b* of the rotating unit is placed on the upper surface of the movable member 440*b*, the roller pin 461*b* is disposed on the end of the bent part 452*b*. As the roller 457*b* moves upwards along the lift guide block 441*b* of the movable member 440*b* and the link 453*b* thus rotates around the hinge shaft 454*b*, the bent part 452*b* of the link 453*b* is moved upwards, and the roller pin 461*b* is thus moved along the inclined surface to the medial portion of the bent part 452*b*. At this time, the movement of the latch bolt coupling unit 460*b* causes the latch bolt 480*b* coupled to the latch bolt coupling unit 460*b* to be retracted into the door 10*b*.

The restoring spring 470*b* is wrapped around the hinge shaft 454*b* of the rotating unit 450*b*

A first end of the restoring spring 470*b* wrapped around the hinge shaft 454*b* is fixed to the inner surface of the body unit 410*b*, and a second end thereof is fixed to the connection part 456*b* of the links 453*b*. Therefore, the restoring spring 470*b* is compressed by rotation of the links 453*b*, and when the external force that has rotated the links 453*b* is removed, the restoring spring 470*b* returns to its original state so that the links 453*b* can be return to their pre-rotated state. In addition, an elastic spring 475*b* is installed between the connection part 456*b* and the latch bolt coupling unit 460*b*. When the roller pin 461*b* of the latch bolt coupling unit 460*b* is moved to the medial portion of the bent part 452*b* by rotation of the links, the elastic spring 475*b* is compressed. When the links 453*b* move downwards and return to their original positions, the elastic spring 475*b* that has been compressed returns to its original state and thus pushes the latch bolt coupling unit 460*b* to its original position. At this time, the movement of the latch bolt coupling unit 460*b* causes the latch bolt 480*b* coupled to the latch bolt coupling unit 460*b* to be ejected outwards from the door 10*b*.

The opening-and-closing sensing unit 490*b* is provided between the latch bolt moving unit 430*b* and the dead bolt moving unit 500*b* and includes a sensing bolt 491*b* which is disposed in the third opening 414*b* of the body unit, a receiving space 492*b* which receives the sensing bolt 491*b*, a spring 493*b* which is provided in the receiving space 492*b* and elastically supports the sensing bolt 491*b*, and a sensor 494*b* which senses movement of the sensing bolt 491*b* and determines whether the door 10*b* is in the closed state or not.

In the opening-and-closing sensing unit 490*b*, when the door 10*b* is closed, the sensing bolt 491*b* that has been ejected outwards from the door 10*b* is pushed into the door 10*b* by the side frame of the entrance. When the door 10*b* opens, the sensing bolt 491*b* is ejected outwards from the door 10*b*. The sensor 494*b* senses the ejection and retraction of the sensing bolt 491*b*, determines whether the door 10*b* is in the closed state or not, and then transmits a sensing signal to the control unit 1000*b*. When receiving a door-close signal from the opening-and-closing sensing unit 490*b*, the control unit 1000*b* controls the operation of the dead bolt moving unit 500*b* to lock the door 10*b* that has been closed.

The dead bolt moving unit 500*b* includes a motor 510*b* which is operated in response to a signal of the control unit 1000*b*; an actuating shaft 520*b* which is rotated to the left or right by the operation of the motor 510*b*; a rotating lever 530*b* which is coupled to the actuating shaft 520*b*, is disposed in the body unit 410*b*, and is rotated to the left or right by the rotation of the actuating shaft 520*b*; an opening and closing member 540*b* which is coupled to the dead bolt 560*b* disposed in the second opening 413*b* of the body unit and is moved to the left or right in conjunction with the rotation of the rotating lever 530*b*; and a sensor 550*b* which senses the operation of the rotating lever 530*b* and thus determines whether the dead bolt 560*b* is in a closed state or an open state.

For this, a though hole 415*b*, in which the actuating shaft 520*b* is disposed, is formed in the body unit 410*b*. A passing hole 426*b*, in which the actuating shaft 520*b* is disposed, is formed in a mounting bracket 421*b* of the door handle 420*b* that is installed on the inner casing 120*b* of the housing. A locking unit 429*b* is installed in the grip part 427*b* at a position corresponding to the passing hole 426*b* of the mounting bracket 421*b*. A first end of the actuating shaft 520*b* is connected to the motor 510*b*, and a second end of the actuating shaft 520*b* is connected to the locking unit 429*b* installed in a central portion of the door handle 420*b* that is disposed at an indoor side. The locking unit 429*b* that is installed in the door handle 420*b* disposed at the indoor side is used to manually unlock the door 10*b* in case of emergency.

The rotating lever 530*b* includes a cylindrical body which has in a central portion thereof a rectangular hole 531*b* into which the actuating shaft 520*b* is inserted, and a protruding piece 532*b* which protrudes outwards from an outer surface of the cylindrical body. A guide groove 533*b* is formed in an outer surface of the protruding piece 532*b*. Because the actuating shaft 520*b* and the hole 531*b* of the rotating lever 530*b* are rectangular, the rotating lever 530*b* can be rotated along with the actuating shaft 520*b*.

The opening and closing member 540*b* is disposed below the rotating lever 530*b*. A locking depression 541*b* to which the protruding piece 532*b* of the rotating lever 530*b* is locked is formed at a predetermined position in an upper edge of the opening and closing member 540*b*. Locking notches 542*b* are respectively formed in opposite side edges of the locking depression 541*b* so that, when rotated to the maximum, the protruding piece 532*b* is locked to the corresponding locking notch 542*b*. Extending a predetermined length in the longitudinal direction of the opening and closing member 540*b*, a guide slot 543*b* is formed in a central portion of the opening and closing member 540*b*. Protruding from the inner surface of the body unit 410*b*, a support pin 544*b* is disposed in the guide slot 543*b*. A tension spring 545*b* which elastically supports the protruding piece 532*b* of the rotating lever 530*b* is wrapped around the support pin 544*b*. Wrapped around the support pin 544*b*, the tension spring 545*b* is fixed at a first end thereof to the bottom surface of the body unit 410*b* and fixed at a second end thereof to the sidewall of the body unit 410*b* via a lower surface of the guide groove 533*b* of the rotating lever 530*b*. An end of the opening and closing member 540*b* is coupled to the dead bolt 560*b* disposed in the second opening 413*b*.

The sensor 550*b* comprises two sensors which are respectively provided on opposite sides of the rotating lever 530*b*. In detail, each sensor 550*b* is disposed at a position at which the protruding piece 532*b* of the rotating lever comes into contact with the sensor 550*b* when the protruding piece 532*b* is rotated to the maximum and locked to the corresponding locking notch 542*b* of the locking depression 541*b*.

Hereinafter, the operation of the digital opening and closing device having the above-mentioned construction will be described in detail.

Figure 30:
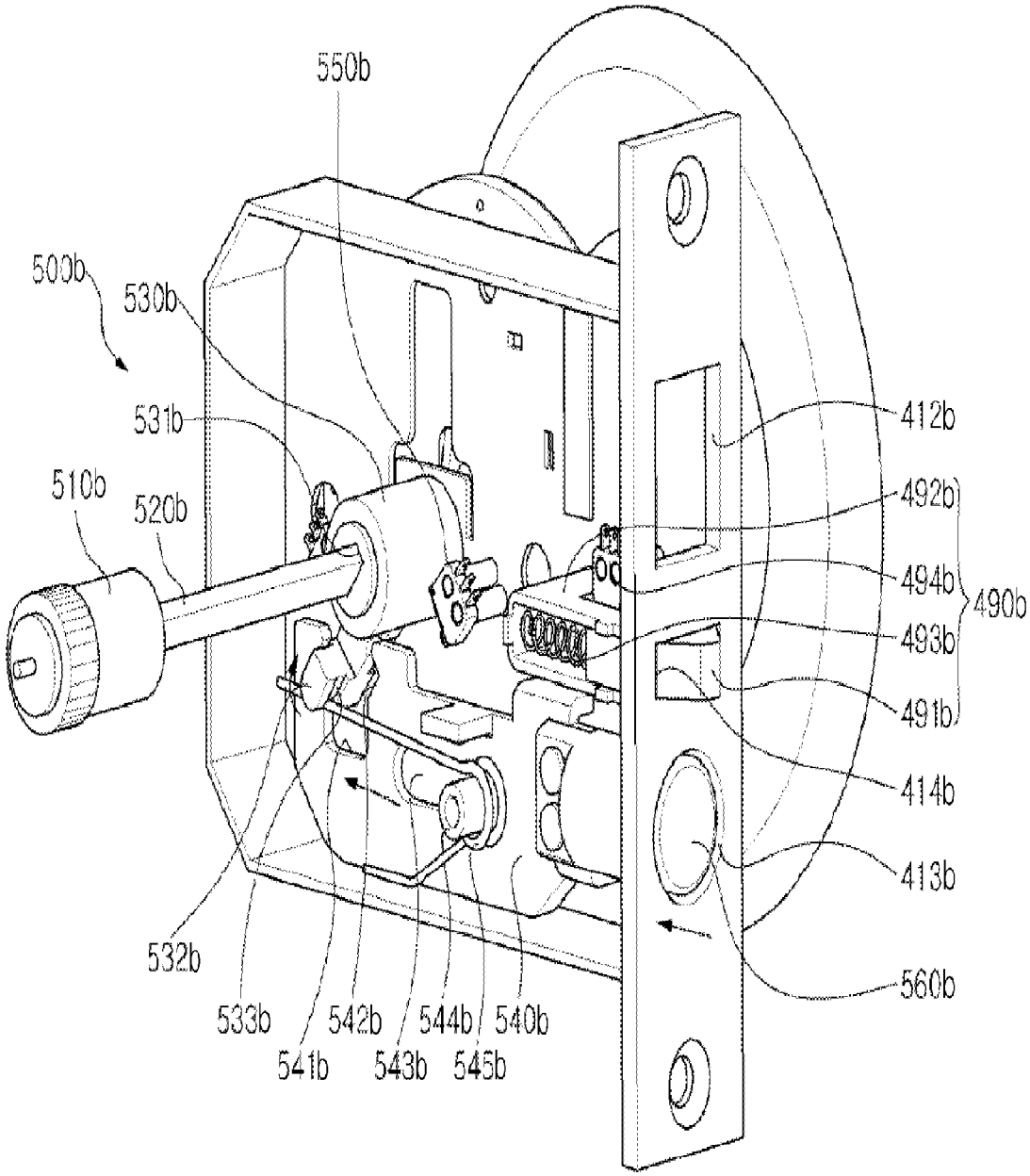
FIG. 30 is a view showing the operation of the dead bolt moving unit of the opening and closing device when the door opens according to the present invention.
Figure 31:
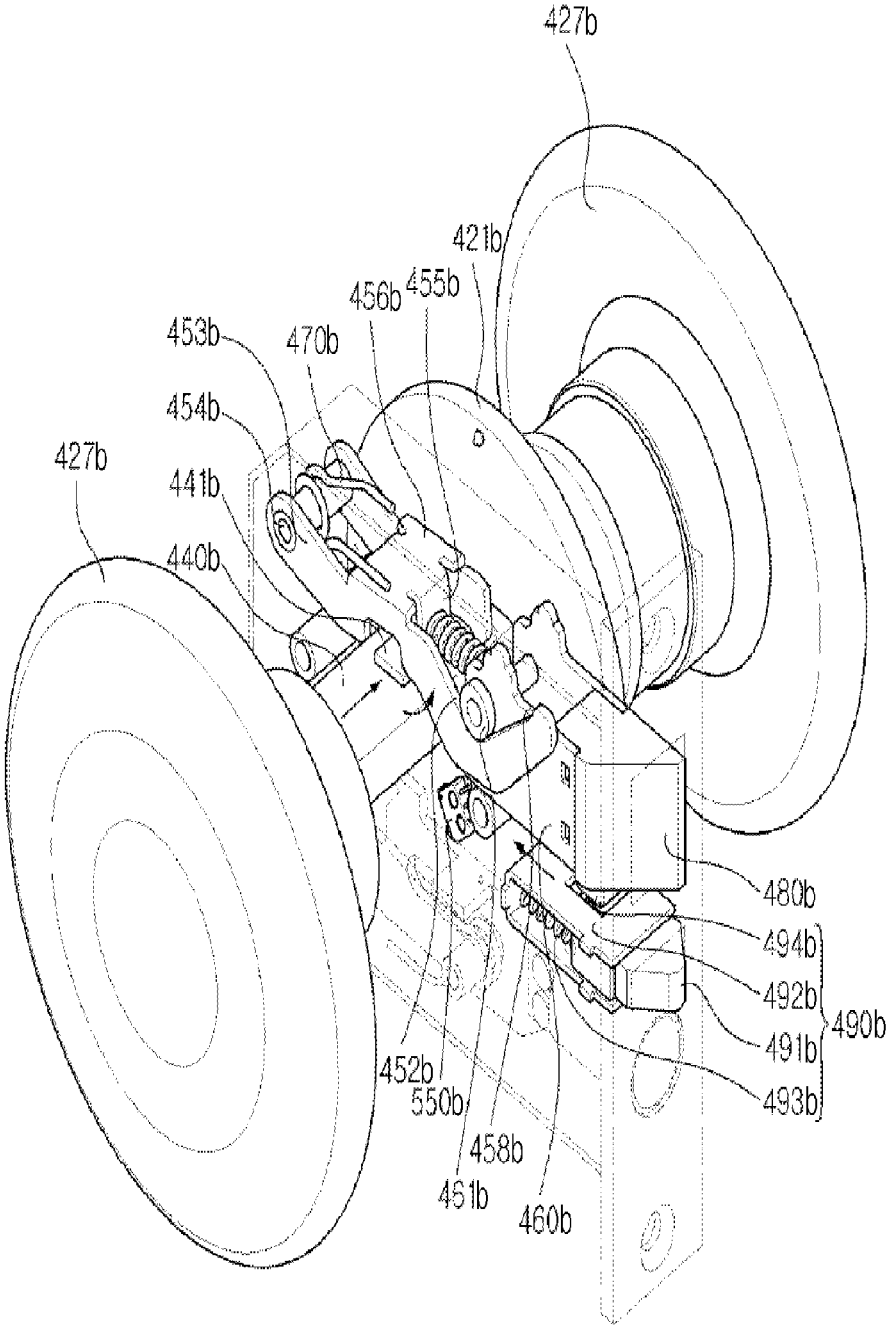
FIG. 31 is a view showing the operation of the latch bolt moving unit and the opening-and-closing sensing unit of the opening and closing device when the door opens according to the present invention.
Figure 32:
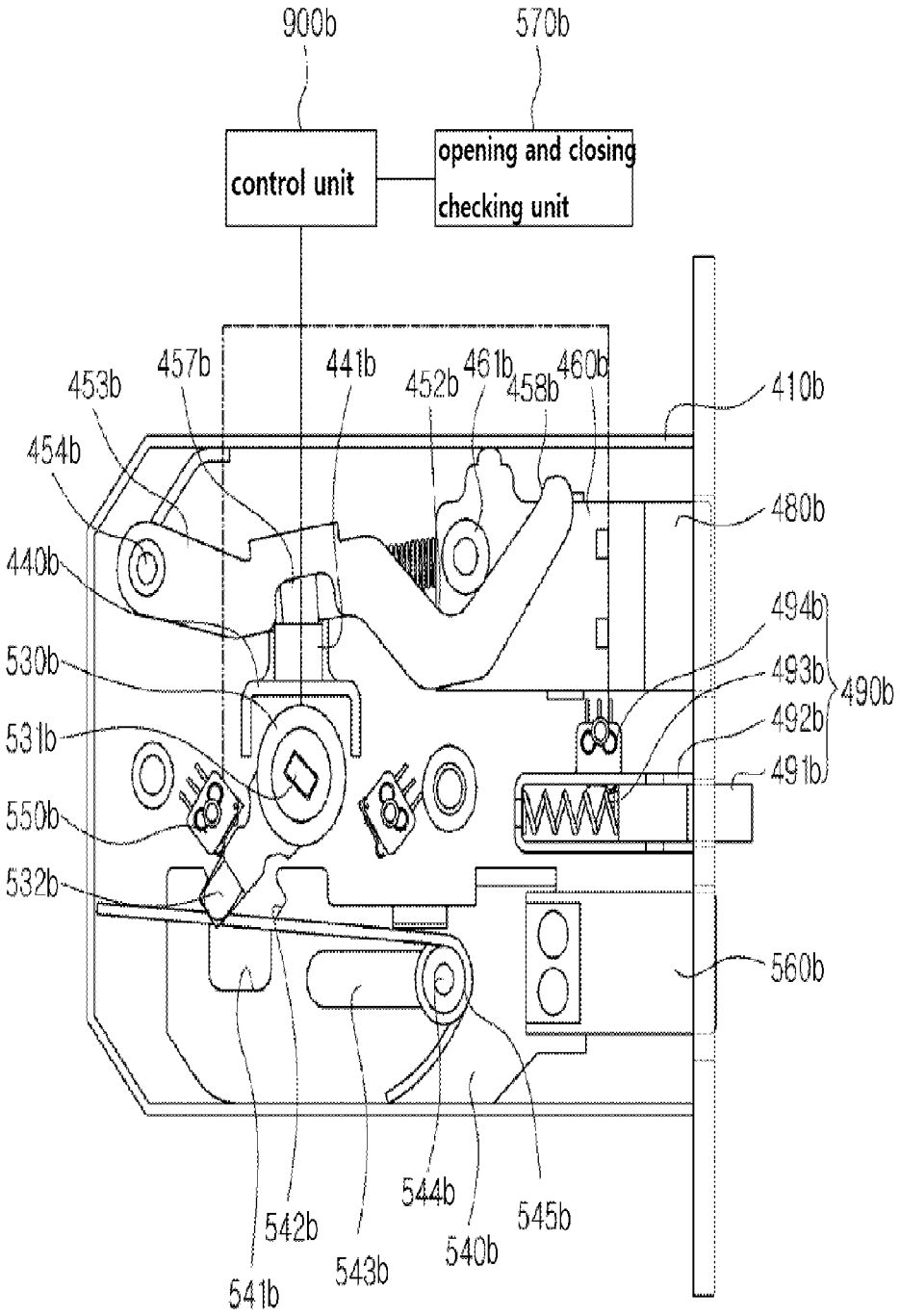
FIG. 32 is a front view of the door opening and closing unit of the opening and closing device to illustrate the opening-and-closing sensing unit and the sensor for sensing opening of the door according to the present invention.
Figure 33:
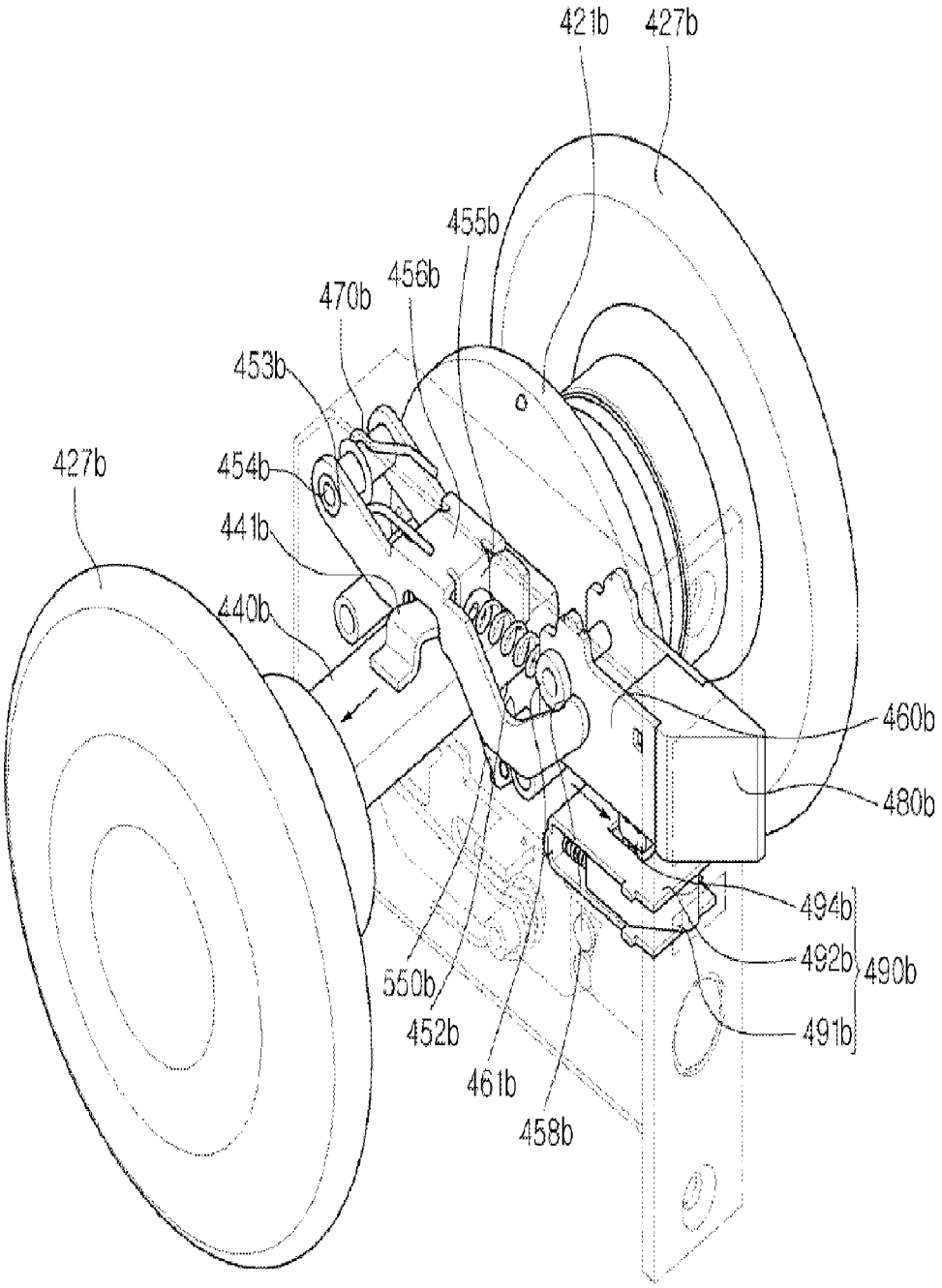
FIG. 33 is a view showing the operation of the latch bolt moving unit and the opening-and-closing sensing unit of the opening and closing device when the door is closed according to the present invention.
Figure 34:
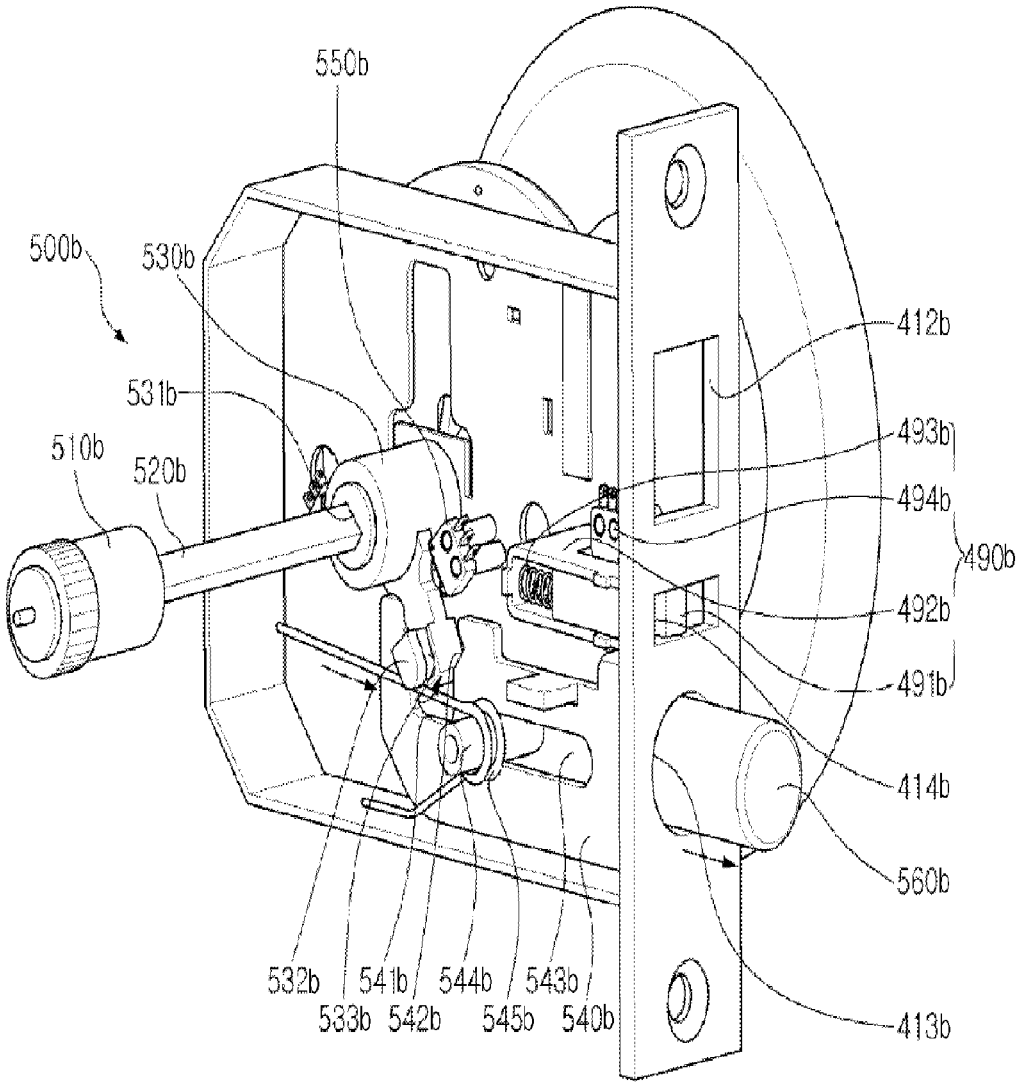
FIG. 34 is a view showing the operation of the dead bolt moving unit of the opening and closing device when the door is closed.
Figure 35:
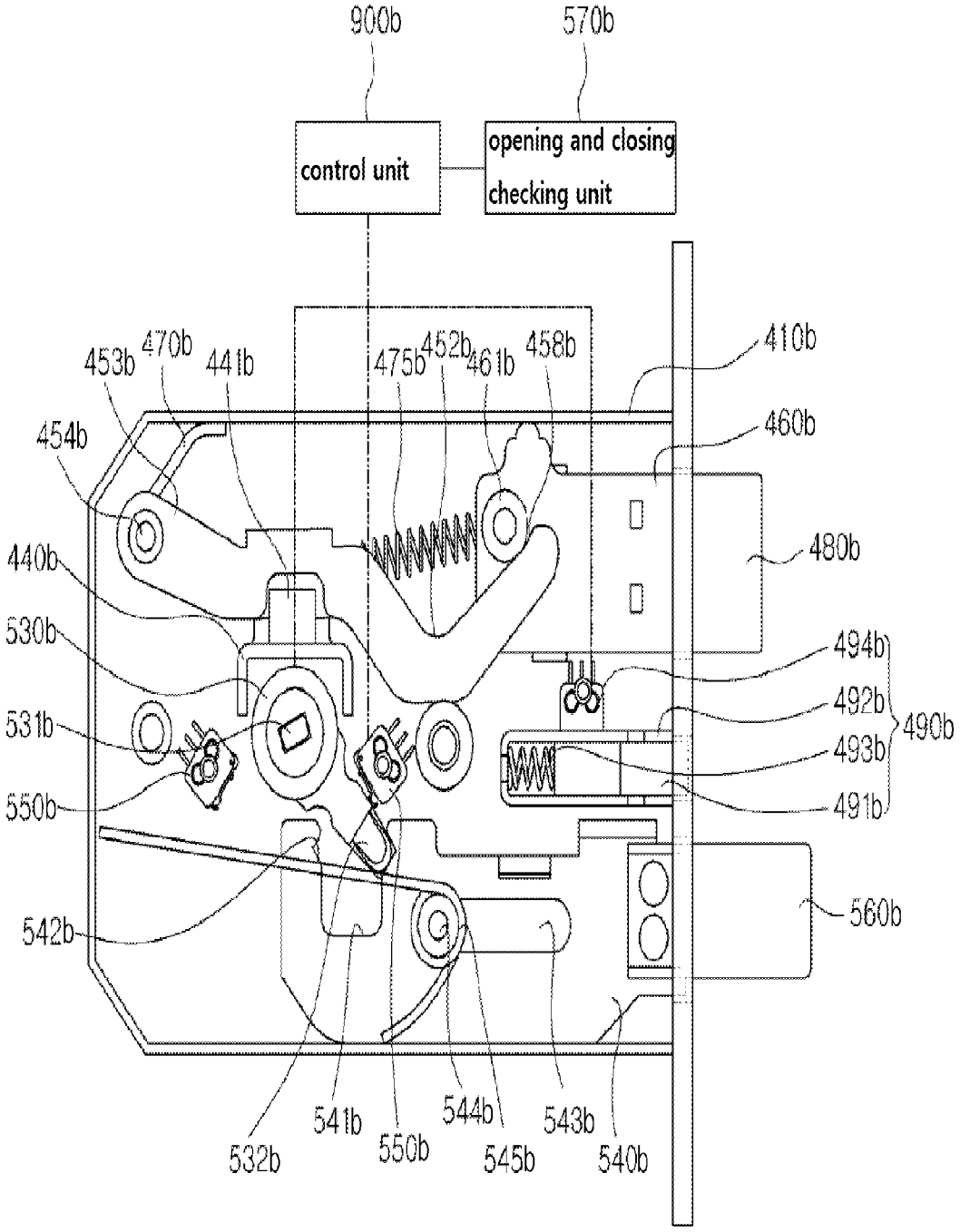
FIG. 35 is a front view of the door opening and closing unit of the opening and closing device to illustrate the opening-and-closing sensing unit and the sensor for sensing closing of the door according to the present invention.

FIG. 30 is a view showing the operation of the dead bolt moving unit of the opening and closing device when the door opens according to the present invention. FIG. 31 is a view showing the operation of the latch bolt moving unit and the opening-and-closing sensing unit of the opening and closing device when the door opens according to the present invention. FIG. 32 is a front view of the door opening and closing unit of the opening and closing device to illustrate the opening-and-closing sensing unit and the sensor for sensing opening of the door according to the present invention. FIG. 33 is a view showing the operation of the latch bolt moving unit and the opening-and-closing sensing unit of the opening and closing device when the door is closed according to the present invention. FIG. 34 is a view showing the operation of the dead bolt moving unit of the opening and closing device when the door is closed. FIG. 35 is a front view of the door opening and closing unit of the opening and closing device to illustrate the opening-and-closing sensing unit and the sensor for sensing closing of the door according to the present invention.

When a visitor inputs a password to the password input unit 200*b* or uses the identification unit 300*b*, the password input to the password input unit 200*b* or the identification information input to the identification unit 300*b* is transmitted to the control unit 1000*b*. The control unit 1000*b* compares the input password or identification information to the preset password or identification information and, when determining that they match each other, creates a control signal to open the door opening and closing unit 400*b*. As shown in FIG. 30, the door opening and closing unit 400*b* that has received the control signal from the control unit 1000*b* drives the motor 510*b* of the dead bolt moving unit 500*b* and rotates the actuating shaft 520*b* connected to the motor 510*b* in one direction. Then, the rotating lever 530*b* is rotated in the same direction by the rotation of the actuating shaft 520*b*. Simultaneously, the protruding piece 532*b*, which is provided on the end of the rotating lever 530*b* and disposed in the locking depression 541*b* of the opening and closing member 540*b*, is also rotated, thus moving the opening and closing member 540*b* in a direction corresponding to the direction of the rotation of the protruding piece 532*b*. Here, because the support pin 544*b* fixed to the body unit 410*b* is disposed in the guide slot 543*b* of the opening and closing member 540*b*, the opening and closing member 540*b* is linearly moved under the guidance of the support pin 544*b*. When the protruding piece 532*b* that has rotated is locked to the locking notch 542*b* formed in the first side edge of the locking depression 541*b*, the rotating lever 530*b* no longer rotates. Furthermore, in this state, the protruding piece 532*b* of the rotating lever 530*b* is supported by the elastic force of the tension spring 545*b*. The rotating lever 530*b* is therefore prevented from being reversely rotated, unless external force is applied thereto. Consequently, the opening and closing member 540*b* that has been moved to open can be maintained in place. The dead bolt 560*b* coupled to the opening and closing member 540*b* is retracted into the second opening 413*b* by the movement of the opening and closing member 540*b*, thus allowing opening of the door 10*b*. Simultaneously, as shown in FIG. 32, the protruding piece 532*b* that is locked to the locking notch 542*b* formed in the first side edge of the locking depression 541*b* makes contact with the corresponding sensor 550*b*. The sensor 550*b* senses that the protruding piece 532*b* has rotated to open the opening and closing member 540*b*, determines that the dead bolt 560*b* has been retracted, and then transmits a door-open signal to the control unit 1000*b*. Preferably, the control unit 1000*b* may output a voice, for example, "door unlocked", or an alarm, a warning sound, etc. using an opening and closing checking unit 570*b* connected to a speaker.

In this state, as shown in FIG. 31, when the user pushes or pulls the grip part 427*b* of the corresponding door handle 420*b* in the direction in which the door 10*b* opens, the movable member 440*b* is horizontally moved, and the lift guide block 441*b* provided on the upper surface of the movable member 440*b* is integrally moved along with the movable member 440*b*. At this time, the lift guide block 441*b* pushes the roller 456*b* that makes contact with the inclined surface 442*b*. Then, the roller 456*b* rotates on the hinge and rolls upwards along the inclined surface 442*b* of the lift guide block 441*b* from the bottom of the inclined surface 422*b* to the top thereof. As the roller 457*b* moves upwards, the links 453*b* rotate around the hinge shaft 454*b* so that the bent part 452*b* provided on the second end of the links 453*b* is moved upwards, whereby the inclination of the inclined surface of the bent part 452*b* is increased. Therefore, the roller pin 461*b* of the latch bolt coupling unit 460*b* moves along the inclined surface to the medial portion of the bent part 452*b*. As the latch bolt coupling unit 460*b* moves, the latch bolt 480*b* is retracted into the door 10*b*, thus allowing the door 10*b* to open. During the above process, the restoring spring 470*b* wrapped around the hinge shaft 454*b* is compressed by the rotation of the links 453*b*, and the elastic spring 475*b* installed in the latch bolt coupling unit 460*b* is also compressed by the movement of the latch bolt coupling unit 460*b*.

As stated above, when the user pushes the grip part 427*b* of the door handle 420*b* in the direction in which the door 10*b* opens, the movable member 440*b* is pushed by the pushing force of the grip part 427*b*. Here, until the lift guide block 441*b* of the movable member 440*b* begins to push the roller 456*b* upwards, the grip part 427*b* is easily pushed. While the lift guide block 441*b* pushes the roller 456*b* upwards and the roller 456*b* thus rolls upwards along the inclined surface 442*b* of the lift guide block 441*b*, the speed at which the grip part 427*b* is pushed and moved is reduced. Therefore, the user can feel in his or her hand a variation of the speed of the grip part 427*b*, that is, a reduction in speed at which the grip part 427*b* is pushed, due to the rolling motion of the roller. Thus, the user can sense that the door 10*b* is opening. In addition, by virtue of the rolling motion of the roller 456*b* that moves upwards along the inclined surface 442*b* of the lift guide block 441*b*, the user may not only sense that the door 10*b* is opening but also that the door 10*b* opens smoothly.

As shown in FIG. 32, when the door 10*b* opens, the sensing bolt 491*b* of the opening-and-closing sensing unit 490*b* is ejected outwards from the door 10*b*. The sensor 494*b* senses that the sensing bolt 491*b* has been ejected outwards and then transmits a door-open signal to the control unit 1000.

Meanwhile, as shown in FIG. 33*b*, when the door handle 420*b* that has been pushed or pulled is released in the open state of the door 10*b*, in other words, when the external force that has been applied to the grip part 427*b* is removed, the movable member 440*b* is returned to its original position, and the roller 457*b* that has been moved upwards by the movement of the movable member 440*b* is moved downwards along the lift guide block 441*b*. Simultaneously, the restoring spring 470*b* that has been compressed returns to its original state, thus returning the links 453*b* to their pre-rotated state. That is, the links 453*b* rotate around the hinge shaft 454*b* so that the bent part 452*b* provided on the second end of the links 453*b* are moved downwards, whereby the inclination of the inclined surface of the bent part 452*b* becomes reduced. Then, the roller pin 461*b* of the latch bolt coupling unit 460*b* is moved to the end of the bent part 452*b* along the inclined surface of the bent part 452*b* by the restoring force of the elastic spring 475*b* that has been compressed in the latch bolt coupling unit 460*b*. Furthermore, the latch bolt coupling unit 460*b* is moved so that the latch bolt 480*b* is ejected outwards from the door 10*b*, thus maintaining the door 10*b* in a closed state.

As shown in FIG. 35, when the door 10*b* enters the closed state, the sensing bolt 491*b* that has been ejected is retracted into the door 10*b* by the side frame of the entrance. The sensor 494*b* senses that the sensing bolt 491*b* has been retracted and thus transmits a door-close signal to the control unit 1000*b*. When receiving the door-close signal from the opening-and-closing sensing unit 490*b*, the control unit 1000*b* controls the operation of the dead bolt moving unit 500*b* to lock the closed door.

As shown in FIG. 34, when receiving a signal from the control unit 1000*b*, the dead bolt moving unit 500*b* operates the motor 510*b* in a reverse direction so that the actuating shaft 520*b* connected to the motor 510*b* is reversely rotated. Then, the rotating lever 530*b* is also reversely rotated by the reverse rotation of the actuating shaft 520*b*. Provided on the end of the rotating lever 530*b*, the protruding piece 532*b* that is in the locking depression 541*b* of the opening and closing member 540*b* reversely rotates and thus moves the opening and closing member 540*b* in a direction corresponding to the direction in which the protruding piece 532*b* rotates. During the above process, because the support pin 544*b* fixed to the body unit 410*b* is disposed in the guide slot 543*b* of the opening and closing member 540*b*, the opening and closing member 540*b* can also linearly move under the guidance of the support pin 544*b*. When the protruding piece 532*b* that has reversely rotated is locked to the locking notch 542*b* formed in the second side edge of the locking depression 541*b*, the protruding piece 532*b* no longer rotates. Furthermore, because the protruding piece 532*b* of the rotating lever 530*b* moves the opening and closing member 540*b* while overcoming the elastic force of the tension spring 545*b* that elastically supports the protruding piece 532*b*, the rotation of the rotating lever 530*b* and the movement of the opening and closing member 540*b* can be reliably and smoothly embodied. The dead bolt 560*b* coupled to the opening and closing member 540*b* is ejected outwards from the second opening 413*b* by the movement of the opening and closing member 540*b* and inserted into a locking recess (not shown) formed in the side frame of the entrance, thus locking the door 10*b*. Simultaneously, as shown in FIG. 35, the protruding piece 532*b* that is locked to the locking notch 542*b* formed in the second side edge of the locking depression 541*b* makes contact with the corresponding sensor 550*b*. The sensor 550*b* senses that the protruding piece 532*b* has reversely rotated to close the opening and closing member 540*b*, determines that the dead bolt 560*b* has been ejected, and then transmits a door-lock signal to the control unit 1000*b*. Preferably, the control unit 1000*b* may output a voice, for example, "door locked", or an alarm, warning sound, etc. using the opening and closing checking unit 570*b* connected to the speaker.

Meanwhile, when receiving a manual opening signal from the manual opening button 900*b*, the control unit 1000*b* controls the operation of the dead bolt moving unit 500*b* such that even when the control unit 1000*b* receives a door-close signal from the opening-and-closing sensing unit 490*b*, the door is not locked. The reason for this is to control the door such that the door is not automatically locked, given the fact that if the door, for example, installed in crowded places such as public offices or venues, is automatically locked when closed, people cannot rapidly pass through the door.

When the user pushes the opening button 700*b* provided in the inner casing 120*b* to open the door 10*b* and go outside, the control unit 1000*b* receives a signal from the opening button and releases the locked state of the bolt moving unit 500*b* in the operating manner illustrated in FIG. 30. Subsequently, when the user pushes the door handle 420*b*, the door 10*b* opens in the operating manner illustrated in FIG. 31.

As described above, in a digital opening and closing device for an entrance according to the present invention, when pushing or pulling a door handle of a door after unlocking the door, a user can easily sense that the door is opening while feeling both variation of the speed of the door handle when a roller begins to move upwards and the rolling motion of the roller. Furthermore, the operation of opening the door can be smoothly conducted. Therefore, the safety in opening or closing the door, as well as convenience in use can be markedly enhanced.

In addition, the opening and closing device is operated in a pushing or pulling fashion rather than in a rotating fashion. Therefore, even children, the elderly and disabled persons or a user who uses both hands to hold objects can easily open the door. Thus, convenience in use and practicality can be improved. For places such as public offices or venues which are crowded, an accident can be prevented because it is easy to open the door. Particularly, in case of fire, if a handle of the door melts in a fire, it may be impossible to rotate the door handle. However, in the present invention, because the opening and closing device can be easily operated in a pushing fashion, the risk of an accident can be markedly reduced.

Furthermore, when the door is closed, it can be automatically locked. Both security and safety can thus be enhanced.

Moreover, for doors used in crowded places such as public offices or venues, the opening and closing device is controlled such that when the door is closed, it is prevented from being automatically locked, thereby enabling people to rapidly pass through the door. Therefore, the desirability of the opening and closing device can be enhanced.

Moreover, in case of fire, a door opening and closing unit is automatically unlocked so that people can rapidly evacuate and an accident can be prevented.

Although the preferred embodiments of the present invention have been disclosed for illustrative purposes, the present invention is not limited to these embodiments. Those skilled in the art will appreciate that various modifications, additions and substitutions are possible, without departing from the scope and spirit of the invention as disclosed in the accompanying claims. These modification, additions and substitutions must be regarded as being equivalents falling within the bounds of the present invention.

We claim:

1. A digital opening and closing device for an entrance, comprising:

a housing comprising an outer casing installed on an outdoor surface of a door, and an inner casing coupled to the outer casing with the door interposed between the inner and outer casings;

a password input unit provided on the outer casing of the housing, the password input unit being used in inputting a password;

a door opening and closing unit installed in the housing, the door opening and closing unit conducting an operation of opening or closing the door in response to a control signal of a control unit;

the control unit comparing a password input to the password input unit with a preset reference password and controlling the door opening and closing operation of the door opening and closing unit;

an opening button provided on the inner casing of the housing, the opening button being connected to the control unit and used in automatically opening the door;

a manual opening button applying a signal to the control unit to prevent the door from being automatically locked when the door is closed; and a power supply supplying drive power to the elements, wherein the door opening and closing unit is configured such that: a door is opened by an operation of pushing or pulling a door handle in a direction in which the door opens; when the door handle is pushed or pulled, opening of the door is sensed by a reduction in speed at which the door handle is pushed or pulled; and locking of the door can be selectively controlled in such a way that the door is automatically locked when the door is closed, or the door is prevented from being automatically locked when the door is closed.

2. The digital opening and closing device of claim 1, further comprising an identification unit provided in the outer casing of the housing, the identification unit functioning to identify a visitor, wherein the control unit compares information input to the identification unit with preset reference information and controls the door opening and closing operation of the door opening and closing unit.

3. The digital opening and closing device of claim 2, wherein the identification unit comprises at least one of a door phone camera, a card reader, a fingerprint reader and an iris reader.

4. The digital opening and closing device of claim 1, wherein the door opening and closing unit comprises:

a body unit having, in a side surface thereof, a first opening in which a latch bolt is disposed, a second opening in which a dead bolt is disposed, and a third opening in which a sensing bolt is disposed;

door handles respectively provided below the inner and outer casings of the housing, each of the door handles being configured to be pushed or pulled;

a latch bolt moving unit configured such that when either of the door handles is pushed or pulled, the latch bolt is retracted into the door to allow the door to open, and when the door handle that has been pushed or pulled is released, the latch bolt is ejected outwards from the door to maintain the door in a closed state;

an opening-and-closing sensing unit for sensing an operation of opening or closing the door and transmitting a sensing signal to the control unit; and a dead bolt moving unit controlling movement of the dead bolt in response to a control signal of the control unit and locking or unlocking the door.

5. The digital opening and closing device of claim 4, wherein each of the door handles comprises:

a mounting bracket fixed to a corresponding one of the outer and inner casings of the housing, the mounting bracket having a receiving space in which a first end of a grip part is disposed so as to be movable forwards or backwards; and the grip part inserted at the first end thereof into the receiving space of the mounting bracket, the grip part being configured to be pushed or pulled.

6. The digital opening and closing device of claim 4, wherein the control unit, when receiving a door-close signal from the opening-and-closing sensing unit, controls operation of the dead bolt moving unit such that the door is locked.

7. The digital opening and closing device of claim 4, wherein the control unit, when receiving the signal of the manual opening button, controls operation of the dead bolt moving unit such that the door is prevented from being locked.

8. The digital opening and closing device of claim 4, further comprising an opening and closing checking unit, comprising a sensor sensing conditions of movement of the dead bolt moving unit and transmitting a sensing signal to the control unit, the opening and closing checking unit being connected to a speaker so that whether the door is locked or not is output in a voice in response to the sensing signal of the sensor.

9. The digital opening and closing device of claim 4, wherein the latch bolt moving unit comprises:

a movable member coupled at opposite ends thereof to the respective door handles, the movable member being horizontally moved by pushing or pulling either of the door handles, with a lift guide block provided on a medial portion of an upper surface of the movable member, the lift guide block guiding upward movement of a roller;

a rotating unit coupled at a medial portion thereof to a rotation shaft, the rotation shaft fixed in place and oriented in a direction parallel to the movable member, with the roller provided in a first end of the rotating unit, the roller making contact with the lift guide block, and with a locking stop provided on a second end of the rotating unit, wherein when the movable member is horizontally moved, the rotating unit is rotated around the rotation shaft;

an actuating member locked at a first end thereof to the locking stop of the rotating unit and coupled at a second end thereof to the latch bolt disposed in the first opening of the body unit, the actuating member being moved to leftwards or rightwards depending on a direction of the rotation of the rotating unit; and a restoring spring wrapped around the rotation shaft of the rotating unit, the restoring spring fixed at a first end thereof to an inner surface of the body unit and fixed at a second end thereof to the second end of the rotating unit so that the rotating unit is returned to an original state thereof by the restoring spring.

10. The digital opening and closing device of claim 9, wherein the lift guide block includes an inclined surface having an upwardly curved shape so that the roller rolls on the inclined surface and moves upwards.

11. The digital opening and closing device of claim 9, wherein until the lift guide block of the movable member begins to push the roller, the door handles are easily pushed or pulled, and when the lift guide block pushes the roller so that the roller rolls and moves upwards along the inclined surface of the lift guide block, a speed at which the door handles are pushed or pulled is reduced.

12. The digital opening and closing device of claim 9, wherein the rotating unit comprises: a pair of links spaced apart from each other by a predetermined distance, with a coupling hole formed in a medial portion of each of the links so that the links are coupled to the rotation shaft through the coupling holes; bent parts respectively provided on the first ends of the links and bent in a direction parallel to a direction in which the lift guide block moves, with the roller coupled to the bent parts by a hinge; and a connection part connecting the second ends of the links to each other, with the locking stop connected to the connection part, the locking stop being bent downwards.

13. The digital opening and closing device of claim 9, wherein the actuating member has: a locking slot formed in a bottom surface of a first end of the actuating member so that the locking stop of the rotating unit is locked to the locking slot; and a guide slot formed in a side surface of the actuating member, with a stopper coupled to the guide slots, the stopper being used in limiting rotation of the locking stop.

14. The digital opening and closing device of claim 4, wherein the dead bolt moving unit comprises:

a motor configured to be operated in response to a signal of the control unit;

an actuating shaft rotated leftwards or rightwards by the operation of the motor;

a rotating lever coupled to the actuating shaft and disposed in the body unit, the rotating lever being rotated leftwards or rightwards by the rotation of the actuating shaft; and an opening and closing member coupled to the dead bolt disposed in the second opening of the body unit, the opening and closing member being moved leftwards or rightwards in conjunction with the rotation of the rotating lever.

15. The digital opening and closing device of claim 14, wherein the actuating shaft has a rectangular cross-section, and the rotating lever has in a central portion thereof a rectangular hole into which the actuating shaft is fitted so that when the actuating shaft rotates, the rotating lever is rotated along with the actuating shaft.

16. The digital opening and closing device of claim 14, wherein the opening and closing member has:

a guide slot in a central portion thereof, the guide slot extending a predetermined length in a longitudinal direction of the opening and closing member, with a support pin disposed in the guide slot, the support pin protruding from an inner surface of the body unit;

a locking depression formed at a predetermined position in an upper edge of the opening and closing member so that the rotating lever is locked to the locking depression; and locking notches respectively formed in opposite side edges of the locking depression so that the rotating lever, when rotating, is locked to either of the locking notches and prevented from being removed from the locking depression.

17. The digital opening and closing device of claim 14, wherein a tension spring is wrapped around the support pin, the tension spring elastically supporting the rotating lever.

18. The digital opening and closing device of claim 1, wherein the power supply comprises an auxiliary power supply capable of supplying emergency power.

19. The digital opening and closing device of claim 1, further comprising a fire sensor connected to the control unit, the fire sensor sensing a temperature, wherein the control unit controls the door opening and closing unit such that when the temperature sensed by the fire sensor exceeds a preset reference temperature, a locked state of the door opening and closing unit is released.

20. A digital opening and closing device for an entrance, comprising:

a housing comprising an outer casing installed on an outdoor surface of a door, and an inner casing coupled to the outer casing with the door interposed between the inner and outer casings;

a password input unit provided on the outer casing of the housing, the password input unit being used in inputting a password;

a door opening and closing unit installed in the housing, the door opening and closing unit conducting an operation of opening or closing the door in response to a control signal of a control unit;

the control unit comparing a password input to the password input unit with a preset reference password and controlling the door opening and closing operation of the door opening and closing unit;

an opening button provided on the inner casing of the housing, the opening button being connected to the control unit and used in automatically opening the door;

a manual opening button applying a signal to the control unit to prevent the door from being automatically locked when the door is closed; and a power supply supplying drive power to the elements, wherein the door opening and closing unit is configured such that: a door is opened by an operation of pushing or pulling a door handle in a direction in which the door opens; when the door handle is pushed or pulled, opening of the door is sensed by a reduction, due to rolling motion of a roller separately installed in the door opening and closing unit, in speed at which the door handle is pushed or pulled; and locking of the door can be selectively controlled in such a way that the door is automatically locked when the door is closed, or the door is prevented from being automatically locked when the door is closed.

21. The digital opening and closing device of claim 20, further comprising an identification unit provided in the outer casing of the housing, the identification unit identifying a visitor, wherein the control unit compares information input to the identification unit with preset reference information and controls the door opening and closing operation of the door opening and closing unit.

22. The digital opening and closing device of claim 21, wherein the identification unit comprises at least one of a door phone camera, a card reader, a fingerprint reader and an iris reader.

23. The digital opening and closing device of claim 20, wherein the door opening and closing unit comprises:

a body unit having, in a side surface thereof, a first opening in which a latch bolt is disposed, a second opening in which a dead bolt is disposed, and a third opening in which a sensing bolt is disposed;

door handles respectively provided below the inner and outer casings of the housing, each of the door handles being configured to be pushed or pulled;

a latch bolt moving unit configured such that when either of the door handles is pushed or pulled, the latch bolt is retracted into the door, and when the door handle that has been pushed or pulled is released, the latch bolt is ejected outwards from the door;

an opening-and-closing sensing unit for sensing an operation of opening or closing the door and transmitting a sensing signal to the control unit; and a dead bolt moving unit controlling movement of the dead bolt in response to a control signal of the control unit and locking or unlocking the door.

24. The digital opening and closing device of claim 23, wherein each of the door handles comprises:

a mounting bracket fixed to a corresponding one of the outer and inner casings of the housing, the mounting bracket having a receiving space in which a first end of a grip part is disposed so as to be movable forwards or backwards; and the grip part inserted at the first end thereof into the receiving space of the mounting bracket, the grip part being configured to be pushed or pulled.

25. The digital opening and closing device of claim 23, wherein the control unit, when receiving a door-close signal from the opening-and-closing sensing unit, controls operation of the dead bolt moving unit such that the door is locked.

26. The digital opening and closing device of claim 25, wherein the control unit, when receiving the signal of the manual opening button, controls operation of the dead bolt moving unit such that the door is prevented from being locked.

27. The digital opening and closing device of claim 23, further comprising an opening and closing checking unit, comprising a sensor sensing conditions of movement of the dead bolt moving unit and transmitting a sensing signal to the control unit, the opening and closing checking unit being connected to a speaker so that whether the door is locked or not is output in a voice in response to the sensing signal of the sensor.

28. The digital opening and closing device of claim 23, wherein the latch bolt moving unit comprises:

a movable member coupled at opposite ends thereof to the respective door handles, the movable member being horizontally moved by pushing or pulling either of the door handles, with a guide block protruding from an upper surface of the movable member, the guide block having an inclined side surface;

an actuating member having in a first end thereof the roller making contact with the inclined side surface of the guide block, the actuating member being coupled at a second end thereof to the latch bolt disposed in the first opening of the body unit, wherein when the movable member is moved, the actuating member is moved in a direction perpendicular to a direction of the movement of the movable member by the roller moving along the inclined side surface of the guide block; and a restoring spring installed between one surface of the body unit and the mounting bracket of the corresponding door handle, the restoring spring being configured to return the movable member to an original state thereof when no external force is applied to the latch bolt moving unit.

29. The digital opening and closing device of claim 28, wherein guide slots are respectively formed in opposite side surfaces of the actuating member; a protrusion pin is disposed in each of the guide slots, the protrusion pin protruding from the body unit; and an elastic spring is installed between a pin for supporting the roller and the protrusion pin, the elastic spring configured to return the actuating member to an original position thereof.

30. The digital opening and closing device of claim 28, wherein until the guide block of the movable member begins to push the roller, the door handles are easily pushed or pulled, and when the guide block pushes the roller so that the roller rolls and moves along the inclined side surface of the guide block, a speed at which the door handles are pushed or pulled is reduced.

31. The digital opening and closing device of claim 23, wherein the dead bolt moving unit comprises:

a motor configured to be operated in response to a signal of the control unit;

an actuating shaft rotated leftwards or rightwards by the operation of the motor;

a rotating lever coupled to the actuating shaft and disposed in the body unit, the rotating lever being rotated leftwards or rightwards by the rotation of the actuating shaft; and an opening and closing member coupled to the dead bolt disposed in the second opening of the body unit, the opening and closing member being moved leftwards or rightwards in conjunction with the rotation of the rotating lever.

32. The digital opening and closing device of claim 31, wherein the actuating shaft has a rectangular cross-section, and the rotating lever has in a central portion thereof a rectangular hole into which the actuating shaft is fitted so that when the actuating shaft rotates, the rotating lever is rotated along with the actuating shaft.

33. The digital opening and closing device of claim 31, wherein the opening and closing member has:

a guide slot in a central portion thereof, the guide slot extending a predetermined length in a longitudinal direction of the opening and closing member, with a support pin disposed in the guide slot, the support pin protruding from an inner surface of the body unit;

a locking depression formed at a predetermined position in an upper edge of the opening and closing member so that the rotating lever is locked to the locking depression; and locking notches respectively formed in opposite side edges of the locking depression so that the rotating lever, when rotating, is locked to either of the locking notches and prevented from being removed from the locking depression.

34. The digital opening and closing device of claim 33, wherein a tension spring is wrapped around the support pin, the tension spring elastically supporting the rotating lever.

35. The digital opening and closing device of claim 23, wherein the latch bolt moving unit comprises:

a movable member passing through the body unit and coupled at opposite ends thereof to the respective door handles, the movable member being horizontally moved by pushing or pulling either of the door handles, with a lift guide block provided on a medial portion of an upper surface of the movable member, the lift guide block guiding upward movement of a roller;

a rotating unit disposed across an upper surface of the movable member, the rotating unit being coupled at a first end thereof to a hinge shaft, with the roller provided in a lower surface of a medial portion of the rotating unit, the roller making contact with the lift guide block, the rotating unit including a bent part on a second thereof, wherein when the movable member is horizontally moved, the rotating unit is rotated around the hinge shaft by the roller moving upwards along the lift guide block;

a latch bolt coupling unit locked at a first end thereof to the bent part of the rotating unit and coupled at a second end thereof to the latch bolt disposed in the first opening of the body unit, the latch bolt coupling unit being moved to leftwards or rightwards depending on a direction of the rotation of the rotating unit; and a restoring spring wrapped around the hinge shaft, the restoring spring fixed at a first end thereof to an inner surface of the body unit and fixed at a second end thereof to the rotating unit so that the rotating unit is returned to an original state thereof by the restoring spring.

36. The digital opening and closing device of claim 35, wherein the lift guide block includes an inclined surface having an upwardly curved shape so that the roller rolls on the inclined surface and moves upwards.

37. The digital opening and closing device of claim 35, wherein until the lift guide block of the movable member begins to push the roller, the door handles are easily pushed or pulled, and when the lift guide block pushes the roller so that the roller rolls and moves upwards along the inclined surface of the lift guide block, a speed at which the door handles are pushed or pulled is reduced.

38. The digital opening and closing device of claim 35, wherein the rotating unit comprises:

a pair of links having in a first end thereof a hinge coupling hole, with the bent part provided on a second end of the pair of links, the bent part being bent at a predetermined position to have a downward inclined surface extending from a first end of the bent part to the predetermined position and an upward inclined surface extending from the predetermined position to a second end of the bent part;

the hinge shaft coupled to the hinge coupling hole of the pair of links spaced apart from each other by a predetermined distance;

a connection part connecting medial portions of the pair of links to each other, with coupling surfaces bent downwards from respective opposite ends of the connection part; and the roller coupled to the coupling surfaces of the connection part by a hinge.

39. The digital opening and closing device of claim 35, wherein a roller pin is provided on an outer surface of the first end of the latch bolt coupling unit and placed on the bent part of the pair of links of the rotating unit so as to be movable along the inclined surface of the bent part.

40. The digital opening and closing device of claim 35, further comprising an auxiliary power supply provided in the power supply, the auxiliary power supply being capable of supplying emergency power.

41. The digital opening and closing device of claim 35, further comprising a fire sensor connected to the control unit, the fire sensor sensing a temperature, wherein the control unit controls the door opening and closing unit such that when the temperature sensed by the fire sensor exceeds a preset reference temperature, a locked state of the door opening and closing unit is released.

42. The digital opening and closing device of claim 23, wherein the dead bolt moving unit comprises a motor configured to be operated in response to a signal of the control unit;

an actuating shaft rotated leftwards or rightwards by the operation of the motor;

a rotating lever coupled to the actuating shaft and disposed in the body unit, the rotating lever being rotated leftwards or rightwards by the rotation of the actuating shaft; and an opening and closing member coupled to the dead bolt disposed in the second opening of the body unit, the opening and closing member being moved leftwards or rightwards in conjunction wich the rotation of the rotating lever.

43. The digital opening and closing device of claim 42, wherein the actuating shaft has a rectangular cross-section, and the rotating lever has in a central portion thereof a rectangular hole into which the actuating shaft is fitted so that when the actuating shaft rotates, the rotating lever is rotated along with the actuating shaft.

44. The digital opening and closing device of claim 42, wherein the opening and closing member has:

a guide slot in a central portion thereof, the guide slot extending a predetermined length in a longitudinal direction of the opening and closing member, wich a support pin disposed in the guide slot, the support pin protruding from an inner surface of the body unit;

a locking depression formed at a predetermined position in an upper edge of the opening and closing member so that the rotating lever is locked to the locking depression; and locking notches respectively formed in opposite side edges of the locking depression so that the rotating lever, when rotating, is locked to either of the locking notches and prevented from being removed from the locking depression.

45. The digital opening and closing device of claim 44, wherein a tension spring is wrapped around the support pin, the tension spring elastically supporting the rotating lever.

46. The digital opening and closing device of claim 20, wherein the power supply comprises an auxiliary power supply capable of supplying emergency power.

47. The digital opening and closing device of claim 20, further comprising a fire sensor connected to the control unit, the fire sensor sensing a temperature, wherein the control unit controls the door opening and closing unit such that when the temperature sensed by the fire sensor exceeds a preset reference temperature, a locked state of the door opening and closing unit is released.

* * * * *